US008606138B2

(12) United States Patent
Okano et al.

(10) Patent No.: US 8,606,138 B2
(45) Date of Patent: Dec. 10, 2013

(54) COOLING DEVICE HAVING A TURBULENCE GENERATING UNIT

(75) Inventors: Satoshi Okano, Kanagawa (JP); Takayuki Nishimura, Tokyo (JP); Kenichi Takehara, Kanagawa (JP); Yasuaki Iijima, Kanagawa (JP); Hiromitsu Fujiya, Kanagawa (JP); Tomoyasu Hirasawa, Kanagawa (JP); Masanori Saitoh, Tokyo (JP); Shingo Suzuki, Kanagawa (JP); Keisuke Yuasa, Kanagawa (JP); Keisuke Ikeda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 508 days.

(21) Appl. No.: 12/844,384

(22) Filed: Jul. 27, 2010

(65) Prior Publication Data

US 2011/0030927 A1 Feb. 10, 2011

(30) Foreign Application Priority Data

| | | |
|---|---|---|
| Aug. 5, 2009 | (JP) | 2009-182895 |
| Aug. 5, 2009 | (JP) | 2009-182899 |
| Nov. 11, 2009 | (JP) | 2009-257656 |

(51) Int. Cl.
*G03G 21/20* (2006.01)

(52) U.S. Cl.
USPC ..... 399/94; 399/341; 165/89; 165/90; 492/46

(58) Field of Classification Search
USPC ..... 399/94, 341; 492/46
See application file for complete search history.

(56) References Cited

U.S. PATENT DOCUMENTS

| | | | | |
|---|---|---|---|---|
| 3,633,663 | A * | 1/1972 | Tafel | 165/89 |
| 3,870,100 | A | 3/1975 | Korting et al. | |
| 3,976,423 | A * | 8/1976 | Schmidt | 432/236 |
| 4,315,299 | A | 2/1982 | Saint Marcoux et al. | |
| 4,351,386 | A * | 9/1982 | Kobler | 165/89 |
| 4,913,224 | A * | 4/1990 | Moran | 165/89 |
| 5,437,819 | A * | 8/1995 | Hardison | 261/94 |
| 6,675,876 | B2 * | 1/2004 | Yamashita et al. | 165/89 |
| 7,025,123 | B1 * | 4/2006 | Gerndt et al. | 165/90 |
| 7,352,979 | B2 * | 4/2008 | Funabiki et al. | 399/68 |

(Continued)

FOREIGN PATENT DOCUMENTS

| | | |
|---|---|---|
| JP | 1-136279 U | 9/1989 |
| JP | 2-25333 A | 1/1990 |

(Continued)

OTHER PUBLICATIONS

English machine translation of Takahashi (JP 2000-196276 A); "Electronic Apparatus"; published Jul. 14, 2000; by Takahashi, Masahiro.*

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

In a cooling device that includes a cooling roller that comprises a hollow tubular member and a cooling medium transport unit for transporting a cooling liquid to the inside of the cooling roller and contacts a sheet-like member to cool down the paper, a turbulence generating unit that generates turbulence in a cooling liquid is disposed near an inner wall of the outer tube.

9 Claims, 31 Drawing Sheets

(56) References Cited

U.S. PATENT DOCUMENTS

| | | | | |
|---|---|---|---|---|
| 7,420,141 | B2 * | 9/2008 | Kitano et al. | 219/469 |
| 7,725,055 | B2 * | 5/2010 | Smeyers et al. | 399/159 |
| 8,306,449 | B2 * | 11/2012 | Stresau | 399/94 |
| 8,351,817 | B2 * | 1/2013 | Saitoh et al. | 399/94 |
| 2009/0156379 | A1 * | 6/2009 | Rodal | 492/46 |
| 2010/0008694 | A1 | 1/2010 | Okano et al. | |
| 2010/0008695 | A1 | 1/2010 | Okano et al. | |
| 2010/0129107 | A1 * | 5/2010 | Takehara et al. | 399/92 |
| 2011/0052248 | A1 * | 3/2011 | Nishimura et al. | 399/94 |
| 2011/0052249 | A1 * | 3/2011 | Iijima et al. | 399/94 |
| 2012/0315069 | A1 * | 12/2012 | Ikeda et al. | 399/341 |

FOREIGN PATENT DOCUMENTS

| | | | |
|---|---|---|---|
| JP | 3-36832 | U | 4/1991 |
| JP | 5-33112 | A | 2/1993 |
| JP | 8-129310 | | 5/1996 |
| JP | 8-338890 | A | 12/1996 |
| JP | 10-207155 | | 8/1998 |
| JP | 11-7218 | | 1/1999 |
| JP | 2000-75709 | | 3/2000 |
| JP | 2000-196276 | | 7/2000 |
| JP | 2002-229366 | | 8/2002 |
| JP | 3478676 | | 10/2003 |
| JP | 2004-285952 | A | 10/2004 |
| JP | 2005-234205 | | 9/2005 |
| JP | 2005-234206 | | 9/2005 |
| JP | 2005-292578 | | 10/2005 |
| JP | 2005-292594 | | 10/2005 |
| JP | 2005-298109 | | 10/2005 |
| JP | 2006-3819 | A | 1/2006 |
| JP | 2006-58493 | | 3/2006 |
| JP | 2006-91095 | | 4/2006 |
| JP | 2006-225115 | | 8/2006 |
| JP | 2006-258953 | | 9/2006 |
| JP | 2007-78917 | | 3/2007 |
| JP | 2007-119109 | | 5/2007 |
| JP | 3987399 | | 7/2007 |
| JP | 4265996 | | 2/2009 |
| JP | 4380559 | | 10/2009 |
| JP | 4445336 | | 1/2010 |

OTHER PUBLICATIONS

Chinese Office Action issued Feb. 24, 2012, in Patent Application No. 201010247336.X (with English-language translation).

Office Action issued Apr. 26, 2013 in Japanese Patent Application No. 2009-182895.

Office Action issued May 17, 2013 in Japanese Patent Application No. 2009-182899.

Office Action issued May 17, 2013 in Japanese Patent Application No. 2009-257656.

* cited by examiner

COOLING DEVICE HAVING A TURBULENCE GENERATING UNIT

CROSS-REFERENCE TO RELATED APPLICATIONS

The present application claims priority to and incorporates by reference the entire contents of Japanese Patent Application No. 2009-182899 filed in Japan on Aug. 5, 2009, Japanese Patent Application No. 2009-182895 filed in Japan on Aug. 5, 2009 and Japanese Patent Application No. 2009-257656 filed in Japan on Nov. 11, 2009.

BACKGROUND OF THE INVENTION

1. Field of the Invention

The present invention relates to a cooling device used for an image forming device such as a printer, a facsimile, and a copy machine.

2. Description of the Related Art

Image forming devices that form a toner image on a paper that is a sheet-like member using an electronic photography technique and cause a toner of the toner image to melt and be fused on the paper through a heat fixing device have been known. Generally, the temperature of the heat fixing device depends on a type of a toner or a paper, a paper transport speed, etc. but is set and controlled to a temperature of about 180° C. to 200° C. to quickly fuse the toner. A surface temperature of the paper after passing through the heat fixing device depends on a heat capacity (e.g., specific heat or density) of the paper but has a high temperature of, for example, about 100° C. to 130° C. Since a melting temperature of the toner is comparatively lower, at a point of time directly after passing through the heat fixing device, the toner remains a slightly softened state and is in an adhesive state for a while until the paper is cooled down. Thus, when an image output operation is continuously repeated and papers that passed through the heat fixing device are stacked on a discharged paper receiving unit, if the toner on the paper is not sufficient hardened but in a soft state, the toner on the paper may be attached to another paper, so that a so-called blocking phenomenon may be caused to remarkably degrade the image quality.

In an image forming device disclosed in Japanese Patent Application Laid-open No. 2006-003819, a cooling device with a cooling roller that is rotatably supported to a bracket through a bearing and comes into contact with a paper to cool the paper while transporting the paper is disposed at a down stream side of a heat fixing device in a paper transport direction. The paper that passed through the heat fixing device is cooled down by the cooling roller of the cooling device, so that the toner on the paper is also cooled down and hardened, thereby preventing the occurrence of the blocking phenomenon. The cooling roller has a tubular structure. A cooling liquid flows inside the cooling roller from one end side to the other end side in a longitudinal direction of the cooling roller, and so the cooling roller raised in temperature by depriving heat from the paper is cooled down by the cooling liquid.

In recent years, needs for light printing such as high-speed printing for telephone bills, receipts, etc. or printing of glossy color images on thick papers or coat papers have been increased. In such light printing, since a large amount of printing is performed at a high speed, a high-temperature sheet-like member needs to be cooled down in a shorter time. Unlike printings for office use, since the frequency of color printing is high and many glossy images are present, the fixing unit fixes images on the sheet-like member at a higher temperature, so that high efficiency cooling is required.

However, if the cooling liquid simply flows inside the cooling roller, the temperature of the cooling liquid near an inner wall of the cooling roller is excessively raised, and so it is impossible to effectively cool down the cooling roller by the cooling liquid. As a result, there is a problem in that it is difficult to appropriately cool down the paper through the cooling roller, etc.

Further, in an image forming device disclosed in Japanese Patent Application Laid-open No. 2006-003819, a cooling device with a cooling roller that comes into contact with the paper to cool down the paper while transporting the paper is disposed at a down stream side of a heat fixing device in a paper transport direction. The paper that passed through the heat fixing device is cooled down by the cooling roller of the cooling device, so that the toner on the paper is also cooled down and hardened, thereby preventing the occurrence of the blocking phenomenon. The cooling roller has a tubular structure. A cooling liquid flows inside the cooling roller from one end side to the other end side in a longitudinal direction of the cooling roller, and the cooling roller raised in temperature by depriving heat from the paper is cooled by the cooling liquid.

However, since the cooling liquid flows inside the cooling roller in one direction from one end side to the other end side in the longitudinal direction of the cooling roller through a single path, the temperature of the cooling liquid is lowest at the one end side, and as it is closer to the other end side, the temperature of the cooling liquid is further raised by heat absorbed by the cooling roller from the paper. For this reason, there occurs a problem in that a temperature difference in the longitudinal direction of the cooling roller causes a cooling efficiency difference, etc.

SUMMARY OF THE INVENTION

It is an object of the present invention to at least partially solve the problems in the conventional technology.

According to an aspect of the present invention there is provided a cooling device. The cooling device includes: a cooling roller that comprises a hollow tubular member; a cooling medium transport unit that transports a cooling liquid to the inside of the tubular member; and a turbulence generating unit that is disposed near an inner wall of the tubular member to generate turbulence in the cooling liquid. The cooling device is configured to cause the cooling roller to contact a sheet-like member to cool down the sheet-like member.

According to another aspect of the present invention there is provided a cooling device. The cooling device includes: a cooling roller that contacts a sheet-like member to cool down the sheet-like member; and a cooling medium feeding/retrieving unit that feeds a cooling medium to the inside of the cooling roller from a feed port disposed in the cooling roller and retrieves the cooling medium drained to the outside of the cooling roller from a drain port disposed in the cooling roller. The cooling roller has a dual tube structure in which an inner tube is disposed inside an outer tube and which has an outside flow passage in which the cooling medium flows through a space between the outer tube and the inner tube and an inside flow passage in which the cooling medium flows inside the inner tube, and an opening that causes the outside flow passage to communicate with the inside flow passage is formed in a middle of the inner tube in a longitudinal direction of the cooling roller. A first passage in which the cooling medium fed by the cooling medium feeding/retrieving unit flows through the outside flow passage from one end side to the other end side of the cooling roller and flows into the inside flow passage through the opening and a second passage in which the cooling medium fed by the cooling medium feeding/retrieving unit flows through the outside flow passage from the other end side to the one end side of the cooling roller and flows into the inside flow passage through the opening are formed.

According to still another aspect of the present invention there is provided a cooling device. The cooling device includes: a cooling roller that contacts a sheet-like member to cool down the sheet-like member; and a cooling medium feeding/retrieving unit that feeds the cooling medium to the inside of the cooling roller from a feed port disposed in the cooling roller and retrieves the cooling medium drained to the outside of the cooling roller from a drain port disposed in the cooling roller. The cooling roller has a dual tube structure in which an inner tube is disposed inside an outer tube and which has an outside flow passage in which the cooling medium flows through a space between the outer tube and the inner tube and an inside flow passage in which the cooling medium flows inside the inner tube, and an opening that causes the outside flow passage to communicate with the inside flow passage is formed in a middle of the inner tube in a longitudinal direction of the cooling roller. A first passage in which the cooling medium fed by the cooling medium feeding/retrieving unit flows through the inside flow passage, flows into the outside flow passage through the opening, and flows toward at least one end side of the cooling roller and a second passage in which the cooling medium fed by the cooling medium feeding/retrieving unit flows through the inside flow passage, flows into the outside flow passage through the opening, and flows toward at least the other end side of the cooling roller are formed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, exemplary embodiments of the present invention will be described.

First Embodiment

A cooling roller and a cooling device according to embodiments of the present invention will be described in connection with an image forming device which fixes a toner on a recording paper through a heat fixing unit. However, the cooling roller and the cooling device of the present invention are not limited thereto and can be applied to any device requiring cooling of a sheet medium.

The cooling roller as a cooling unit has a tubular structure and allows the cooling liquid to flow and circulate thereinside to cool down a surface of the cooling roller. The cooling device having the cooling roller is disposed in a paper transport path directly behind a heat fixing unit and comes into contact with the paper while transporting the paper through the cooling roller, thereby removing heat from the paper to cool down the paper.

Figure 2:
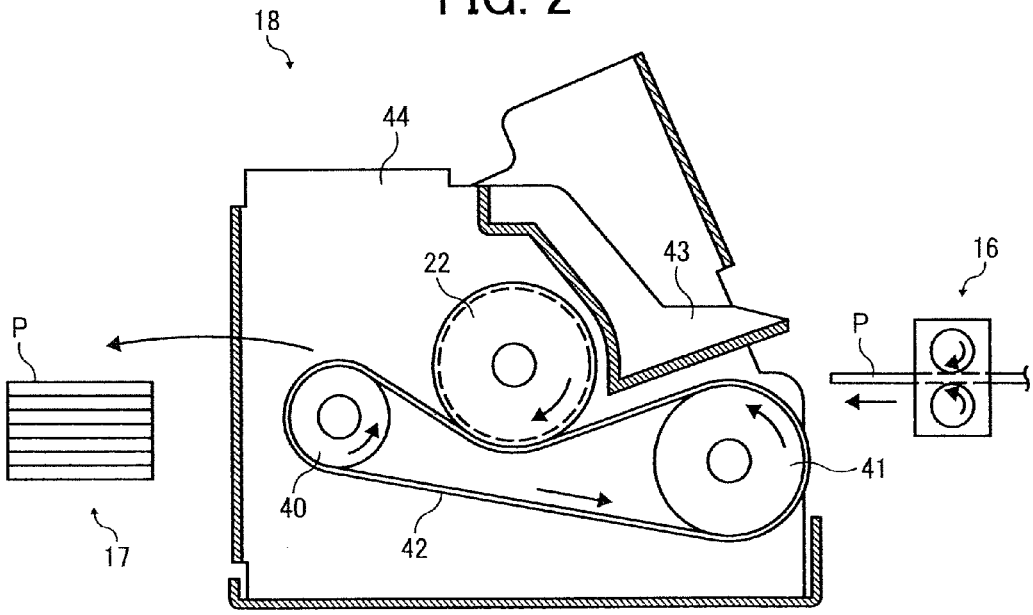
FIG. 2 is an explanation view illustrating an example of a schematic configuration of a cooling device with a cooling roller that also performs a paper transport function according to the first embodiment.

FIG. 2 is a schematic view illustrating an example of a cooling device 18 having a cooling roller 22 of the present invention which also performs a paper transport function. In the cooling device 18, a roller 40 and a roller 41 which are disposed apart from each other in a transport direction of a paper P, which is an example of a sheet-like member, (a left-right direction) are provided, and support and extend a transport belt 42 for transporting the paper. The roller 40 at a downstream side in the paper transport direction is used as a driving roller (connected with a driving source (not shown)), and rotates the transport belt 42 in counterclockwise direction to transport the paper from a right side to the left side in the drawing.

A heat fixing unit 16 is disposed at an upstream side of the cooling device 18 in the paper transport direction, and a discharged paper receiving unit 17 is disposed at a downstream side of the cooling device 18 in the paper transport direction. An upper guide 43 that guides the paper P transported from the heat fixing unit 16 is disposed above the roller 41. A cooling roller 22 downwardly press-contacts the transport belt 42 so as to dig into the transport belt 42 at an intermediate position between the roller 40 and the roller 41. The cooling roller 22 is rotated so as to rotate together with the transport belt 42 by transport force of the transport belt 42. A reference numeral 44 in the drawing denotes a bracket that forms a body of the cooling device 18 and fixedly or rotatably supports components such as the roller 40, the roller 41, the cooling roller 22, and the upper guide 43. The cooling device 18 is constituted as one unit by the bracket 44 and mounted to a body of an image forming device.

The paper P which was heated by the heat fixing unit 16 to become a high temperature passes through the cooling device 18 before being discharged to the discharged paper receiving unit 17. In detail, the paper P which becomes a high temperature by passing through the heat fixing unit 16 enters between the upper guide 43 and the roller 41 of the cooling device 18, then passes through a nip area formed by the cooling roller 22 and the transport belt 42, and is discharged to the discharged paper receiving unit 17. The inside of the cooling roller 22 has a tubular structure. The cooling liquid sufficiently cooled down in the outside is fed to the inside of the cooling roller 22, circulated inside the cooling roller 22, and then drained from the inside of the cooling roller 22. Since the paper P is passed through while closely contacting the cooling roller 22 in the nip area formed when the cooling roller 22 contacts the transport belt 42, the heat of the paper P is absorbed into the cooling roller 22, so that the paper P is sufficiently cooled down. For example, when the surface temperature of the paper P directly after passing through the heat fixing unit 16 is about 100° C., the paper P can be cooled down to about 50° C. to 60° C. by passing the paper P through the cooling device 18.

As will be explained later, the cooling roller 22 is communicated/connected with a cooling liquid circulation unit including a tank 101, a pump 100, a radiator 103 having a cooling fan 104 mounted therein, etc. through a rotating tube joint unit. As the sealed cooling liquid is circulated, the cooling roller 22 is cooled down.

In an image forming device of an electronic photography type, the high-temperature paper to which the toner is fixed may be curled. Further, the toner may not be completely fixed so that the papers in a stacked state stick to each other to remarkably degrade the image quality. Therefore, cooling has been required.

Conventionally, in an image forming device of an electronic photography type for office use, in order to cool down the high-temperature paper, a technique of performing cooling by directly blowing air to the top surface of the paper and the bottom surface of the belt through the cooling fan or a technique of performing cooling by holding the paper by being nipped by the heat pipe roller having an end cooled down by the cooling fan has been frequently employed.

However, in recent years, in an image forming device of an electronic photography type, needs for light printing such as high-speed printing for telephone bills, receipts, etc. or printing of glossy color images on thick papers or coat papers have been increased. In light printing through such an image forming device of an electronic photography type, a large amount of printing is performed at a high speed, and thus the high-temperature paper needs to be cooled down in a shorter time. Unlike printing for office use, since the frequency of color printing is high and glossy images are frequency printed, the fixing unit fixes an image on the paper at a higher temperature. Therefore, there is a demand for higher-efficiency cooling than the conventional method.

For this reason, liquid cooling techniques, having higher cooling efficiency than the cooling fan or the heat pipe roller described above, that passes a circulating cooling liquid through a hollow cooling roller and cools down the high-temperature paper by the cooling roller starts to be suggested.

In order to efficiently decrease the temperature of the paper, it is necessary to increase heat flux from the paper to the cooling liquid across a wall portion of the cooling roller. The heat flux between the wall portion of the cooling roller and the cooling liquid is expressed as in Expression 1 showing convective heat transfer based on "J. P Holman, "Heat Transfer Engineering (First Book), Brain Books, P 11 to P 12".

$$W=h\cdot A\cdot(Tr-Tw) \quad (1)$$

wherein

W[W]: heat flux h[W/m$^2$·° C.]: heat transfer rate of a roller inner wall surface A[m$^2$]: roller inner wall area Tr[° C.]: roller inner wall surface temperature Tw[° C.]: liquid temperature (at a position sufficiently away from a roller inner wall surface)

In Expression 1, in order to increase the heat flux W, it is necessary to decrease the liquid temperature Tw, increase the roller inner wall area A, or improve the heat transfer rate h of the roller inner wall surface.

In Expression 1, increasing the heat transfer rate or specific heat by changing a fluid that flows inside the roller from air to the cooling liquid or increasing the speed of the fluid inside the roller, in order to increase the heat flux W, corresponds to increasing the heat transfer rate h of the roller inner wall surface. Increasing the fluid speed puts a great burden on a pump that feeds the fluid to the inside of the roller and thus cannot be easily performed.

Further, in Expression 1, the heat flux W can be increased by decreasing the liquid temperature Tw. However, when the cooling fan and the radiator are used as a unit of lowering the liquid temperature Tw, it is essentially impossible to decrease the liquid temperature Tw to a temperature lower than a room temperature. Therefore, the liquid temperature Tw is not lowered as much as expected. Further, when a refrigerating machine is used as a unit of decreasing the liquid temperature Tw, the liquid temperature Tw is lowered to a temperature lower than the room temperature. However, power consumption of the refrigerating machine or the initial investment cost is increased, and it is not easy to implement.

For this reason, in the present embodiment, the occurrence of these problems is prevented, and the cooling efficiency of the paper P by the cooling roller 22 is improved.

Configuration Example 1

Figure 1A:
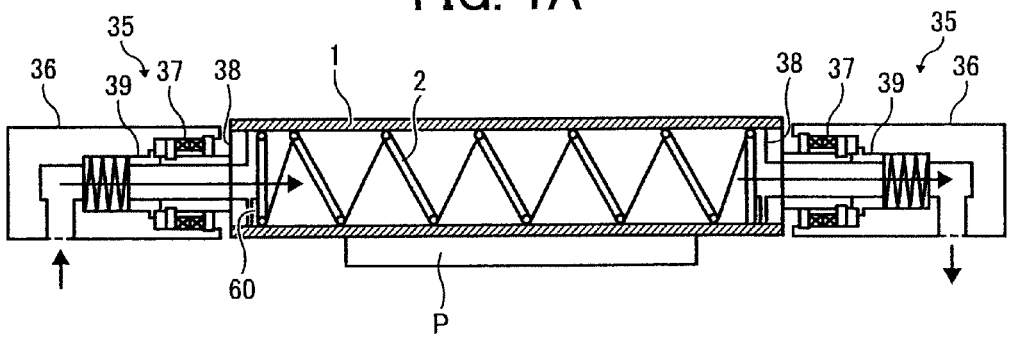
FIG. 1A is a cross-sectional view where a cooling roller of a configuration example 1 according to a first embodiment is cut in an axis direction.
Figure 1B:
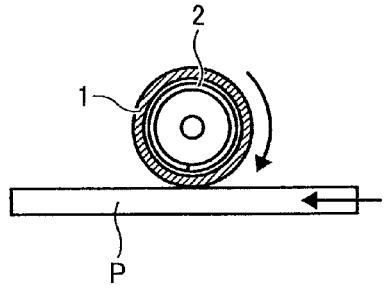
FIG. 1B is a cross-sectional view when the cooling roller of the configuration example 1 is cut in a diametrical direction.

FIG. 1A is a cross-sectional view where the cooling roller 22 of the present configuration example is cut in the axis direction, and FIG. 1B is a cross-sectional view where the cooling roller 22 of the present configuration example is cut in the diametrical direction.

In the cooling roller 22 of the present configuration example, a coil-like member 2 as a turbulence generating unit for generating turbulence in a cooling liquid in an outer tube 1 is disposed near an inner wall of the hollow outer tube 1 that forms the cooling roller 22. An end of the coil-like member 2 in the axial direction (thrust direction) of the cooling roller is fixed by a fixing bar 60 that is a protruding member formed on the inner wall of the outer tube 1. Each end of the outer tube 1 forms an opening, and a flange 38 is press-fitted into and mounted to the outer tube 1 from the each opening. A shaft of the flange 38 is press-fitted into a bearing 37 disposed inside a rotary joint 35. A seal member 39 made of resin prevents a liquid from being leaked from between an inner wall of a barrel section 36 of the rotary joint 35 and a shaft of the flange 38 to the outside of the rotary joint 35.

The paper P is held between the outer tube 1 of the cooling roller 22 and the transport belt 42 (see FIG. 2) which is not shown. As the outer tube 1 rotates in an arrow direction in FIG. 1B, the paper P is transported from the right side to the left side in the drawing.

Figure 3:
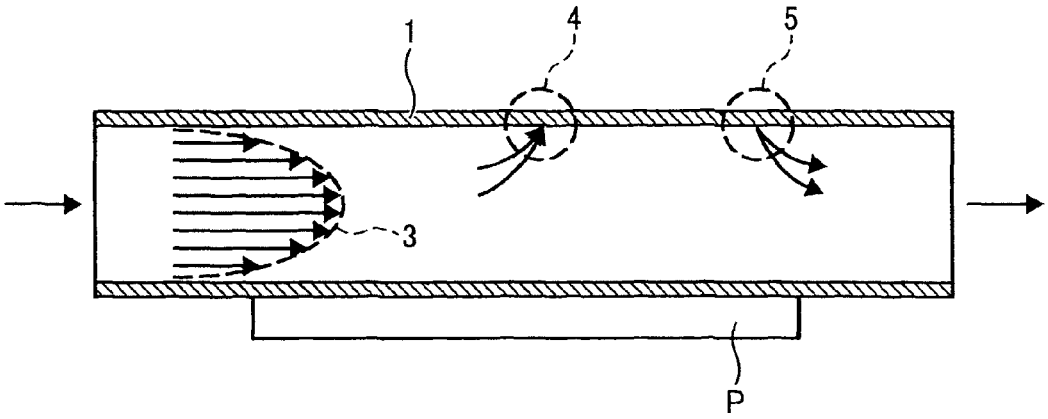
FIG. 3 is an explanation view illustrating a flow velocity distribution of the inside of the cooling roller according to the first embodiment.

In FIG. 1A, the cooling liquid that flows from the left side in the drawing to the inside of the outer tube 1 initially forms a flow field similar to a Poiseuille flow such as a flux profile 3 illustrated in FIG. 3 when the liquid is transferred in the outer tube 1. According to the flux profile 3, the flow collides with the coil-like member 2 disposed near the inner wall of the outer tube 1 shown in FIG. 1A or 1B, and thereby is agitated. As a result, as illustrated in FIG. 3, the flow is adhered to the inner wall of the outer tube 1 as shown by adhesion 4 or separated from the inner wall of the outer tube 1 as shown by separation 5.

Figure 4:
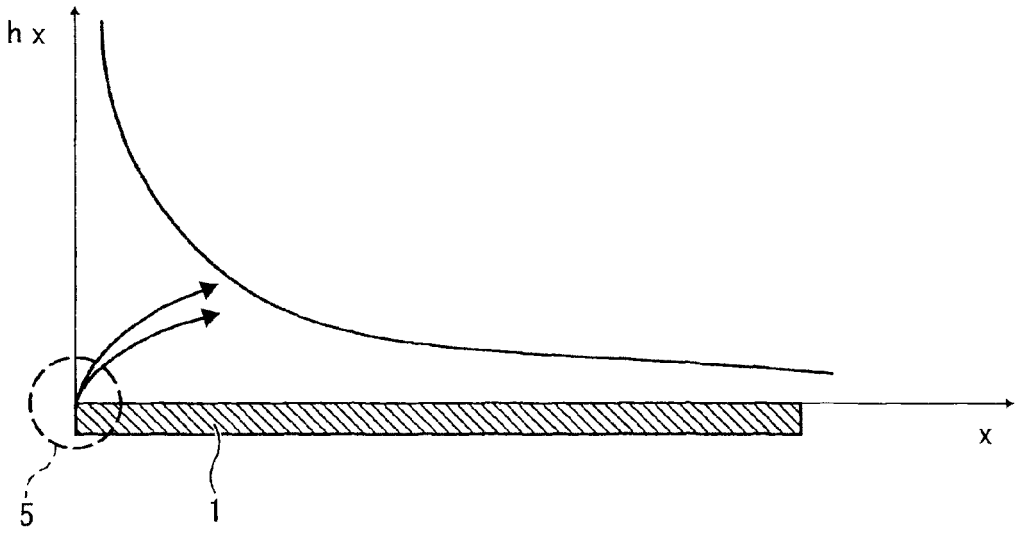
FIG. 4 is a graph illustrating a heat transfer rate distribution at a flow direction downstream side of a separation point in an inner wall of the cooling roller.

At a position where the flow is adhered to or separated from, the heat transfer rate from the inner wall of the outer tube 1 to the cooling liquid is improved. In connection with separation of the flow, as illustrated in FIG. 4, when separation 5 of the cooling liquid flow occurs on the inner wall surface of the outer tube 1, the heat transfer rate at a position x in a downstream direction of the cooling liquid from a position of separation 5 as an original point is distributed like hx based on Expression 2, which is a convective heat transfer expression when a flow is a laminar flow, stated in "J. P Holman, "Heat Transfer Engineering (First Book), Brain Books, P 144 to P 160, Expression 5-41". At this time, a theoretical heat transfer rate at a position of separation 5, that is, the original point, is increased to +∞ (but, there is no actual case where the heat transfer rate technically becomes +∞ at a position where x is zero (0)).

$$hx=0.332k\cdot Pr^{(1/3)}\cdot\sqrt{(U\infty/(\nu\cdot x))} \quad (2)$$

wherein x[m]: position from a separation point of the flow hx[$W/m^2\cdot K$]: local heat transfer rate at a position x Pr[1]: Prandtl coefficient U∞[m/s]: main flux of the flow sufficiently away from the roller inner wall surface ν[$m^2/s$]: Kinematic viscosity (=viscosity/density)

k: Heat transfer rate

The separation or adhesion of the flow frequently occurs near the inner wall of the outer tube 1, and the heat transfer rate at each position where the separation or adhesion of the flow occurs is increased. Therefore, the high heat transfer rate is realized uniformly over the longitudinal direction of the outer tube 1, and the heat flux from the roller to the cooling liquid is increased. Eventually, the cooling efficiency of the sheet-like member is significantly improved. Therefore, when the high-temperature paper P is held between and transported by the outer tube 1 of the cooling roller 22 and the transport belt 42 (see FIG. 2) that is not shown, the heat of the paper P is transferred with high efficiency to the cooling liquid that flows inside the outer tube 1 while passing through a position adjacent the wall section of the outer tube 1, so that the temperature of the paper P is lowered.

The coil-like member 2 that is the turbulence generating unit is disposed near the inner wall of the outer tube 1 and thus does not greatly disturb the flow of the cooling liquid that flows inside the outer tube 1. It neither acts as large fluid resistance against the cooling liquid that flows inside the outer tube 1 nor puts a great burden on liquid feeding of a pump (not shown) that feeds the cooling liquid into the outer tube 1. Therefore, it is possible to perform an operation in which power consumption of the pump is saved.

The coil-like member 2 that is the turbulence generating unit may be made of a member different from the outer tube 1 and may have a diameter slightly smaller than a diameter of the inner wall surface of the outer tube 1. According to such a configuration, in a process of assembling the cooling roller 22, the coil-like member 2 can be easily inserted into the outer tube 1, and the coil-like member 2 can be fixed to the inside of the outer tube 1 naturally by frictional force generated between the inner wall surface of the outer tube 1 and the coil-like member 2. Thus, it can be easily implemented without any special fixing unit. Further, the coil-like member 2 can be easily removed from the inside of the outer tube 1. Therefore, the maintainability of the cooling roller 22 can be improved.

Further, the flow direction of the cooling liquid may be reverse to a direction illustrated in FIG. 1A.

When a helical member or a protrusion is disposed in the outer tube 1, a winding direction of the helical shape may be selected to cause feeding of the same direction as the flow direction of the cooling liquid in view of the rotation direction of the outer tube 1 in order not to cause a fluid resistance problem.

For example, when the cooling liquid flows from the left side to the right side of the outer tube 1 (the left side is the upstream side in the flow direction of the cooling liquid, and the right side is the downstream side in the flow direction of the cooling liquid) as illustrated in FIG. 1A, and the outer tube 1 rotates right when viewed in the axial direction from the downstream side, the coil-like member 2 that rotates right together with the outer tube 1 should be wound in a right winding direction that causes feeding of the same direction as the flow direction of the cooling liquid in order to generate the turbulence near the inner wall of the outer tube 1 by the coil-like member 2 not to generate the fluid resistance.

Figure 5A:
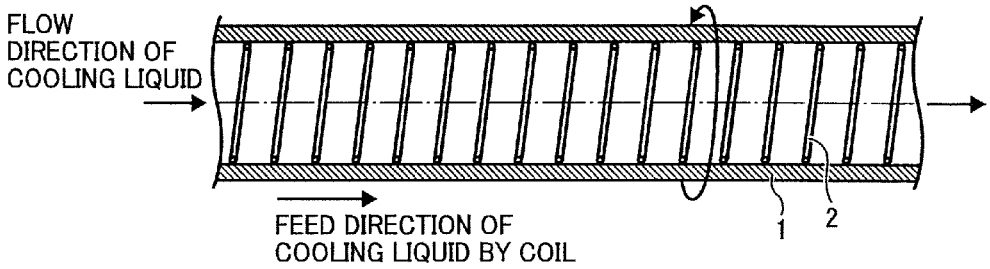
FIG. 5A is an enlarged cross-sectional view illustrating a cooling roller in which an outer tube rotates right and a coil-like member is wound clockwise.

FIG. 5A is an enlarged cross-sectional view of the cooling roller 22 in which the outer tube 1 rotate right and the coil-like member 2 is wound clockwise. FIG. 5A is a view in which FIG. 1A is practically depicted to make it easy to understand the winding direction of the coil-like member 2. In FIG. 5A, it is understood that the flow direction of the cooling liquid is identical to the feed direction of the cooling liquid by rotation by the coil-like member 2.

Similarly, when the cooling liquid flows from the left side to the right side in the drawing and the transport direction of the paper P of FIG. 1B is a reverse direction (the right direction in the drawing), since the outer tube 1 rotates left when viewed in the axial direction from the cooling liquid flow direction downstream side, the coil-like member 2 at this time should be wound in a left winding direction. FIG. 5D is an enlarged cross-sectional view of the cooling roller 22 in which the outer tube 1 rotates left and the coil-like member 2 is wound counterclockwise. It is understood that the flow direction of the cooling liquid is identical to the feed direction of the cooling liquid by rotation of the coil-like member 2.

In this way, according to a configuration in which the flow direction of the cooling liquid flowing inside the outer tube 1 of the cooling roller 22 is identical to the feed direction of the cooling liquid by rotation of the coil-like member 2, it is possible to reduce the fluid resistance by the coil-like member 2 against the cooling liquid flowing inside the outer tube 1.

Meanwhile, when a turbulence generating unit disposed on the inner wall (the inner circumferential surface) of the outer tube has a helical shape like the coil-like member 2, the helical shape may be selected to have a winding direction which causes feeding in a direction reverse to the flow direction of the cooling liquid that flows along near the inner wall of the outer tube 1 according to the rotation direction of the outer tube 1.

The cooling performance is further improved by generating greater turbulence in the cooling liquid near the inner wall of the outer tube 1 compared with the cooling roller 22 having the configuration illustrated in FIGS. 5A to 5D. For this purpose, the coil-like member 2 may be wounded in the winding direction reverse to the winding directions of the configurations illustrated in FIGS. 5A and 5D so that feeding in a direction reverse to the flow direction of the cooling liquid is caused. As a result, near the inner wall of the outer tube 1, force (the flow) by the coil-like member 2 that tends to feed the cooling liquid in the reverse direction collides with the flow of the cooling liquid that is directed to the cooling liquid flow direction downstream side. Therefore, more complicated and random turbulence is generated, and the heat transfer rate from the outer tube 1 to the cooling liquid is significantly improved.

Figure 5B:
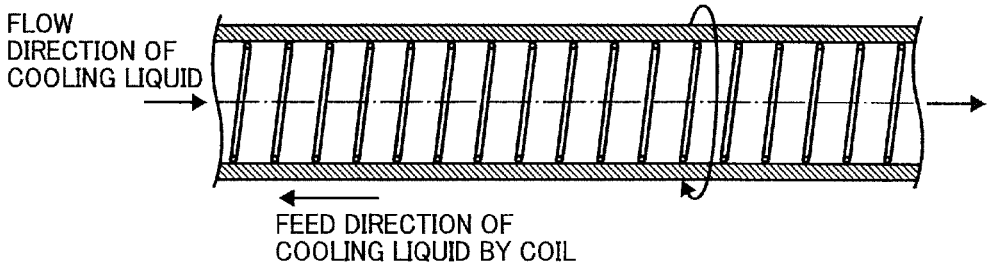
FIG. 5B is an enlarged cross-sectional view illustrating a cooling roller in which an outer tube rotates left and a coil-like member is wound clockwise.
Figure 5C:
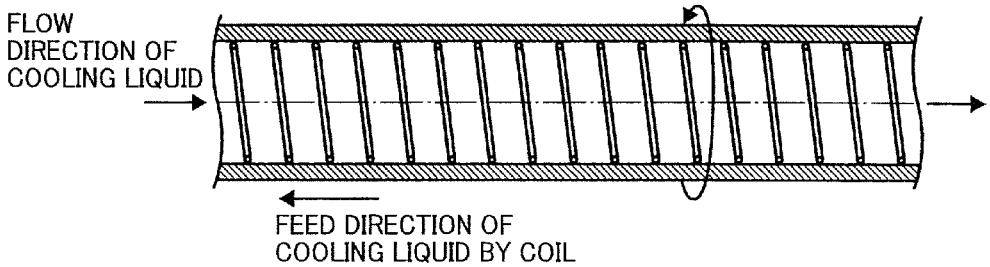
FIG. 5C is an enlarged cross-sectional view illustrating a cooling roller in which an outer tube rotates right and a coil-like member is wound counterclockwise.
Figure 5D:
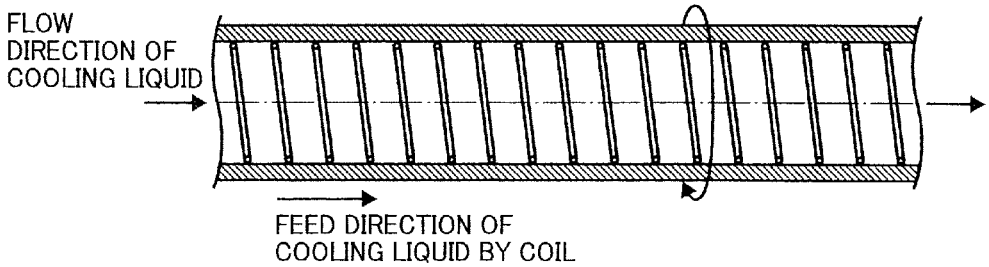
FIG. 5D is an enlarged cross-sectional view illustrating a cooling roller in which an outer tube rotates left and a coil-like member is wound counterclockwise.

Compared to the configurations illustrated in FIGS. 5A and 5D in which the feed direction of the cooling liquid by the coil-like member 2 is identical to the flow direction of the cooling liquid that flows inside the outer tube 1, configuration examples in which the feed direction of the cooling liquid by the coil-like member 2 is reverse to the flow direction of the cooling liquid that flows inside the outer tube 1 are illustrated in FIGS. 5B and 5C.

In FIG. 5A or 5C, the cooling liquid flows from the left side to the right side in the drawing, and the outer tube 1 rotates right when viewed in the axial direction at the cooling liquid flow direction downstream side. In this case, in order to make the feed direction of the cooling liquid by the coil-like member 2 identical to the flow direction of the cooling liquid that flows inside the outer tube 1, the coil-like member should be wound clockwise as illustrated in FIG. 5A. However, in order to make the feed direction of the cooling liquid by the coil-like member 2 reverse to the flow direction of the cooling liquid that flows inside the outer tube 1, the coil-like member 2 should be wound counterclockwise as illustrated in FIG. 5C.

Further, in FIG. 5B or 5D, the cooling liquid flows from the left side to the right side in the drawing, but the outer tube 1 rotates left when viewed in the axial direction from the cooling liquid flow direction downstream side. In this case, in order to make the feed direction of the cooling liquid by the coil-like member 2 identical to the flow direction of the cooling liquid that flows inside the outer tube 1, the coil-like member should be wound counterclockwise as illustrated in FIG. 5D. However, in order to make the feed direction of the cooling liquid by the coil-like member 2 reverse to the flow direction of the cooling liquid that flows inside the outer tube 1, the coil-like member 2 should be wound clockwise as illustrated in FIG. 5B.

Such combination relationships are not limited. For example, when the rotation direction of the outer tube 1 and the winding direction of the coil-like member 2 are maintained "as is" and only the flow direction of the cooling liquid is changed to the opposite direction (the direction from the right side to the left side in the drawing), the flow direction of the cooling liquid is reverse to the feed direction of the cooling liquid by the coil-like member 2 in the configurations illustrated in FIGS. 5A and 5D.

Therefore, based on a combination relationship among three factors of the rotation direction of the outer tube 1, the flow direction of the cooling liquid, and the feed direction of the cooling liquid by the coil-like member 2, the winding direction of the coil-like member 2 may be determined to cause feeding of the cooling liquid by the coil-like member 2 in a direction identical or reverse to the flow direction of the cooling liquid.

However, since a certain shape size of the turbulence generating unit such as the coil-like member 2 may increase the fluid resistance, attention is required. For example, if the coil-like member 2 has a very small wire diameter, an effect resulting from the turbulence is reduced, but even though the feed direction of the cooling liquid by the coil-like member 2 is reverse to the flow direction of the cooling liquid, the fluid resistance is too small to cause a problem. On the contrary, if the coil-like member 2 has a very large wire diameter, the turbulence effect is increased, but since feeding of the cooling liquid by the coil-like member 2 in a direction reverse to the flow direction of the cooling liquid becomes greater and stronger, the fluid resistance is increased. However, since the shape or size of the turbulence generating unit such as the coil-like member 2 is changed to deal with each case according to specification conditions such as the flow velocity and the flow quantity of the cooling liquid, the width (size) of a space that allows the cooling liquid to flow, and a cooling performance target, the shape or size of the turbulence generating unit cannot be categorically determined. Therefore, in order to obtain the maximum turbulence effect with the minimum fluid resistance, an optimum shape or size (for example, a wire diameter dimension) of the turbulence generating unit has been determined by comparing or confirming through a simulation or an actual experimental evaluation. When the turbulence generating unit has a helical shape like the coil-like member 2, since a helical pitch interval of the helical shape is a factor for determining a turbulence occurrence frequency or an interval of a position where turbulence is generated, the helical pitch interval also needs to be considered.

Figure 6:
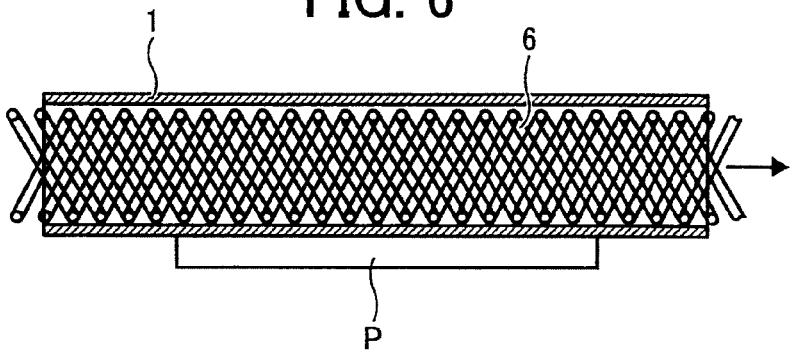
FIG. 6 is an explanation view illustrating a configuration of a cooling roller in which a net-like member is disposed as a turbulence generating unit.

As the turbulence generating unit, in addition to the coil-like member 2, for example, a net-like member 6 illustrated in FIG. 6 may be used. Though not to the extent of the net-like member 6, a plurality of wire-like members may be inserted into the outer tube 1. Alternatively, a cylindrical roll of a sheet having a plurality of punch holes or a porous medium having some thickness may be inserted into the outer tube 1.

Configuration Example 2

Figure 7:
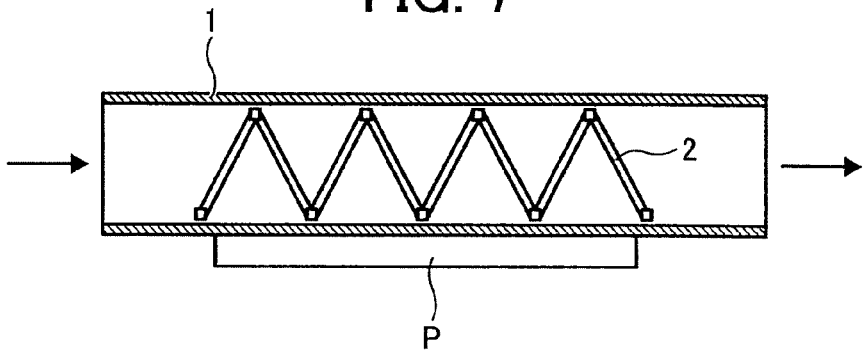
FIG. 7 is a cross-sectional view where a cooling roller of a configuration example 2 according to the first embodiment is cut in the axial direction.

FIG. 7 is a cross-sectional view where the cooling roller 22 of the present configuration example is cut in the axial direction. In the present configuration example, as illustrated in FIG. 7, the coil-like member 2 which is the turbulence generating unit is disposed only at a part, which is located near the paper P, of the outer tube 1 as viewed in the axial direction. According to the configuration in which the coil-like member 2 is disposed only near a part, which contacts the high-temperature paper P, of the outer tube 1, the fluid resistance caused by the coil-like member 2 is not generated against the cooling liquid that flows inside the outer tube 1 of the cooling roller 22 in the other parts inside the outer tube 1 where the coil-like member 2 is not disposed. Thus, a load of the pump is reduced, so that the power consumption is decreased, and durability is also improved. Further, a pump lower by one rank can be used, thereby reducing the cost.

Configuration Example 3

Figure 8A:
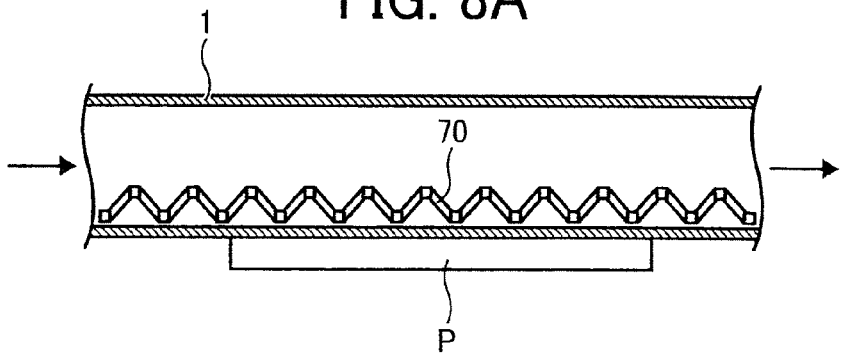
FIG. 8A is a cross-sectional view where a cooling roller of a configuration example 3 according to the first embodiment is cut in the axial direction.
Figure 8B:
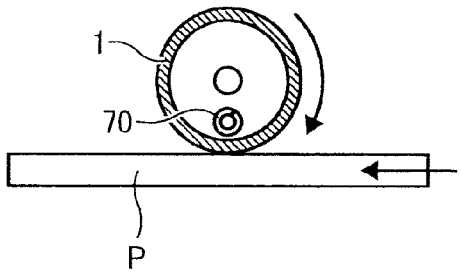
FIG. 8B is a cross-sectional view where the cooling roller of the configuration example 3 is cut in the diametrical direction.

FIG. 8A is a cross-sectional view where the cooling roller 22 of the present configuration example is cut in the axial direction, and FIG. 8B is a cross-sectional view where the cooling roller 22 of the present configuration example is cut in the diametrical direction. In the present configuration example, as illustrated in FIGS. 8A and 8B, a coil-like member 70 having a diameter much smaller than a diameter of the outer tube 1 is disposed only at a portion of the outer tube 1 near the paper P.

Figure 9:
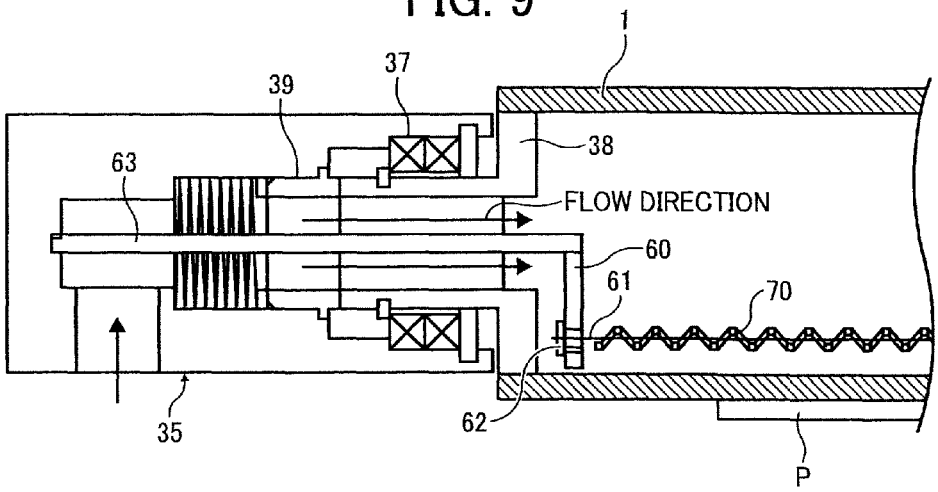
FIG. 9 is an explanation view illustrating an example in which a coil-like member having a small diameter is disposed inside an outer tube.

As illustrated in FIG. 9, a shaft 63 has one end fixedly supported to an end of a rotary joint 35 and the other end positioned inside the outer tube 1 and is lengthy in the axial direction of the cooling roller. A hole is formed in the axial direction of the cooling roller in a sidewall of a fixing bar 60 that is disposed to be fixed to the other end of a shaft 63. A long and fine wire 61 is passed through the hole in the axial direction of the cooling roller, and the wire 61 is fixed to the fixing bar 60 by a wire fastener 62. Even though not shown in FIG. 9, a opposite side of the cooling roller opposite in the axial direction has the same configuration. The coil-like member 70 is fixed near the inner wall of the outer tube 1 by passing the coil-like member 70 through the wire 61. Further, the coil-like member 70 is fixed by the fixing bar 60 in the axial direction (the thrust direction) of the cooling roller. Through such a configuration, even though the outer tube 1 rotates, the shaft 63 having one end fixedly supported by the rotary joint 35 does not rotate. Therefore, even though the outer tube 1 rotates, the coil-like member 70 passed through the wire 61 that is tightened between the fixing bars 60 disposed in the shafts 63 is not displaced from a position near the paper P.

Figure 10:
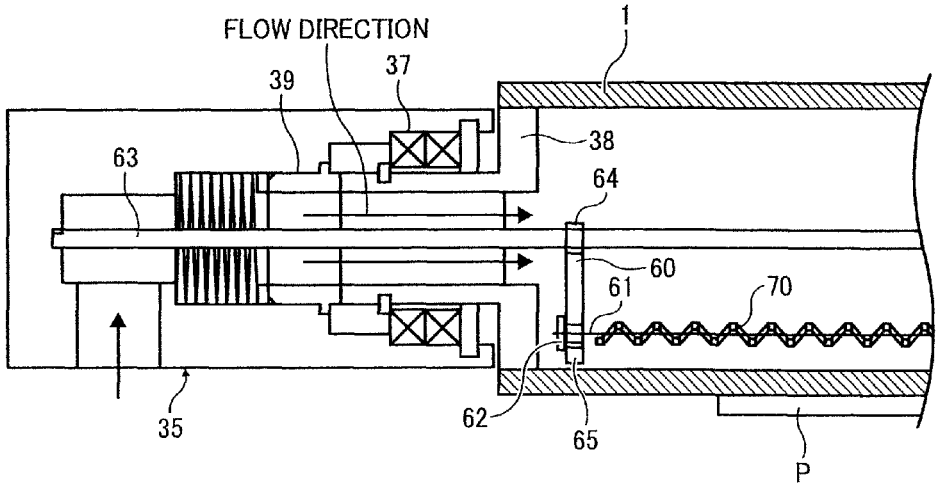
FIG. 10 is an explanation view illustrating another example in which a coil-like member having a small diameter is disposed inside an outer tube.

Further, as illustrated in FIG. 10, the fixing bar 60 may be disposed by being swingably hung to the shaft 63 through a bearing 64. At this time, by providing a weight 65 at an end of the fixing bar 60 at a side opposite to the bearing 64, the coil-like member 70 can be position near the paper P by own weight of the weight 65.

Figure 11:
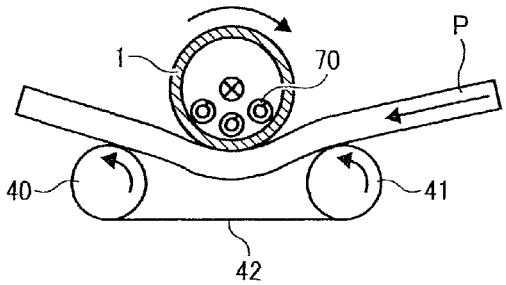
FIG. 11 is an explanation view illustrating a configuration of a cooling roller in which a plurality of coil-like members having a small diameter is disposed near a paper.

As a modified example, in FIG. 11, a plurality of coil-like members 70 having a small diameter is prepared, and the plurality of coil-like members 70 is disposed only at a portion of the outer tube 1 near the paper P in order to adapt to a case where a contact area between the paper P and the outer tube 1 is large. The plurality of coil-like members 70 is fixed near the inner wall of the outer tube 1 by disposing as many components illustrated in FIG. 9 and FIG. 10 as the number of the coil-like members 70.

In this way, according to the configuration in which the coil-like member 70 having a diameter smaller than the coil-like member 2 is disposed only near the paper P inside the outer tube 1, the fluid resistance caused by the coil-like member 70 can be reduced and thus the load of the pump is suppressed, the power consumption is reduced, and the durability is also improved, compared to the case where the coil-like member 2 is disposed. Further, a pump lower by one rank can be used and thus the cost can be reduced.

Figure 12:
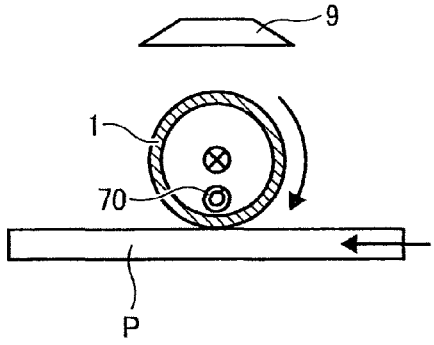
FIG. 12 is a view illustrating a case where a vibrating unit for vibrating a coil-like member having a small diameter is disposed.

Further, in order to promote the generation of the turbulence, a configuration of externally vibrating the turbulence generating unit such as the coil-like member may be provided. In FIG. 12, the generation of the turbulence is promoted such that the coil-like member 70 having a small diameter, as the turbulence generating unit, disposed near the paper P is vibrated in a non-contact manner by an oscillatory wave such as an ultrasonic wave emitted from a vibrating unit 9.

Configuration Example 4

Figure 14A:
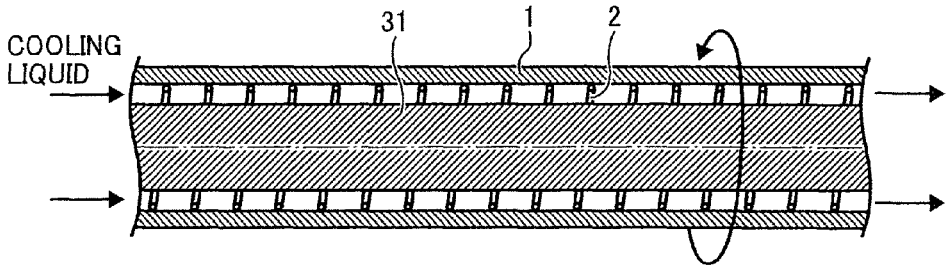
FIG. 14A is an enlarged cross-sectional view illustrating a cooling roller that includes an outer tube having a coil-like member disposed near an inner wall and a core.

As illustrated in FIG. 14A, the cooling roller 22 has a tubular structure configured with the outer tube 1, in which the coil-like member 2 is provided near the inner wall of the outer tube 1, and a core 31, and a narrow space is formed between the outer tube 1 and the core 31. The cooling liquid flows through the space as a fluid passage. In this case, compared to FIG. 5A, the flow velocity of the cooling liquid is increased, and the turbulence effect caused near the inner wall of the outer tube 1 by the coil-like member 2 is added. Therefore, the heat transfer rate is further improved by the synergetic effect, and further temperature reduction of the paper P is expected.

Figure 13A:
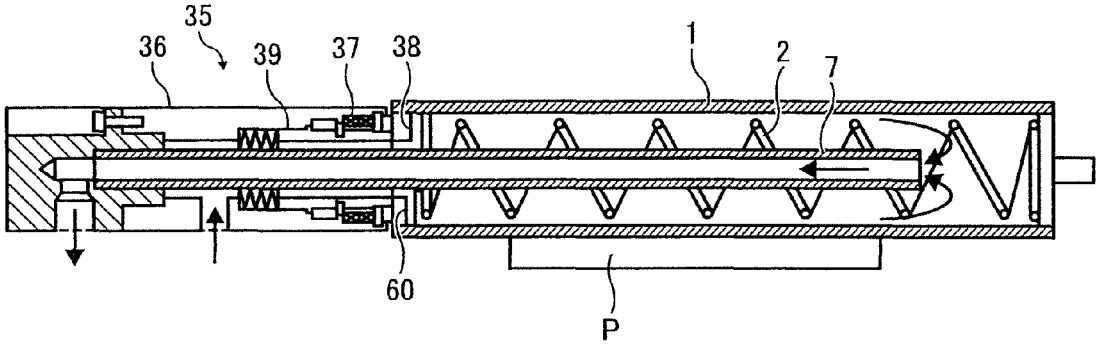
FIG. 13A is a cross-sectional view where a cooling roller of a configuration example 5 according to the first embodiment is cut in an axial direction.
Figure 14B:
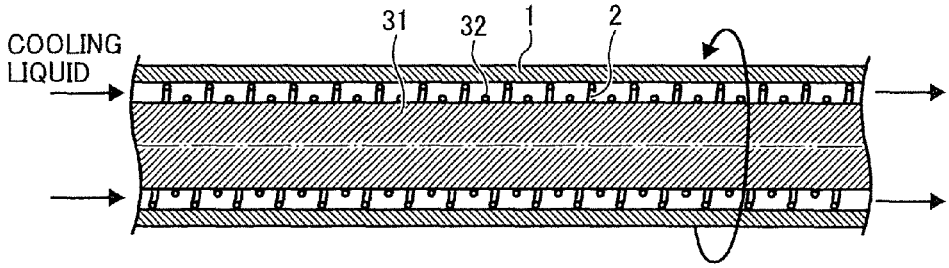
FIG. 14B is a cross-sectional view illustrating an enlarged configuration in which a coil-like member as a turbulence generating unit is disposed even in a core.

FIG. 14B illustrates that a coil-like member 32 as the turbulence generating unit is disposed even at the core 31 compared to FIG. 14A. The turbulence is generated even near an outer wall of the core 31 by the coil-like member 32 and combined with the turbulence generated near the inner wall of the outer tube by the coil-like member 2 of the outer tube 1, so that more complicated and larger turbulence is generated in the space between the outer tube 1 and the core 31. Therefore, the cooling performance can be improved more than the configuration illustrated in FIG. 13A.

Further, in the case of the cooling roller 22 of the present configuration example, the outer tube 1 and the core 31 may have different rotation numbers. According to this configuration, a rotation speed component of the cooling liquid near the inner wall of the outer tube 1 is greatly different from that near the outer wall of the core 31. Therefore, the generation of the turbulence is promoted to further improve the heat transfer rate. If the core 31 is different in rotation number from the outer tube 1, for example, the core 31 has several times as many rotation numbers as the outer tube 1 or stops and does not rotate, and thus the greater the difference is, the more effects can be obtained. In order to obtain the maximum effect, the core 31 may be rotated in a direction reverse to the rotation direction of the outer tube 1. In addition, as the flow velocity increases due to the narrow space formed between the outer tube 1 and the core 31, the heat transfer rate is further improved. Further, when the turbulence generating unit such as the coil-like member 32 is disposed even at the core 31, the heat transfer rate is further improved.

Configuration Example 5

Figure 13B:
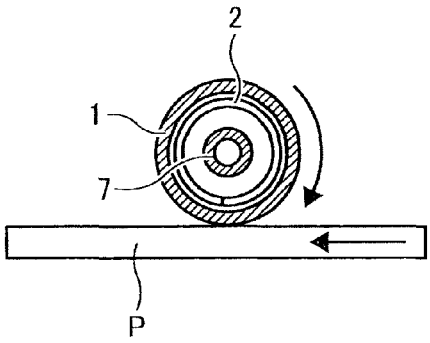
FIG. 13B is a cross-sectional view where the cooling roller of the configuration example 5 is cut in a diametrical direction.

FIG. 13A is a cross-sectional view where the cooling roller 22 of the present configuration example is cut in the axial direction, and FIG. 13B is a cross-sectional view where the cooling roller 22 of the present configuration example is cut in the diametrical direction.

In the cooling roller 22 of the present configuration, an inner tube 7 is disposed inside the outer tube 1, and the coil-like member 2 as the turbulence generating unit for agitating the cooling liquid inside the outer tube 1 is disposed near the inner wall of the outer tube 1 in a space between the outer tube 1 and the inner tube 7 in which the cooling liquid flows.

In the present configuration example, as illustrated in FIGS. 13A and 13B, the cooling roller 22 has a tubular structure configured with the outer tube 1 and the inner tube 7, and the cooling liquid flows back and forth inside the cooling roller 22. That is, it is configured such that the cooling liquid flows in from the left side in the drawing through the space formed between the outer tube 1 and the inner tube 7 as a forward flow passage, is U-turned at a right end of the outer tube 1, and flows outs toward the left side in the drawing through the inside of the inner tube 7 as a return flow passage. The inflow and outflow passages of the cooling liquid may be reversed, that is, the inside of the inner tube 7 may be used as the forward flow passage, and the space formed between the outer tube 1 and the inner tube 7 may be used as the return flow passage.

In the present configuration example, since the flow passage space of the forward flow passage is narrow, compared to FIG. 5A, the flow velocity of the cooling liquid near the inner wall of the outer tube is increased, and the turbulence effect caused near the inner wall of the outer tube by the coil-like member 2 is added. Thus, the heat transfer rate from the outer tube 1 to the cooling liquid is improved. Further, when the space is more narrowed by making an external diameter size of the inner tube 7 close to an internal diameter size of the outer tube 1, the same effect as the core 31 illustrated in FIG. 14A is disposed is obtained.

Further, in the present configuration example, a joint that is disposed at an end of the cooling roller 22 in the axial direction and has a mechanical seal for the inflow/outflow of the cooling liquid to/from the inside of the outer tube 1 may be disposed only at the left side of the cooling roller 22 in the drawing, that is, only at one end side of the cooling roller 22 in the axial direction. In this case, an empty space is formed at the right side of the cooling roller 22 in the drawing, that is, at the other end side of the cooling roller 22 in the axial direction at which the joint unit is not disposed. The empty space contributes to size reduction of the image forming device. When the cooling roller 22 is mounted to the cooling device 18 or the image forming device, the mounting work of the cooling roller 22 can be easily performed without being restricted by a tube or a pipe of the cooling liquid.

Figure 15:
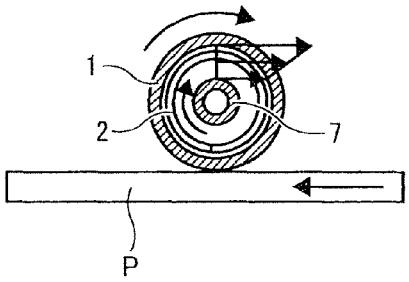
FIG. 15 is a cross-sectional view where a cooling roller in which an outer tube and an inner tube are different in rotation number is cut in the diametrical direction.

In the cooling roller 22 configured with the outer tube 1 and the inner tube 7, the outer tube 1 and the inner tube 7 may have different rotation numbers as illustrated in FIG. 15. According to this configuration, a rotation speed component of the cooling liquid near the internal wall of the outer tube 1 is greatly different from that near the outer wall of the inner tube 7. Therefore, the generation of the turbulence is promoted to further improve the heat transfer rate. If the core 31 is different in rotation number from the outer tube 1, for example, the core 31 has several times as many rotation numbers as the outer tube 1 or stops and does not rotate, and thus the greater the difference is, the more effects can be obtained. In order to obtain the maximum effect, the inner tube 7 may rotate in a direction reverse to the rotation direction of the outer tube 1.

Figure 16:
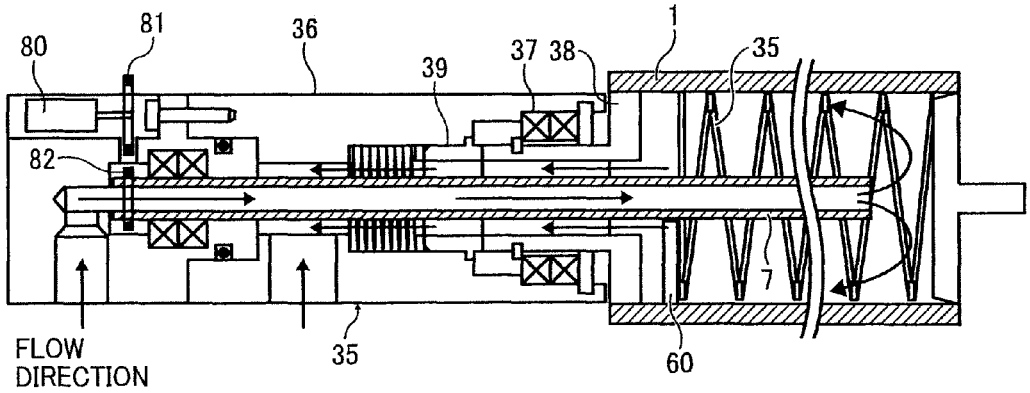
FIG. 16 is a cross-sectional view where a cooling roller in which an outer tube and an inner tube are different in rotation number is cut in the axial direction.

For example, as illustrated in FIG. 16, a magnet 81 is mounted to a rotation shaft of a motor 80 disposed outside a rotary joint, and a magnet 82 is mounted to an outer circumferential surface of the inner tube 7 facing the magnet 81 mounted to the motor 80. As the magnet 81 mounted to the motor 80 rotates, magnetic force working between both magnets applies rotary force to the magnet 82 mounted to the inner tube 7, so that the inner tube 7 rotates. In this configuration, the outer tube 1 and the inner tube 7 can have different rotation numbers or different rotation directions from each other by controlling the rotation number or the rotation direction of the motor 80.

Figure 17A:
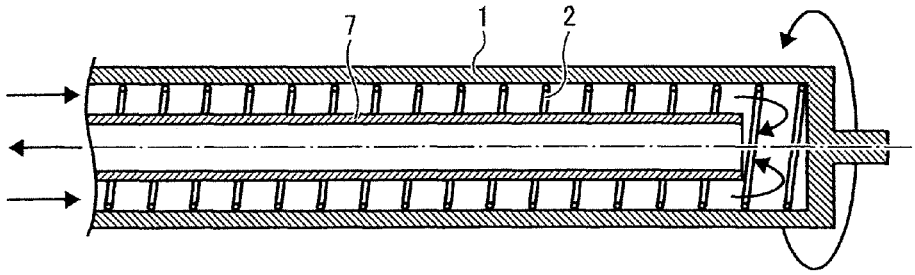
FIG. 17A is an enlarged cross-sectional view illustrating a cooling roller having a tubular structure that includes an outer tube and an inner tube.
Figure 17B:
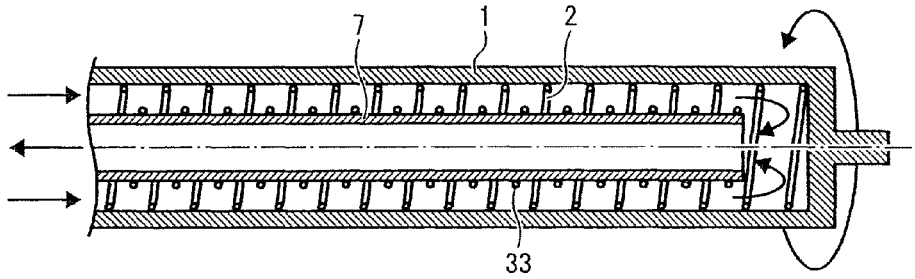
FIG. 17B is an enlarged cross-sectional view illustrating a cooling roller in which a coil-like member as a turbulence generating unit is disposed even in an inner tube.

FIG. 17B illustrates that a coil-like member 33 as the turbulence generating unit is disposed even at the inner tube 7 compared to FIG. 17A. The turbulence is generated even near the outer wall of the inner tube 7 by the coil-like member 33 and combined with the turbulence generated near the inner wall of the outer tube by the coil-like member 2 of the outer tube 1. As a result, more complicated and larger turbulence is generated in the space formed between the outer tube 1 and the inner tube 7, whereby the cooling performance can be further improved.

Figure 18:
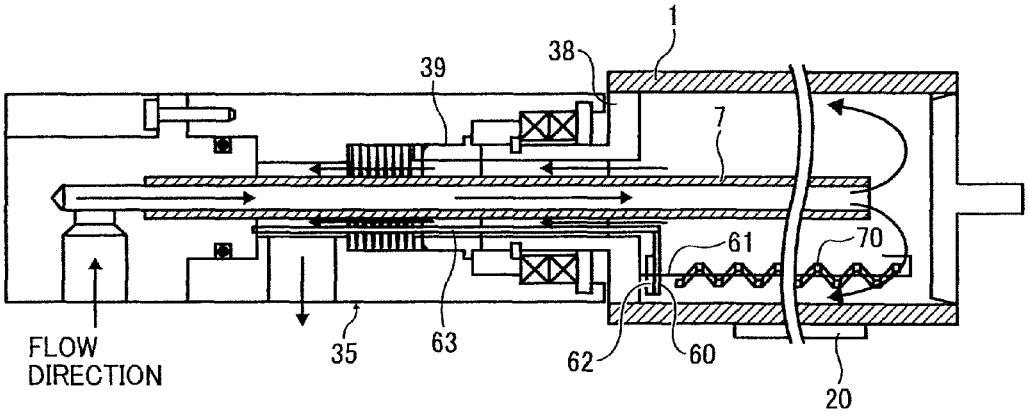
FIG. 18 is an explanation view illustrating an example in which a coil-like member having a small diameter is disposed in an outer tube.
Figure 19:
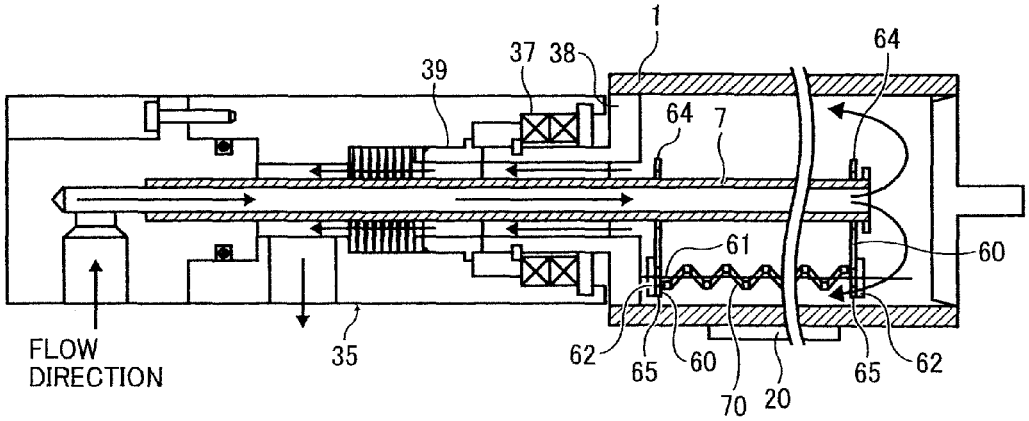
FIG. 19 is an explanation view illustrating another example in which a coil-like member having a small diameter is disposed in an outer tube.

Further, as illustrated in FIGS. 18 and 19, a configuration in which the coil-like member 70 having a diameter much smaller than a diameter of the outer tube 1 is disposed only at a portion of the outer tube 1 near the paper P may be employed.

As illustrated in FIG. 18, the shaft 63 has an one end fixedly supported to the rotary joint 35 and the other end positioned inside the outer tube 1 and is lengthy in the axial direction of the cooling roller. A hole is formed in the axial direction of the cooling roller in a sidewall of the fixing bar 60 that is disposed to be fixed to the other end of the shaft 63. A long and fine wire 61 is passed through the hole in the axial direction of the cooling roller, and the wire 61 is fixed to the fixing bar 60 by the wire fastener 62. The coil-like member 70 is fixed near the inner wall of the outer tube 1 by passing the coil-like member 70 through the wire 61. Further, after the coil-like member 70 is passed through the wire 61, an end of the wire 61 at a side opposite to the fixing bar 60 is bent, so that the coil-like member 70 does not slip out of the wire 61. Since the weight of the coil-like member 70 is not so much heavy, the strength of the shaft 63 is sufficient to be supported even though the shaft 63 has a cantilever structure, but in order to increase the strength, two or more shafts 63 may be disposed.

Further, as illustrated in FIG. 19, the fixing bar 60 may be disposed to be swingably hung to the inner tube 7 through the bearing 64. In this case, the weight 65 is disposed at an end of the fixing bar 60 at a side opposite to the bearing 64, so that the coil-like member 70 can be positioned near the paper P by own weight of the weight 65.

In this way, since the coil-like member 70 having a diameter smaller than the coil-like member 2 is disposed only in a portion of the outer tube 1 near the paper P, the fluid resistance caused by the coil-like member 70 can be reduced more than when the coil-like member 2 is disposed. Therefore, the load of the pump is reduced, the power consumption is reduced, and the durability is also, improved. Further, a pump lower by one rank can be used, and the cost can be reduced.

Configuration Example 6

Figure 20A:
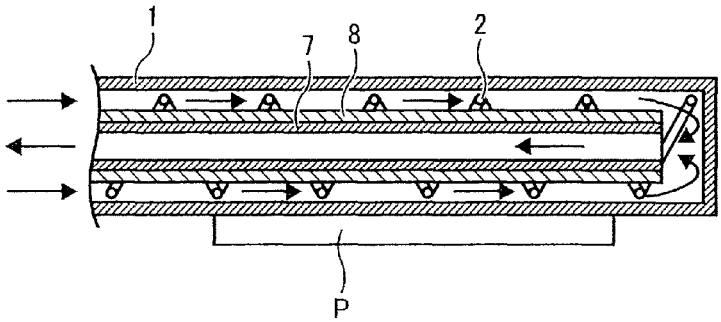
FIG. 20A is a cross-sectional view where a cooling roller of a configuration example 6 according to the first embodiment is cut in an axial direction.
Figure 20B:
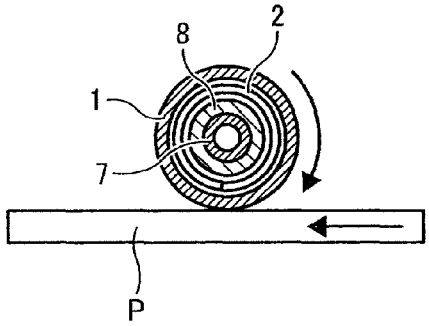
FIG. 20B is a cross-sectional view where the cooling roller of the configuration example 6 is cut in a diametrical direction.

FIG. 20A is a cross-sectional view where the cooling roller 22 of the present configuration example is cut in the axial direction, and FIG. 20B is a cross-sectional view where the cooling roller 22 of the present configuration example is cut in the diametrical direction.

The cooling roller 22 of the present configuration example is configured such that the inner tube 7 is disposed inside the outer tube 1, a hollow cylinder 8 is inserted to the outside of the inner tube 7, and the cooling liquid flows in a narrow space formed between the outer tube 1 and the cylinder 8 and inside the inner tube 7. That is, the cooling liquid flows in through the narrow space formed between the outer tube 1 and the cylinder 8 from the left side in the drawing, and the cooling liquid that reaches the right end of the outer tube 1 is U-turned and flows out toward the left side in the drawing through the inside of the inner tube 7. As the cylinder 8 is disposed as in the present configuration example, the flow velocity near the inner wall of the outer tube 1 is increased compared to when the cylinder 8 is not disposed, and thus the heat transfer rate from the wall of the outer tube 1 to the cooling liquid is improved. As a result, further temperature reduction of the paper P can be obtained. Further, the inflow and outflow passages of the cooling liquid may be reversed, that is, the inside of the inner tube 7 may be used as the forward flow passage, and the space formed between the outer tube 1 and the cylinder 8 may be used as the return flow passage.

In the case of the cooling roller 22, since the narrow space is formed between the outer tube 1 and the cylinder 8 and the cooling liquid flows through the narrow space as the flow passage, the flow velocity of the cooling liquid is increased compared to FIG. 5A. Further, since the effect of the turbulence generated near the inner wall of the outer tube by the coil-like member 2 is added, the heat transfer rate from the outer tube 1 to the cooling liquid is further improved, and further temperature reduction of the paper P is expected.

Even in this configuration, the joint unit for the inflow and outflow of the cooling liquid may be disposed only in an end of the cooling roller 22 at the left side in the drawing, it is possible to reduce the size of the image forming device and improve assembling workability. That is, the cooling roller 22 of FIG. 21A has a configuration in which configurations illustrated in FIGS. 13A and 17A are combined and that has the advantages and effects of both configurations.

Figure 21A:
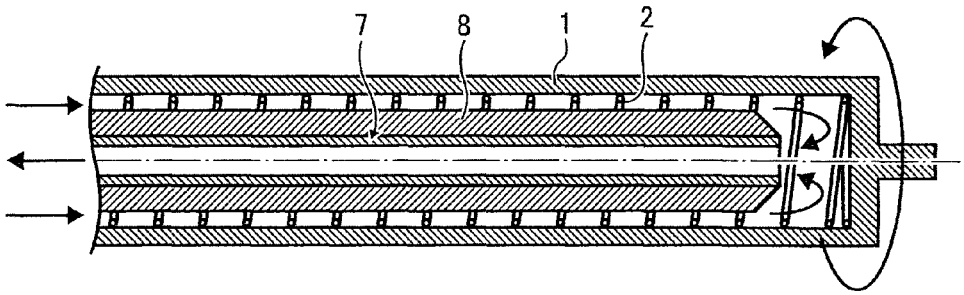
FIG. 21A is an enlarged cross-sectional view illustrating a cooling roller having a tubular structure that includes an outer tube, an inner tube, and a cylinder.
Figure 21B:
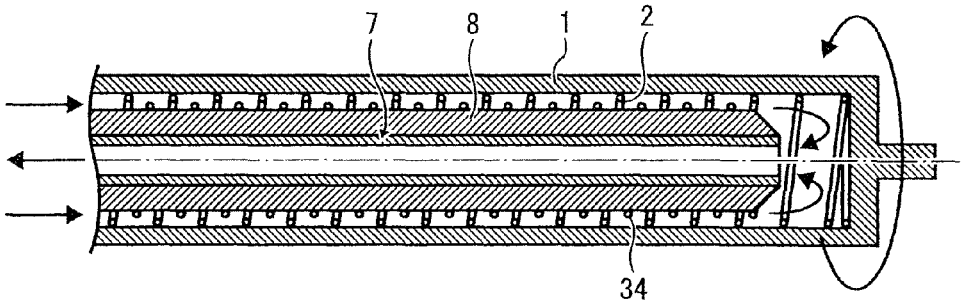
FIG. 21B is an enlarged cross-sectional view illustrating a cooling roller in which a coil-like member as a turbulence generating unit is disposed even in a cylinder.

FIG. 21B illustrates that a coil-like member 34 as the turbulence generating unit is disposed even at the cylinder 8 compared to FIG. 21A. The turbulence is generated even near the outer wall of the cylinder 8 by the coil-like member 34 and combined with the turbulence generated by the coil-like member 2 of the outer tube 1. As a result, more complicated and larger turbulence is generated in the space formed between the outer tube 1 and the cylinder 8, and thus the cooling performance can be further improved. That is, the cooling roller 22 of FIG. 21B has a configuration in which configurations illustrated in FIGS. 13B and 20B are combined and that has the advantages and effects of both configurations.

Further, in the case of the cooling roller 22 of the present configuration example, the outer tube 1 and the cylinder 8 may have different rotation numbers. According to this configuration, a rotation speed component of the cooling liquid near the inner wall of the outer tube 1 is greatly different from that near the outer wall of the cylinder 8. Therefore, the generation of the turbulence is promoted to further improve the heat transfer rate. If the cylinder 8 is different in rotation number from the outer tube 1, for example, the cylinder 8 has several times as many rotation numbers as the outer tube 1 or stops and does not rotate, and thus the greater the difference is, the more effects can be obtained. In order to obtain the maximum effect, the cylinder 88 may be rotated in a direction reverse to the rotation direction of the outer tube 1. In addition, as the flow velocity increases due to the narrow space formed between the outer tube 1 and the cylinder 8, the heat transfer rate is further improved. Further, when the turbulence generating unit such as the coil-like member 32 is disposed even at the cylinder 8, the heat transfer rate of the cooling roller 22 is further improved.

Figure 22:
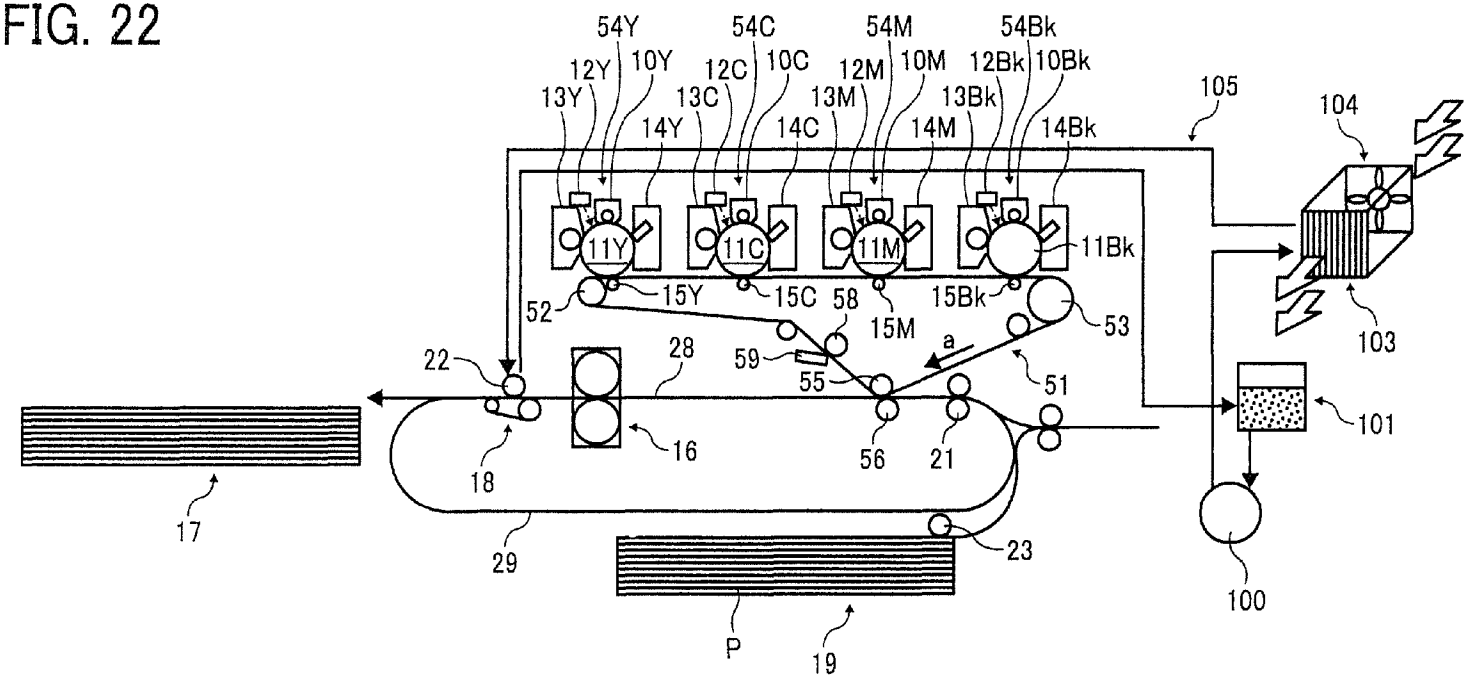
FIG. 22 is an explanation view illustrating a schematic configuration of an image forming device according to the present embodiment.

Next, a schematic configuration diagram of a color image forming device of a tandem type and an intermediate transfer belt technique in which the cooling device 18 having the cooling roller 22 of the present invention is mounted is illustrated in FIG. 22.

An intermediate transfer belt 51 as an intermediate transfer medium is tightened around a plurality of rollers. The intermediate transfer belt 51 is configured to be rotated by the rollers, and process units for image formation are disposed around the intermediate transfer belt 51.

As the process units for image formation, a first image station 54Y, a second image station 54C, a third image station 54M, a fourth image station 54Bk are disposed between a roller 52 and a roller 53 above the intermediate transfer belt 51 in an order from an upstream side of the intermediate transfer belt 51 in the rotation direction when a rotation direction of the intermediate transfer belt 51 is a direction indicated by an arrow "a" in the drawing. For example, as the first image station 54Y, a charging unit 10Y, an optical writing unit 12Y, a developing device 13Y, and a cleaning unit 14Y are disposed around a drum-shaped photoreceptor 11Y. A primary transfer roller 15Y as a transfer unit for the intermediate transfer belt 51 is disposed at a position facing the photoreceptor 11 with the intermediate transfer belt 51 interposed therebetween. The other three image stations have the same configuration. The four image stations are disposed at a predetermined pitch interval in a left-right direction.

In the present embodiment, the optical writing unit 12 is configured with an optical system having a light emitting diode (LED) as a light source but may be configured with a laser optical system having a laser as a light source. The optical writing unit 12 performs light exposure on the photoreceptor 11 based on image information.

Below the intermediate transfer belt 51, disposed are a paper receiving unit 19 of the paper P that is the sheet-like member, a paper feed roller 23, a pair of resist rollers 21, a secondary transfer roller 56, as a transfer unit from the intermediate transfer belt 51 to the paper P, which is disposed to face a roller 55, which tightens the intermediate transfer belt 51, via the intermediate transfer belt 51, a cleaning unit 59 that is disposed at a position facing a roller 58 contacting a back side of the intermediate transfer belt 51 to contact a front surface of the intermediate transfer belt 51, a heat fixing unit 16, the cooling device 18 having the cooling roller 22 for cooling the paper P, and a discharged paper receiving unit 17 that is a discharge section of the paper P on which the toner is fixed. A paper transport path 28 extends from the paper receiving unit 19 to the discharged paper receiving unit 17. At the time of two-sided image formation, in order to perform image formation on a back side, a paper transport path 29 for two-sided image formation in which the paper P passing through the cooling device 18 once is inverted and transported to a pair of resist rollers 21 again is also provided.

The cooling roller 22 of the cooling device 18 is a heat receiving unit that receives heat of the paper P. The cooling roller 22 is communicated or connected with a radiator 103 having a cooling fan 104, a pump 100, and a tank 101 through a pipe 105 and encloses the cooling liquid therein. The cooling liquid is circulated along a circulation passage configured such that the cooling liquid cooled down by the radiator 103 is fed to the cooling roller 22, drained after traveling inside the cooling roller 22, then fed to the tank 101 and the pump 100, and returned to the radiator 103 again as indicated by an arrow at the pipe 105. The cooling liquid is circulated by rotation pressure of the pump 100, and releases heat at the radiator 103, so that the cooling liquid is cooled down and thus the cooling roller 22 is also cooled down. Power of the pump 100 or the size of the radiator 103 is selected based on a flow quantity, pressure, and cooling efficiency which are determined according to a heat design condition (a condition of a heat quantity and a temperature that should be cooled down by the cooling roller 22).

An image forming process will be explained in connection with the first image station 54Y. The image forming process is based on a general electrostatic recording technique. Light exposure is performed by the optical writing unit 12Y to form an electrostatic latent image on the photoreceptor 11Y uniformly charged in the dark by the charging unit 10Y. The electrostatic latent image is converted to a toner image that is a visible image by the developing device 13Y. The toner image is transferred from the photoreceptor 11Y to the intermediate transfer belt 51 by the primary transfer roller 15Y. After transfer, a surface of the photoreceptor 11Y is cleaned by the cleaning unit 14. The other image stations 54 have the same configuration as the first image station 54Y and perform the same image forming process.

Developing devices 13 in the image stations 54Y, 54C, 54M, and 54Bk have functions of forming visible images by toners of four different colors. If the image stations 54Y, 54C, 54M, and 54Bk are assigned yellow, cyan, magenta, and black, respectively, it is possible to form a full color image. Therefore, while a same image formation area of the intermediate transfer belt 51 pass through the four image stations 54Y, 54C, 54M, and 54Bk in order, the toner images are superposed by being transferred onto the intermediate transfer belt 51 by one color by a transfer bias applied by the primary transfer rollers 15 each of which is disposed to face each photoreceptor 11 with the intermediate transfer belt 51 interposed therebetween. Thereby, at a point of time when the same image formation area passed through the image stations 54Y, 54C, 54M, and 54Bk once, a full color toner image can be formed on the same image area by the superposed transfer.

The full color toner image formed on the intermediate transfer belt 51 is transferred onto the paper P. After the transfer, the intermediate transfer belt 51 is cleaned by the cleaning unit 59. The transfer onto the paper P is performed by applying a transfer bias at the time of transfer on the roller 55 to the secondary transfer roller 56 through the intermediate transfer belt 51 and passing the paper P through a nip section between the secondary transfer roller 56 and the intermediate transfer belt 51. After the transfer onto the paper P, the full color image supported on the paper P is fixed by the heat fixing unit 16, so that a final full color image is formed on the paper P, and then the paper P is stacked on the discharged paper receiving unit 17.

In the image forming device of the present embodiment, before the paper P is stacked on the discharged paper receiving unit 17, the paper P passes through the cooling device 18 disposed directly behind the heat fixing unit 16. At this time, the paper P heated by the heat fixing unit 16 passes through while contacting the cooling roller 22 that is the heat receiving unit. The surface of the cooling roller 22 then absorbs heat from the paper P and transfers the heat to the cooling liquid inside the cooling roller 22. The cooling liquid that became a high temperature by the transferred heat is thereafter drained from the cooling roller 22 and fed to the radiator 103 having the cooling fan 104 mounted therein via the tank 101 and the pump 100. The heat is exhausted to the outside of the image forming device at the radiator 103. The cooling liquid that is cooled down up to nearly room temperature since the heat is dissipated by the radiator 103 is thereafter fed to the cooling roller 22 again. The paper P that was heated by the heat fixing unit 16 to have a high temperature is efficiently cooled down by the heat exhaust cycle of a high cooling performance using the cooling liquid. Therefore, at a point of time when the paper P is stacked on the discharged paper receiving unit 17, the toner on the paper P can be hardened with high degree of certainty. It is thus possible to avoid the blocking phenomenon that has been a big problem, in particular, in two-sided image formation output.

Hereinafter, examples of an image forming device of an electronic photography technique according to the present invention will be explained.

Example 1

The cooling roller 22 of the present invention was applied to a modified device of a color image forming device "Imagio Neo C600" made by Ricoh Co., Ltd. "Imagio Neo C600" employs a tandem-type and an indirect transfer technique illustrated in FIG. 22.

The cooling roller 22 was configured such that the coil-like member 2 having a line thickness of 0.5 [mm] and a pitch of 6 [mm] was inserted along the inner wall of the outer tube 1, made of aluminum, having an outer diameter of ϕ30.4 [mm] and a thickness of 1.1 [mm], and two rotary joints for a one-way flow made by Showa Giken Industrial Corporation were sealably and rotatably mounted to both ends of the cooling roller.

Two corrugated radiators (thickness 20 [mm]) that have a square shape having one side of 120 [mm] and are made of aluminum were connected in series. An axial flow fan (flow velocity 2.3 [m/s]) that has the same size as the radiator and has a square shape having one side of 120 [mm] was used as the radiator fan. A centrifugal type having a shut-off head of 50 [kPa] was used as the pump. A tank that has a volume of 700 [L] and is made of polypropylene was used as the tank. A rubber tube made of a butyl rubber-EPDM mixture was used as the tube. As the circulated cooling liquid, a liquid of a −13° C. anti-freeze specification that includes propylene glycol as a main component and also includes a rust preventing agent was selected.

Through such a configuration, color two-sided continuous printing that was performed for 75 sheets per one minute was continuously performed for three hours on a gloss coat (158 [g/m$^2$]) and a POD film coat S [(198 [g/m$^2$]) that are coat papers produced by Oji Paper Co., Ltd. In order to measure the temperature of the paper, thin thermocouples were disposed in a paper transport passage between the fixing device and the cooling device and in a paper transport passage at a downstream side of the cooling roller 22 in the paper transport direction, and temperatures when the paper contacted the thermocouples were measured. As a result, as a paper temperature reduction effect, in the case of using the gloss coat produced by Oji Paper Co., Ltd., the paper temperature after cooled by the cooling roller 22 was lowered by 35° C. compared to the paper temperature before the paper after fixing us cooled down by the cooling roller 22. Further, in the case of using the POD film coat S, the paper temperature after cooled by the cooling roller 22 was lowered by 30° C. compared to the paper temperature before the paper after fixing is cooled down by the cooling roller 22. Further, a problem such as curl or adhesion was not found on the paper.

Example 2

As the cooling roller 22 of Example 2, employed was a configuration in which the outer tube 1 is made of aluminum and has an outer diameter of ϕ30.4 [mm] and a thickness of 1.1 [mm], the inner tube 7 is made of aluminum, the cylinder 8 is mounted in the inner tube 7, and the coil-like member 2 having a line thickness of 0.5 [mm] and a pitch of 16 [mm] is inserted along the inner wall of the outer tube 1. Further, a configuration, in which a rotary joint for a two-way flow made by Showa Corporation is sealably and rotatably mounted to a one end of the cooling roller 22, was employed. In this time, the inner tube 7 had an outer diameter of ϕ4 [mm], and a space between the outer tube 1 and the cylinder 8 was 1.1 [mm].

By such a configuration, color two-sided continuous printing that was performed for 75 sheets per one minute was continuously performed for four hours. In order to measure the temperature of the paper, thin thermocouples were disposed in a paper transport passage between the fixing device and the cooling device and in a paper transport passage at a downstream side of the cooling roller 22 in the paper transport direction, and temperatures when the paper contacted the thermocouples were measured. As a result, as a paper temperature reduction effect, in the case of using the gloss coat produced by Oji Paper Co., Ltd., the paper temperature after cooled by the cooling roller 22 was lowered by 39° C. compared to the paper temperature before the paper after fixing is cooled down by the cooling roller 22. Further, in the case of using the POD film coat S, the paper temperature after cooled by the cooling roller 22 was lowered by 33° C. compared to the paper temperature before the paper after fixing is cooled by the cooling roller 22. Further, a problem such as curl or adhesion was not found on the paper.

Comparative Example

Next, comparative Examples to the above examples, in which the coil-like members 2 disposed inside the cooling rollers 22 in Example 1 and Example 2 were removed from the inside of the cooling roller 22, will be described.

Two rotary joints for a one-way flow made of Showa Corporation were sealably and rotatably mounted to both ends of the cooling roller having the outer tube 1 that has an outer diameter of ϕ30.4 [mm] and a thickness of 1.1 [mm] and is made of aluminum. The cooling roller was applied to a modified device of a color image forming device "Imagio Neo C600" made by Ricoh Co., Ltd. "Imagio Neo C600" employs a tandem-type and an indirect transfer technique illustrated in FIG. 22.

Two corrugated radiators (thickness 20 [mm]) that have a square shape having one side of 120 [mm] and are made of aluminum were connected in series. An axial flow fan (flow velocity 2.3 [m/s]) that has the same size as the radiator and has a square shape having one side of 120 [mm] was used as the radiator fan. A centrifugal type having a shut-off head of 50 [kPa] was used as the pump. A tank that has a volume of 700 [L] and is made of polypropylene was used as the tank. A rubber tube made of a butyl rubber-EPD mixture was used as the tube. As the circulated cooling liquid, a liquid of a −13° C. anti-freeze specification that includes propylene glycol as a main component and also includes a rust preventing agent was selected.

Through such a configuration, color two-sided continuous printing that was performed for 75 sheets per one minute was continuously performed for three hours on a gloss coat (158 [g/m$^2$]) and a POD film coat S [(198 [g/m$^2$]) that are coat papers produced by Oji Paper Co., Ltd. In order to measure the temperature of the paper, thin thermocouples were disposed in a paper transport passage between the fixing device and the cooling device and in a paper transport passage at a downstream side of the cooling roller in the paper transport direction, and temperatures when the paper contacted the thermocouples were measured. As a result, as a paper temperature reduction effect, in the case of using the gloss coat produced by Oji Paper Co., Ltd., the paper temperature after cooled by the cooling roller 22 was lowered by 33° C. compared to the paper temperature before the paper after fixing is cooled down by the cooling roller. Further, in the case of using the POD film coat S, the paper temperature after cooled by the cooling roller was lowered by 27° C. compared to the paper temperature before the paper after fixing is cooled down by the cooling roller. Further, a problem such as curl or adhesion was not seen on the paper.

As can be understood from the experimental results of Examples 1 and 2 and Comparative Example, when the coil-like member 2 is disposed inside the cooling roller 22 to actively generate the turbulence near the inner wall of the cooling roller 22, the paper temperature reduction effect can be improved more than when the coil-like member 2 is not disposed inside the cooling roller 22.

As described above, according to the present embodiment, in the cooling device 18 that includes the cooling roller 22 having the outer tube 1 that is the hollow tubular member and the pump 100 that is a cooling medium transport unit for transporting the cooling liquid into the cooling roller 22 and makes the paper P contact the cooling roller 22 to cool down the paper P, the turbulence generating unit that generate the turbulence in the cooling liquid is disposed near the inner wall of the outer tube 1, and so the flow of the cooling liquid is converted to the turbulence near the inner wall by the turbulence generating unit. As a result, the cooling liquid having a high temperature near the inner wall and the cooling liquid having a low temperature at a location away from the inner wall are actively interchanged. Therefore, the temperature of the cooling liquid can be lower than when the turbulence generating unit is not disposed near the inner wall, and thus the cooling roller 22 can be effectively cooled down by the cooling liquid as much. Accordingly, the cooling efficiency of the paper P by the cooling roller can be improved.

Further, according to the present embodiment, by employing a configuration in which the turbulence generating unit is detachably attached to the outer tube 1, a complicated process for forming a groove or a slit in the outer tube 1 in advance in order to provide the turbulence generating unit is not necessary, and the turbulence generating unit can be attached as an add-on and can be easily replaced for maintenance.

Further, according to the present embodiment, provided may be a dual tube structure in which the inner tube 7 with the finer tubular structure more than the outer tube 1 is disposed in the hollow inside of the outer tube 1 that is the tubular member, and an outside flow passage in which the cooling liquid flows between the outer tube 1 and the inner tube 7 and an inside flow passage in which the cooling liquid flows inside the inner tube 7 are formed. Thereby, the flow passage of the cooling liquid can be divided into the space between the outer tube 1 and the inner tube 7 and the inside of the inner tube 7, and thus one can be used as the forward passage of the flow of the cooling liquid, and the other can be used as the return passage of the flow of the cooling liquid. Therefore, the inflow and outflow passages of the cooling liquid can be formed at a one end of the cooling roller 22 in the axial direction. Thus, the space can be saved compared to the case where the inflow and outflow passages of the cooling liquid are formed at different ends of the cooling roller 22 in the axial direction. Further, the cooling roller 22 can be easily mounted in the cooling device 18 or the image forming device.

Further, according to the present embodiment, the cylinder 8 having a diameter larger than the inner tube 7 may be mounted in the hollow inside of the outer tube 1 so as to surround the inner tube 7. According to this configuration, the space between the outer tube 1 and the cylinder 8 is narrowed and thus the flow velocity of the cooling liquid increases near the inner wall of the outer tube, and the heat transfer rate between the roller inner wall and the cooling liquid increases, whereby the cooling efficiency of the paper P is improved.

Further, according to the present embodiment, the inner tube 7 may be disposed to rotate with a different rotation number in the same direction as the rotation direction of the outer tube 1, rotate in a direction reverse to the rotation direction of the outer tube 1, or in a fixed state, According to this configuration, in the flow passage configured with the space between the outer tube 1 and the inner tube 7, the rotation speed component increases, and so the generation of the turbulence of the cooling liquid by the turbulence generating unit can be promoted. Therefore, more separation or adhesion of the flow of the cooling liquid occurs throughout the inner wall of the outer tube, and the cooling efficiency of the paper P can be further improved.

Further, according to the present embodiment, the cylinder 8 may be disposed to rotate with a different rotation number in the same direction as the rotation direction of the outer tube 1, rotate in a direction reverse to the rotation direction of the outer tube 1, or in a fixed state. According to this configuration, in the flow passage configured with the space between the outer tube 1 and the cylinder 8, the rotation speed component increases, and the turbulence generation of the cooling liquid by the turbulence generating unit described above can be promoted. Therefore, more separation or adhesion of the flow of the cooling liquid occurs throughout the inner wall of the outer tube, and the cooling efficiency of the paper P can be further improved.

Further, according to the present embodiment, the turbulence generating unit may be disposed in an area extending in the longitudinal direction of the outer tube 1 where the paper P is held. According to this configuration, the fluid resistance caused by the turbulence generating unit is not generated in sections other than the area, and thus the load of the pump is reduced, and the power consumption is reduced. Further, a pump lower than one rank can be used, and the cost can be reduced. Further, as the power consumption of the pump is reduced, durable time is increased.

Further, according to the present embodiment, the turbulence generating unit may be disposed in an area extending in the circumferential direction of the outer tube 1 where the paper P is held. According to this configuration, the fluid resistance caused by the turbulence generating means is not generated in the sections other than the area, and thus the load of the pump is reduced, and the power consumption is reduced. Further, a pump lower than one rank can be used, and the cost can be reduced. Further, when the power consumption of the pump is reduced, durable time is increased.

Further, according to the present embodiment, the vibrating unit for vibrating the turbulence generating unit may be disposed. According to this configuration, the turbulence generating unit is vibrated, so that the flow velocity of the cooling liquid near the turbulence generating unit increases. Therefore, the turbulence generation of the cooling liquid by the turbulence generating unit described above can be promoted. As a result, more separation or adhesion of the flow of the cooling liquid occurs throughout the inner wall of the outer tube, whereby the cooling efficiency of the paper P can be further improved.

Further, according to the present embodiment, by employing a configuration in which the turbulence generating unit is the coil-like member, the cooling roller 22 of the present invention can be easily implemented at a low cost.

Further, according to the present embodiment, the turbulence generating unit may be the net-like member. According to this configuration, the cooling roller 22 of the present invention can be easily implemented at a low cost, for example, by employing a configuration in which a metal net is formed to have a cylindrical shape having a diameter slightly smaller than the outer tube 1 and inserted into the outer tube 1.

Further, according to the present embodiment, the turbulence generating unit may have the helical shape, and the winding direction of the helical shape may be set to the winding direction that causes the feeding in a direction reverse to the flow direction of the cooling liquid flowing near the inner wall of the outer tube 1. According to this configuration, the turbulence is further generated in the cooling liquid near the inner wall of the outer tube 1, so that the cooling performance is further improved. Thus, the cooling efficiency of the paper P can be improved.

Further, according to the present embodiment, the core 31 as the core member may be disposed in the hollow inside of the outer tube 1, and the flow passage in which the cooling liquid flows may be formed in the space formed between the outer tube 1 in which the turbulence generating unit is disposed and the core 31. According to this configuration, the cooling liquid flows through the flow passage of the narrow space in which the core 31 is disposed thereinside, and thus the flow velocity of the cooling liquid increases near the inner wall of the outer tube, and the heat transfer rate between the roller inner wall and the cooling liquid increases, and the cooling efficiency of the paper P is also improved.

Further, according to the present embodiment, the second turbulence generating unit for generating the turbulence in the cooling liquid near the outer circumferential surface of the core 31 may be disposed. According to this configuration, the more complicated and larger turbulence is generated in the flow passage space, and thus the heat transfer rate between the roller inner wall and the cooling liquid is further increased, and the cooling efficiency of the paper P can be improved.

Further, according to the present embodiment, the second turbulence generating unit for generating the turbulence in the cooling liquid near the outer circumferential surface of the inner tube 7 may be disposed. According to this configuration, the more complicated and larger turbulence is generated in the flow passage space, and thus the heat transfer rate between the roller inner wall and the cooling liquid is further increased, and the cooling efficiency of the paper P is improved.

Further, according to the present embodiment, the second turbulence generating unit for generating the turbulence in the cooling liquid near the outer circumferential surface of the cylinder 8 may be disposed. According to this configuration, the more complicated and larger turbulence is generated in the flow passage space, and thus the heat transfer rate between the roller inner wall and the cooling liquid is further increased, and the cooling efficiency of the paper P is improved.

Further, according to the present embodiment, the core 31 may be disposed to rotate with a different rotation number in the same direction as the rotation direction of the outer tube 1, rotate in a direction reverse to the rotation direction of the outer tube 1, or in a fixed state. According to this configuration, in the flow passage of the narrow space formed by including the core 31 inside the outer tube 1, the rotation speed component is increased, and the generation of the turbulence of the cooling liquid by the turbulence generating unit described above can be promoted. Therefore, more separation or adhesion of the flow of the cooling liquid occurs throughout the inner wall of the outer tube, and the cooling efficiency of the paper P can be further improved.

Further, according to the present embodiment, in the image forming device including the toner image forming unit for forming the toner image on the paper P, the heat fixing unit 16 for fixing the toner image, which is formed on the paper P, on the paper P by at least heat, and the cooling unit for cooling down the paper P on which the toner image is fixed by the heat fixing unit 16, the cooling efficiency can be improved by using the cooling device 18 having the cooling roller 22 of the present invention as the cooling unit.

Second Embodiment

Next, a cooling device according to a second embodiment will be described with reference to FIGS. 23 to 41. Here, configuration examples of a cooling roller 110 different from the cooling roller 22 of the cooling device 18 according to the first embodiment described above will be described. A cooling device that is the same as the cooling device illustrated in FIG. 2 regarding an overall configuration is used, and duplicated description will be omitted. Further, a configuration of an image forming device in which the cooling device according to the present embodiment is mounted is also the same as that in FIG. 22, and thus duplicated description is omitted in the present embodiment.

Configuration Example 1

Figure 23:
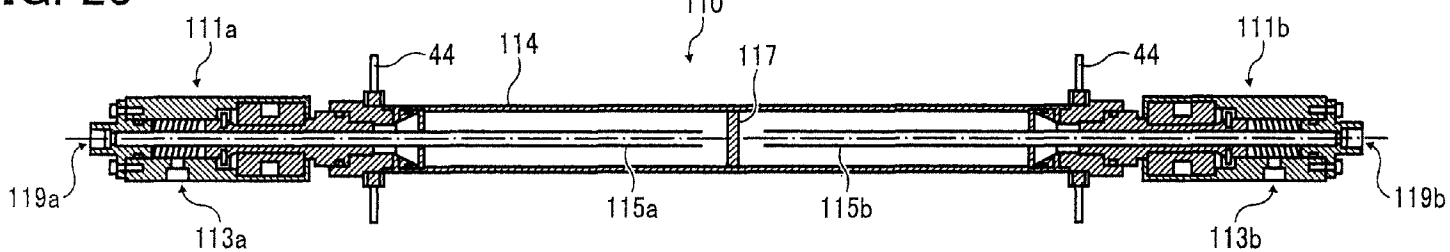
FIG. 23 is an explanation view illustrating a schematic configuration of a cooling roller of a configuration example 1 according to a second embodiment.

Next, a cooling roller 110 according to a configuration example 1 is illustrated in FIG. 23. FIG. 23 is a schematic cross-sectional view of a cooling roller in which rotating tube joint units 111 are mounted to both ends of the cooling roller 110 in the axial direction, and two independent flow passages are formed in the axial direction of the cooling roller 110.

Hereinafter, when discrimination is necessary, components at a first rotating tube joint unit 110*a* side of the cooling roller 110 are designated as "a" behind reference numeral, and components at a second rotating tube joint unit 110*b* side of the cooling roller 110 are designated as "b" behind reference numeral.

Figure 24:
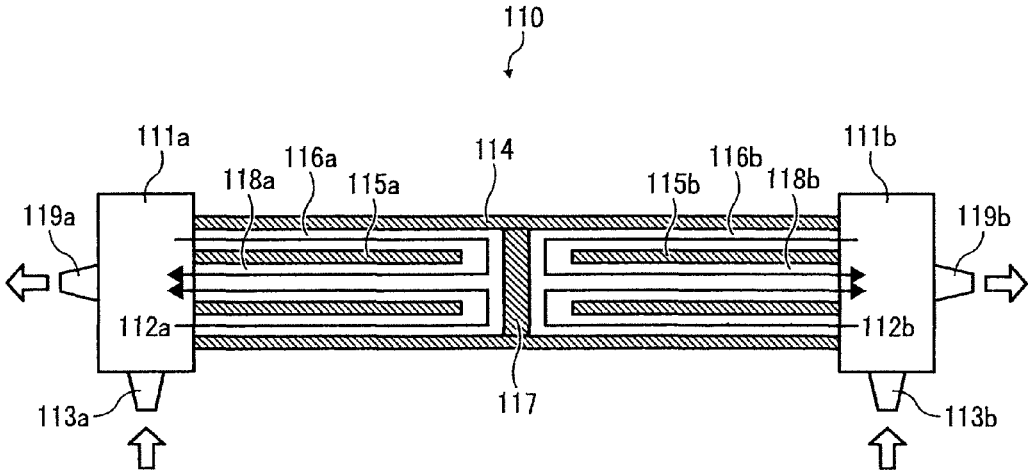
FIG. 24 is a cross-sectional view illustrating a schematic configuration of the cooling roller of the configuration example 1 according to the second embodiment.

In FIG. 24, the cooling liquid is fed from a feed port 113*a* of a first rotating joint unit 111*a* to the cooling roller 110, passes through an outside flow passage 116*a* (a forward flow passage) that is a space between an outer tube 114 and an inner tube 115*a*, is returned by a flow passage wall 117, which separates a flow passage 112*a* and a flow passage 112*b*, present in the middle in the longitudinal direction of the cooling roller 110, passes through an inside flow passage 118*a* (a return flow passage) inside the inner tube 115*a*, and is drained from a drain port 119*a* of the first rotating tube joint unit 111*a*.

Similarly, the cooling liquid is fed from a feed port 113*b* of a second rotating joint unit 111*b* to the cooling roller 110, passes through an outside flow passage 116*b* (a forward flow passage) that is a space between an outer tube 114 and an inner tube 115*b*, is returned by the flow passage wall 117, which separates the flow passage 112*a* and the flow passage 112*b*, present in the middle in the longitudinal direction of the cooling roller 110, passes through an inside flow passage 118*b* (a return flow passage) inside the inner tube 115*b*, and is drained from a drain port 119*b* of the second rotating tube joint unit 111*b*.

In this way, the cooling roller 110 has the two independent flow passages 112*a* and 112*b* in which reciprocating circulation is performed. Therefore, the cooling roller 110 has the cooling area divided in the longitudinal direction of the cooling roller 110 and forms a closed-loop flow passage together with a cooling liquid circulating unit which will be described later through rotating tube joint unit 111*a* and 111*b* to circulate the cooling liquid.

Figure 25:
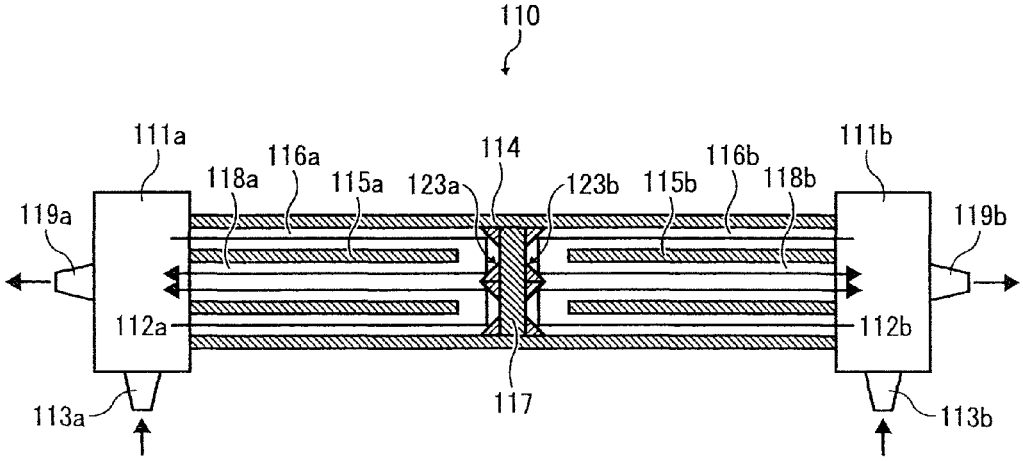
FIG. 25 is a cross-sectional view illustrating a schematic configuration of another cooling roller of the configuration example 1 according to the second embodiment.

Next, FIG. 25 is a schematic cross-sectional view of the cooling roller 110 in which the cooling roller 110 is modified to allow the cooling liquid to easily flow from the outside flow passage 116 to the inside flow passage 118 compared the cooling roller 110 illustrated in FIG. 24.

In the cooling roller 110 illustrated in FIG. 24, since the cooling liquid that flows in through the outside flow passage 116 collides with the flow passage wall 117, it is not easy for the cooling liquid to flow into the inside flow passage 118, and opposite flow may be generated near the flow passage wall 117. For this reason, flow passage auxiliary walls 123*a* and 123*b* having an angle for guiding the flow of the cooling liquid in the direction of the inside flow passage 118 from the outside flow passage 116 are formed in the flow passage wall 117 as illustrated in FIG. 25. Due to the same reason, even though not shown, the flow passage wall 117 may have a shape with a curvature. According to the configuration in which the flow passage auxiliary walls 123*a* and 123*b* are formed in the flow passage wall 117, the cooling liquid smoothly flows to the inside flow passage 118 from the outside flow passage 116, thereby increasing the cooling efficiency.

Configuration Example 2

Figure 26A:
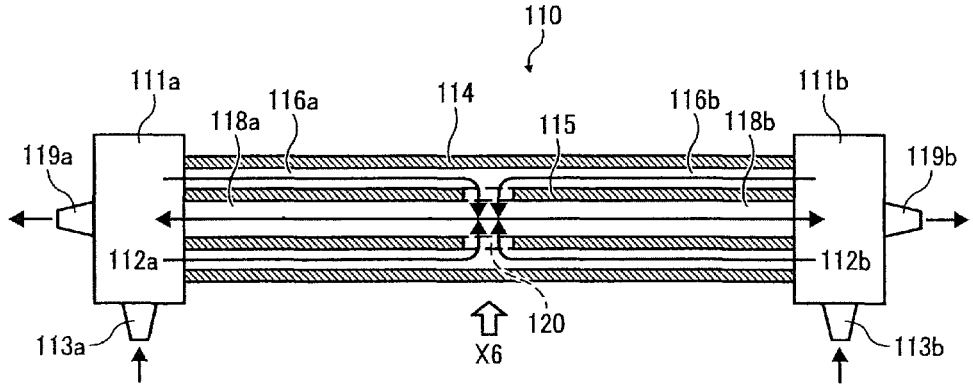
FIG. 26A is a cross-sectional view illustrating a schematic configuration of a cooling roller of a configuration example 2 according to the second embodiment.
Figure 26B:
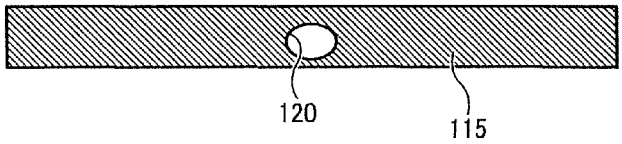
FIG. 26B is an enlarged cross-sectional view illustrating an inner tube of the cooling roller of the configuration example 2.

Next, a cooling roller 110 according to a configuration example 2 is illustrated in FIGS. 26A and 26B. FIG. 26A is a schematic cross-sectional view of a cooling roller 110 having a structure in which the rotating tube joint unit 111 are mounted to both axial direction ends of the cooling roller 110, and a flow passage 112*a* and a flow passage 112*b* are communicated with each other through a flow port 120. FIG. 26B is an enlarged view of the inner tube 115 when the cooling roller 110 illustrated in FIG. 26A is viewed in a direction of an arrow X6 in the drawing.

In FIGS. 26A and 26B, the cooling liquid is fed from the feed port 113*a* of the first rotating joint unit 111*a* to the inside of the cooling roller 110, passes through an outside flow passage 116*a* (the forward flow passage) that is a space between the outer tube 114 and the inner tube 115, passes through an inside flow passage 118*a* (the return flow passage) or an inside flow passage 118*b* (the return flow passage) inside the inner tube 115 via a flow port 120 present in the middle in the longitudinal direction of the cooling roller 110, and is drained from a drain port 119*a* of the first rotating tube joint unit 111*a* or a drain port 119*b* of the second rotating tube joint unit 111*b*.

Similarly, the cooling liquid is fed from the feed port 113*b* of the second rotating joint unit 111*b* to the inside of the cooling roller 110, passes through an outside flow passage 116*b* (the forward flow passage) that is a space between the outer tube 114 and the inner tube 115, passes through the inside flow passage 118*a* (the return flow passage) or the inside flow passage 118*b* (the return flow passage) inside the inner tube 115 via the flow port 120 present in the middle in the longitudinal direction of the cooling roller 110, and is drained from the drain port 119*a* of the first rotating tube joint unit 111*a* or the drain port 119*b* of the second rotating tube joint unit 111*b*.

In this way, the cooling roller 110 has the two independent flow passages 112*a* and 112*b* in which the cooling liquid flows through the flow port 120. Therefore, the cooling roller 110 has the cooling area divided in the longitudinal direction of the cooling roller 110 and forms the closed-loop flow passage together with a cooling liquid circulating unit which will be described later through the first rotating tube joint unit 111*a* and the second rotating tube joint unit 111*b* to circulate the cooling liquid. Since the inner tube 115 is formed with such a simplified shape, the cost can be reduced.

Configuration Example 3

Figure 27A:
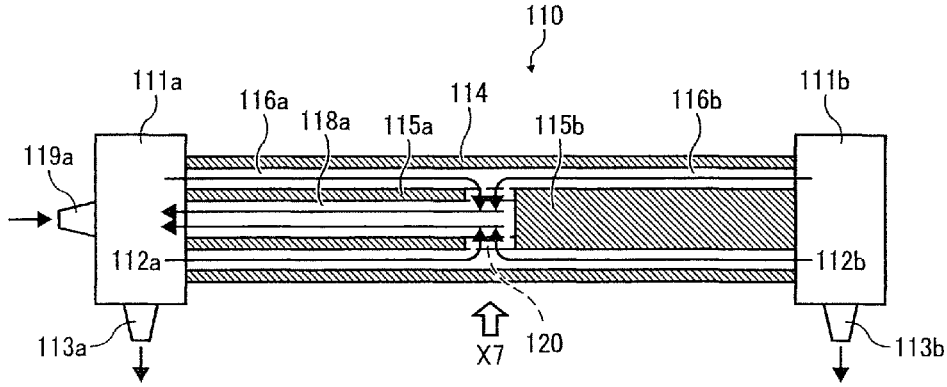
FIG. 27A is a cross-sectional view illustrating a schematic configuration of a cooling roller of a configuration example 3 according to the second embodiment.
Figure 27B:
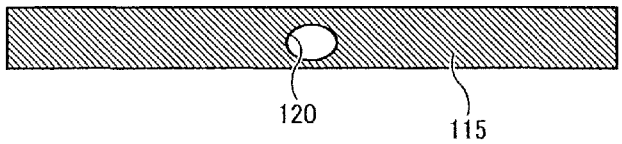
FIG. 27B is a cross-sectional view illustrating an enlarged configuration of an inner tube of the cooling roller of the configuration example 3.

Next, a cooling roller 110 according to a configuration example 3 is illustrated in FIGS. 27A and 27B. FIG. 27A is a schematic cross-sectional view of a cooling roller 110 having a structure in which the rotating tube joint units 111 are mounted to both axial direction ends of the cooling roller 110, a flow passage 112*a* and a flow passage 112*b* are communicated with each other through a flow port 120, and an inside flow passage 118 inside the inner tube 115 and a drain port 119 are formed only at any one side of the first rotating tube joint unit 111*a* side and the second rotating tube joint unit 111*b* side. FIG. 27B is an enlarged view of the inner tube 115 when the cooling roller 110 illustrated in FIG. 27A is viewed in a direction of an arrow X7 in the drawing.

In FIGS. 27A and 27B, the cooling liquid is fed from the feed port 113*a* of the first rotating joint unit 111*a* to the inside of the cooling roller 110, passes through the outside flow passage 116*a* (the forward flow passage) that is a space between the outer tube 114 and the inner tube 115, passes through the inside flow passage 118*a* (the return flow passage) inside the inner tube 115 via the flow port 120 present in the middle in the longitudinal direction of the cooling roller 110, and is drained from the drain port 119*a* of the first rotating tube joint unit 111*a*.

Further, the cooling liquid is fed from the feed port 113*b* of the second rotating joint unit 111*b* to the inside of the cooling roller 110, passes through the outside flow passage 116*b* (the forward flow passage) that is a space between the outer tube 114 and the inner tube 115, passes through the inside flow passage 118*a* (the return flow passage) inside the inner tube 115 via the flow port 120 present in the middle in the longitudinal direction of the cooling roller 110, and is drained from the drain port 119*a* of the first rotating tube joint unit 111*a*.

In this way, the cooling roller 110 has the two flow passages 112*a* and 112*b* in which the cooling liquid flows through the flow port 120. Therefore, the cooling roller 110 has the cooling area divided in the longitudinal direction of the cooling roller 110 and form the closed-loop flow passage together with the cooling liquid circulating unit which will be described later through the first rotating tube joint unit 111*a* and the second rotating tube joint unit 111*b* to circulate the cooling liquid.

Modified Example

Figure 28:
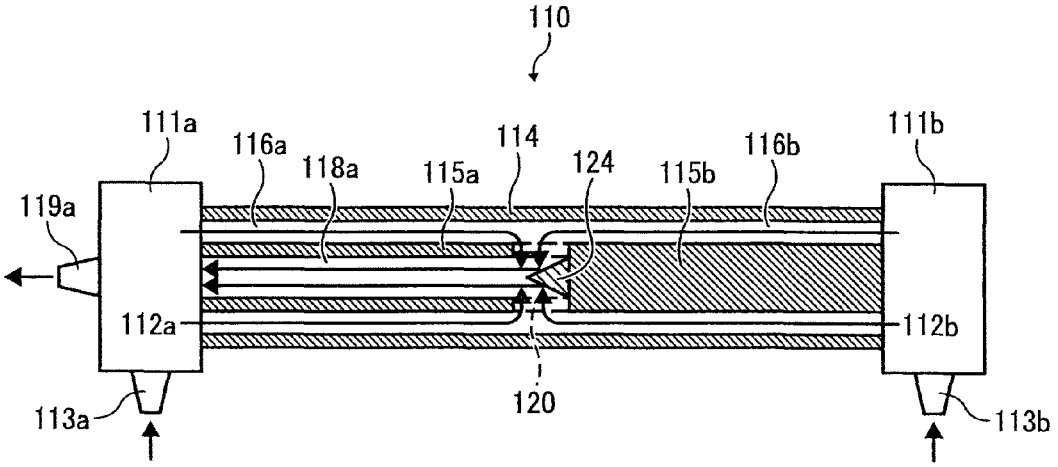
FIG. 28 is a cross-sectional view illustrating a schematic configuration of a cooling roller of a modified example of the configuration example 2 according to the second embodiment.

As illustrated in FIG. 28, a flow passage auxiliary wall 124 that guides the cooling liquid flowing in from the outside flow passage 116 to the inside flow passage 118*a* is formed on an end portion of the inner tube 115*b* at the flow port 120 side. Therefore, the cooling liquid flowing in through the outside flow passage 116 can be easily flowed into the inside flow passage 118 through the flow port 120.

Configuration Example 4

Figure 29A:
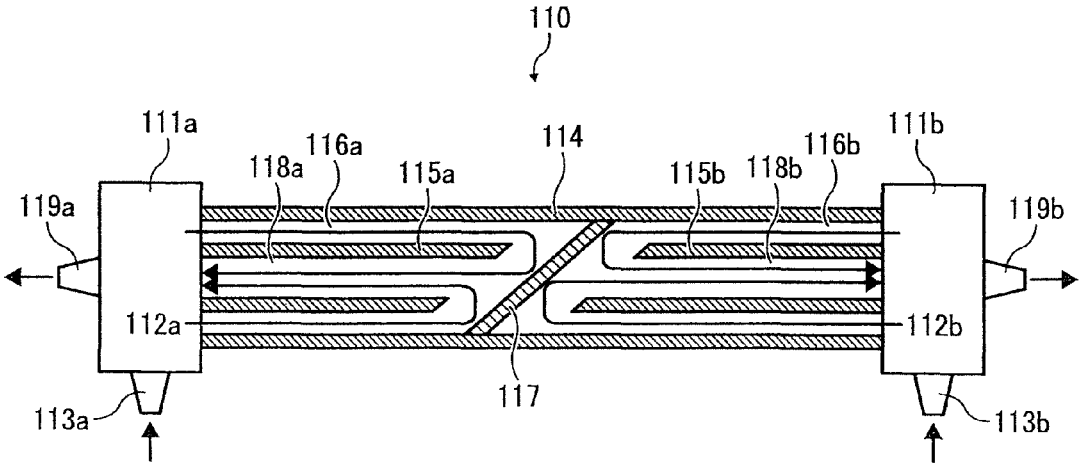
FIG. 29A is a cross-sectional view illustrating a schematic configuration of a cooling roller of a configuration example 4 according to the second embodiment.
Figure 29B:
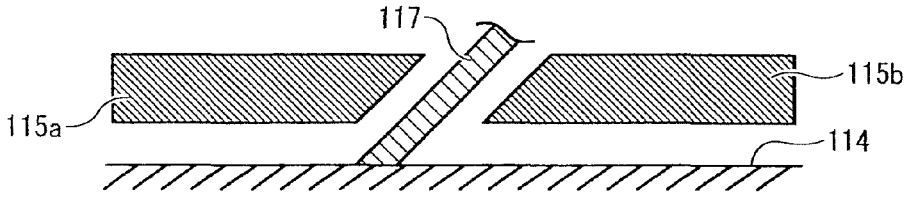
FIG. 29B is an enlarged cross-sectional view illustrating an inner tube of the cooling roller of the configuration example 4.

Next, a cooling roller 110 according to a configuration example 4 is illustrated in FIGS. 29A and 29B. FIG. 29A is a schematic cross-sectional view of a cooling roller 110 having a structure in which the rotating tube joint units 111 are mounted to both axial direction ends of the cooling roller 110, the two independent passages 112 are formed, and return positions in the longitudinal direction of the cooling roller 110 are changed depending on a position along the circumferential direction. FIG. 29B is an enlarged view of the inner tube 115 when the cooling roller 110 illustrated in FIG. 29A is viewed from directly above in the drawing.

In FIGS. 29A and 29B, the cooling liquid is fed from the feed port 113*a* of the first rotating tube joint unit 111*a* to the inside of the cooling roller 110, passes through the outside flow passage 116*a* (the forward flow passage) that is a space between the outer tube 114 and the inner tube 115*a*, is returned by the flow passage wall 117, which separates the passage 112*a* and the passage 112*b*, present in the middle in the longitudinal direction of the cooling roller 110, passes through the inside flow passage 118*a* (a return flow passage) inside the inner tube 115*a*, and is drained from the drain port 119*a* of the first rotating tube joint unit 111*a*.

Similarly, the cooling liquid is fed from the feed port 113*b* of the second rotating tube joint unit 111*b* to the inside of the cooling roller 110, passes through the outside flow passage 116*b* (the forward flow passage) that is a space between the outer tube 114 and the inner tube 115*b*, is returned by the flow passage wall 117, which separates the passage 112*a* and the passage 112*b*, present in the middle in the longitudinal direction of the cooling roller 110, passes through the inside flow passage 118*b* (the return flow passage) inside the inner tube 115*b*, and is drained from the drain port 119*b* of the second rotating tube joint unit 111*b*.

Here, in order to eliminate a spot that can not be cooled locally over one round in a circumferential direction since the cooling liquid is not passed to the outside flow passage 116 at the spot, the flow passage wall 117 is disposed obliquely with respect to the longitudinal direction of the cooling roller 110. The inner tube 115*a* and the inner tube 115*b* have oblique cross sections so that the return positions is changed depending on a position along the circumferential direction and disposed such that a position in the longitudinal direction of the cooling roller 110 is varied.

In this way, the cooling roller 110 has the two independent flow passages 112*a* and 112*b* in which the cooling liquid flows. Therefore, the cooling roller 110 has the cooling area divided in the longitudinal direction of the cooling roller 110 and forms the closed-loop flow passage together with the cooling liquid circulating unit which will be described later through the first rotating tube joint unit 111*a* and the second rotating tube joint unit 111*b* to circulate the cooling liquid.

Configuration Example 5

Figure 30A:
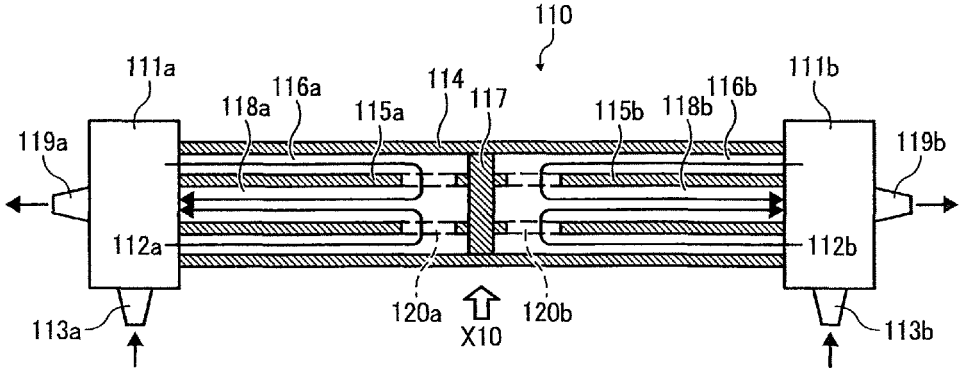
FIG. 30A is a cross-sectional view illustrating a schematic configuration of a cooling roller of a configuration example 5 according to the second embodiment.
Figure 30B:
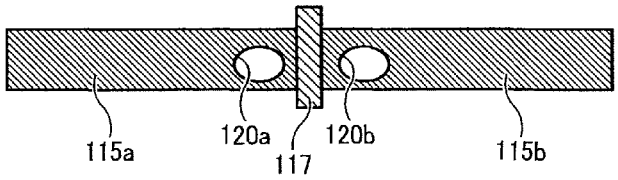
FIG. 30B is an enlarged cross-sectional view illustrating an inner tube of the cooling roller of the configuration example 5.

Next, a cooling roller 110 according to a configuration example 5 is illustrated in FIGS. 30A and 30B. FIG. 30A is a schematic cross-sectional view of a cooling roller 110 in which the rotating tube joint unit 111 are mounted to both axial direction ends of the cooling roller 110, and the two independent flow passages 112*a* and 112*b* are formed. FIG. 30B is an enlarged view of the inner tube 115 when the cooling roller 110 illustrated in FIG. 30A is viewed in a direction of an arrow X10 in the drawing.

The outer tube 114 rotates. One end side of the inner tube 115*a* is fixedly supported to the first rotating tube joint unit 111*a* not to rotate, and the other end side is rotatably supported to the flow passage wall 117 through a bearing (not shown). One end side of the inner tube 115*b* is fixedly supported to the second rotating tube joint unit 111*b* not to rotate, and the other end side is rotatably supported to the flow passage wall 117 through a bearing (not shown). A flow port 120*a* is formed in the inner tube 115*a* near the flow passage wall 117 to allow the cooling liquid to flow from the outside flow passage 116*a* to the inside flow passage 118*a*. A flow port 120*b* is formed in the inner tube 115*b* near the flow passage wall 117 to allow the cooling liquid to flow from the outside flow passage 116*b* to the inside flow passage 118*b*.

The cooling roller 110 having such a configuration generates the turbulence in the flow (the flow in the axial direction and the rotation direction) of the cooling liquid inside the outside flow passage 116, particularly, near the inside of the outer tube 114, thereby increasing the cooling efficiency.

Configuration Example 6

Figure 31A:
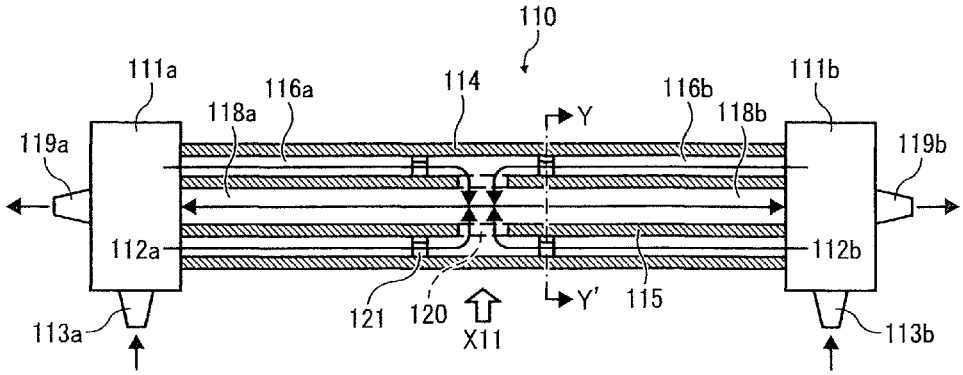
FIG. 31A is a cross-sectional view illustrating a schematic configuration of a cooling roller of a configuration example 6 according to the second embodiment.
Figure 31B:
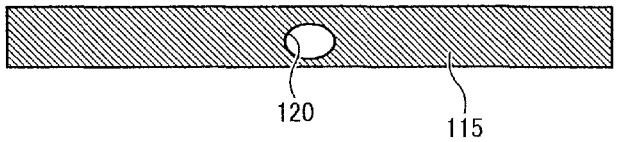
FIG. 31B is an enlarged cross-sectional view illustrating an inner tube of the cooling roller of the configuration example 6.
Figure 32:
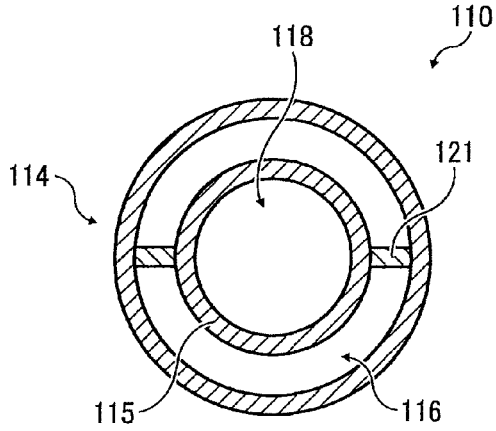
FIG. 32 is a cross-sectional view viewed in the longitudinal direction of the cooling roller of the configuration example 6 according to the second embodiment.

Next, a cooling roller 110 according to a configuration example 6 is illustrated in FIGS. 31A and 31B. FIG. 31A is a schematic cross-sectional view of a cooling roller 110 having a structure in which rotating tube joint unit 111 are mounted to both axial direction ends of the cooling roller 110, and two passages 112*a* and 112*b* are communicated with each other through the flow port 120. The outer tube 114 rotates, and both ends of the inner tube 115 are rotatably supported to the rotating tube joint unit 111. FIG. 31B is an enlarged view of the inner tube 115 when the cooling roller 110 illustrated in FIG. 31A is viewed in a direction of an arrow X11 in the drawing. FIG. 32 is a cross-sectional view when a cross section of the cooling roller 110 taken along line Y-Y' of FIG. 31A is viewed in the longitudinal direction of the cooling roller 110.

In the present configuration example, as illustrated in FIG. 32, the outer tube 114 and the inner tube 115 are locally fixed by a coupling support unit 121. Therefore, the outer tube 114 and the inner tube 115 rotate together. Preferably, the coupling support unit 121 has a mechanical strength that can endure a load generated when the outer tube 114 and the inner tube 115 rotate together and has a structure that disturbs the flow of the cooling liquid flowing through the outside flow passage 116 as little as possible.

The cooling roller 110 having such a configuration makes smooth the flow (in the axial direction and the rotation direction) of the cooling liquid inside the outside flow passage 116, thereby increasing the cooling efficiency.

Configuration Example 7

Figure 33A:
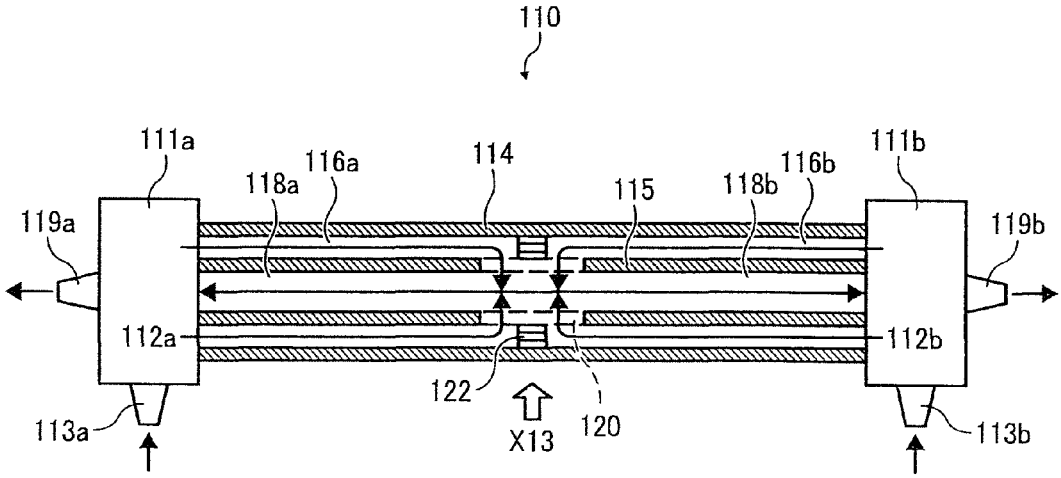
FIG. 33A is a cross-sectional view illustrating a schematic configuration of a cooling roller of a configuration example 7 according to the second embodiment.
Figure 33B:
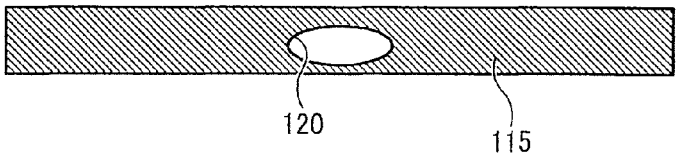
FIG. 33B is an enlarged cross-sectional view illustrating an inner tube of the cooling roller of the configuration example 7.

Next, a cooling roller 110 according to a configuration example 7 is illustrated in FIGS. 33A and 33B. FIG. 33A is a schematic cross-sectional view of a cooling roller 110 having a structure in which the rotating tube joint unit 111 are mounted to both axial direction ends of the cooling roller 110, and the two passages 112*a* and 112*b* are communicated with each other through the flow port 120. FIG. 33B is an enlarged view of the inner tube 115 when the cooling roller 110 illustrated in FIG. 33A is viewed in a direction of an arrow X13 in the drawing.

A flow passage auxiliary wall 122 is fixed to the inner wall of the outer tube 114 between a spot of the inner tube 115 where the flow port 120 is formed and the outer tube 114. The cooling liquids flowing in through the outside flow passages 116*a* and 116*b* easily flow into the inside flow passage 118 through the flow port 120.

When the inner tube 115 does not rotate or when the outer tube 114 and the inner tube 115 rotate together, the flow passage auxiliary wall 122 can be formed to extend up to the inside of the flow port 120. However, when the outer tube 114 and the inner tube 115 asynchronously rotate, the flow passage auxiliary wall 122 needs to be disposed inside the outside flow passage 116 not to contact the inner tube 115.

The flow passage auxiliary wall 122 has an effect of preventing opposite flow from being generated when the cooling liquid flowing in through the outside flow passage 116*a* and the cooling liquid flowing in through the inside flow passage 116*b* collide with each other at a position of the flow port 120 and making smooth the flow of the cooling liquid.

Figure 34:
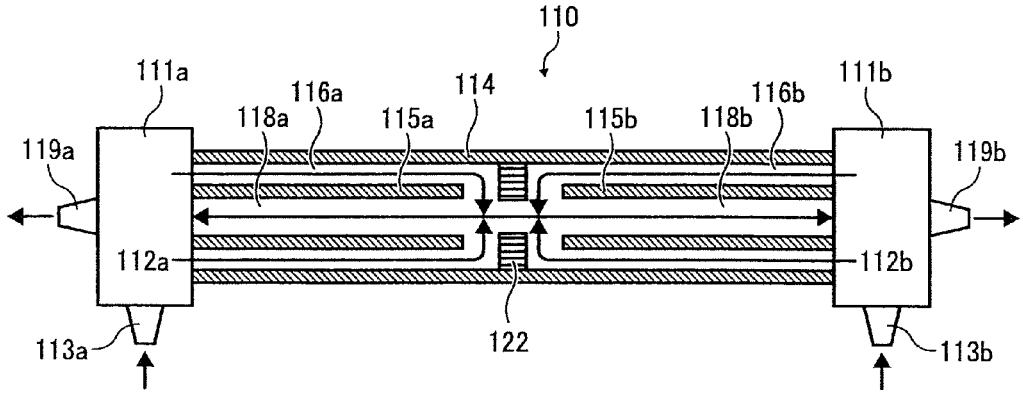
FIG. 34 is a cross-sectional view illustrating a schematic configuration of another cooling roller of the configuration example 7 according to the second embodiment.

Further, as illustrated in FIG. 34, even when the inner tube 115 is divided into an inner tube 115*a* and an inner tube 115*b*, the flow passage auxiliary wall 122 may be disposed to be fixed to the inner wall of the outer tube 114 near the passages 112*a* and 112*b*. In this case, it is possible to enable the cooling liquids flowing in through the outside flow passages 116*a* and 116*b* to easily flow into the inside flow passages 118*a* and 118*b* through the passages 112*a* and 112*b*.

Configuration Example 8

Figure 35A:
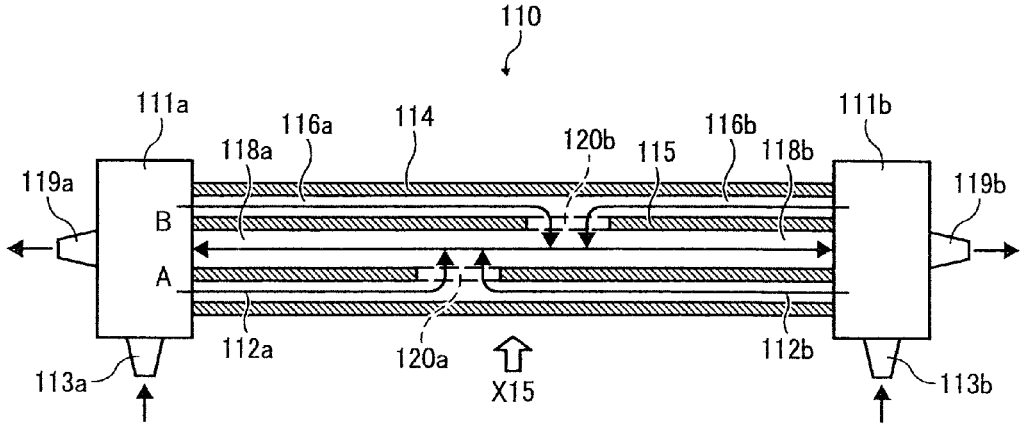
FIG. 35A is a cross-sectional view illustrating a schematic configuration of a cooling roller of a configuration example 8 according to the second embodiment.
Figure 35B:
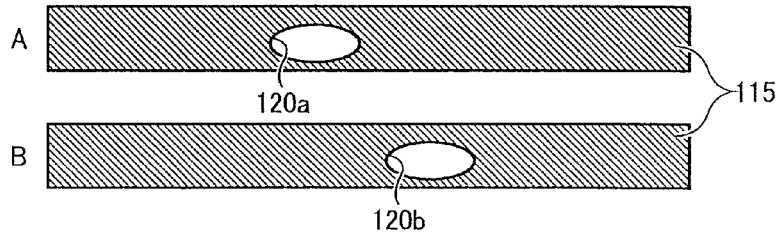
FIG. 35B is an enlarged cross-sectional view illustrating an inner tube of the cooling roller of the configuration example 8.

Next, a cooling roller 110 according to a configuration example 8 is illustrated in FIGS. 35A and 35B. FIG. 35A is a schematic cross-sectional view of a cooling roller 110 having a structure in which the rotating tube joint unit 111 are mounted to both ends of the cooling roller 110 in the axial direction, and the two passages 112*a* and 112*b* are communicated with each other through the flow port 120. FIG. 35B is a cross-sectional view when the cooling roller 110 illustrated in FIG. 35A is viewed in a direction of an arrow X15 in the drawing.

In the present configuration example, at least two flow ports 120*a* and 120*b* that allow the outside flow passage 116 and the inside flow passage 118 to communicate with each other are formed in the inner tube 115. Positions where the cooling liquids are returned in the longitudinal direction of the cooling roller 110 are different in the circumferential direction.

At a circumferential direction position A of the cooling roller 110 of FIG. 35A, the cooling liquid is fed from the feed port 113*a* of the first rotating tube joint unit 111*a* to the inside of the cooling roller 110, passes through the outside flow passage 116*a* that is a space between the outer tube 114 and the inner tube 115, passes through the inside flow passage 118*a* or the inside flow passage 118*b* inside the inner tube 115 through the flow port 120*a* present in the middle in the longitudinal direction of the cooling roller 110, and is drained from the drain port 119*a* of the first rotating tube joint unit 111*a* or the drain port 119*b* of the second rotating tube joint unit 111*b*.

Similarly, the cooling liquid is fed from the feed port 113*b* of the second rotating tube joint unit 111*b* to the inside of the cooling roller 110, passes through the outside flow passage 116*b* that is a space between the outer tube 114 and the inner tube 115, passes through the inside flow passage 118*a* or the inside flow passage 118*b* inside the inner tube 115 through the flow port 120*a* present in the middle in the longitudinal direction of the cooling roller 110, and is drained from the drain port 119*a* of the first rotating tube joint unit 111*a* or the drain port 119*b* of the second rotating tube joint unit 111*b*.

At a circumferential direction position B of the cooling roller 110 of FIG. 35A, the cooling liquid is fed from the feed port 113*a* of the first rotating tube joint unit 111*a* to the inside of the cooling roller 110, passes through the outside flow passage 116*a* that is a space between the outer tube 114 and the inner tube 115, passes through the inside flow passage 118*a* or the inside flow passage 118*b* inside the inner tube 115 through the flow port 120*b* present in the middle in the longitudinal direction of the cooling roller 110, and is drained from the drain port 119*a* of the first rotating tube joint unit 111*a* or the drain port 119*b* of a second rotating tube joint unit 111*b*.

Similarly, the cooling liquid is fed from the feed port 113*b* of the second rotating tube joint unit 111*b* to the inside of the cooling roller 110, passes through the outside flow passage 116*b* that is a space between the outer tube 114 and the inner tube 115, passes through the inside flow passage 118*a* or the inside flow passage 118*b* inside the inner tube 115 through the flow port 120*b* present in the middle in the longitudinal direction of the cooling roller 110, and is drained from the drain port 119*a* of the first rotating tube joint unit 111*a* or the drain port 119*b* of the second rotating tube joint unit 111*b*.

As described above, a plurality of flow ports formed in the inner tube 115 are disposed at different positions in the circumferential direction of the cooling roller 110. When the cooling liquids flowing in through the outside flow passages 116 at different positions in the circumferential direction flow into the inside flow passage 118, the cooling liquids flowing into the inside flow passage 118 from the different flow ports 120 do not collide with each other. Therefore, opposite flow or the turbulence can be reduced, and the flow of the cooling liquid from the outside flow passage 116 to the inside flow passage 118 becomes smooth, thereby increasing the cooling efficiency.

Configuration Example 9

Figure 36:
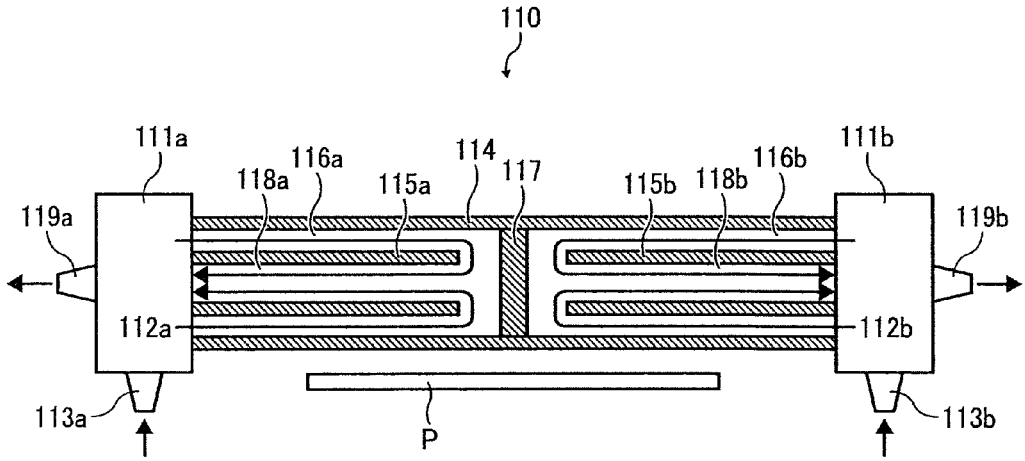
FIG. 36 is a cross-sectional view illustrating a schematic configuration of a cooling roller of a configuration example 9 according to the second embodiment.

Next, a cooling roller 110 according to a configuration example 9 is illustrated in FIG. 36. FIG. 36 is a schematic cross-sectional view of a cooling roller 110 having a structure in which the rotating tube joint unit 111 are mounted to both axial direction ends of the cooling roller 110, and the passage 112*a* and the passage 112*b* are communicated with each other through the flow port 120. The paper P that became a high temperature while passing through the heat fixing unit 16 (see FIG. 2) is transported in a direction orthogonal to the longitudinal direction of the cooling roller 110.

In FIG. 36, the cooling liquid is fed from the feed port 113*a* of a first rotating tube joint unit 111*a* to the inside of the cooling roller 110, passes through the outside flow passage 116*a* that is a space between the outer tube 114 and the inner tube 115*a*, is returned by the flow passage wall 117, which separates the passage 112*a* and the passage 112*b*, present in the middle in the longitudinal direction of the cooling roller 110, passes through the inside flow passage 118*a* inside the inner tube 115*a*, and is drained from the drain port 119*a* of the first rotating tube joint unit 111*a*.

Similarly, the cooling liquid is fed from the feed port 113*b* of the second rotating tube joint unit 111*b* to the inside of the cooling roller 110, passes through the outside flow passage 116*b* that is a space between the outer tube 114 and the inner tube 115*b*, is returned by the flow passage wall 117, which separates the passage 112*a* and the passage 112*b*, present in the middle in the longitudinal direction of the cooling roller, passes through the inside flow passage 118*b* inside the inner tube 115*b*, and is drained from the drain port 119*b* of the second rotating tube joint unit 111*b*.

Therefore, if heat is not received from the outside except the paper P, directly after the cooling liquid is fed to the cooling roller 110, the temperature of the cooling liquid flowing through the outside flow passage 116 of the cooling roller 110 and the surface temperature of the outer tube 114 of the cooling roller 110 are lowest at the first rotating tube joint unit 111*a* side or the second rotating tube joint unit 111*b* side and are highest near the flow passage wall 117.

For this reason, in the present configuration example, the paper P is transported in the longitudinal direction of the cooling roller 110 so that a central position of the paper P can pass through a position of the flow passage wall 117. As a result, the outer tube 114 of the cooling roller 110 is cooled down with a temperature gradient that becomes equal left and right in the width direction of the paper P, and the passages 112*a* and 112*b* are deprived of the same heat quantity. Therefore, it is possible to prevent the temperature of the cooling liquid from being greatly increased in any one of the passages 112.

Further, since the outer tube 114 of the cooling roller 110 is cooled down with the temperature gradient that is equal left and right in the width direction of the paper P, it is possible to reduce curl, and image quality and gloss unevenness caused by fixing in the width direction of the paper P.

Further, when the cooling roller 110 of a structure that does not have the flow passage wall 117 formed in the cooling roller 110 is used in the present configuration example, the paper P is preferably transported in the longitudinal direction of the cooling roller 110 so that the central position of the paper P can pass through the central position of the flow port 120.

Figure 37:
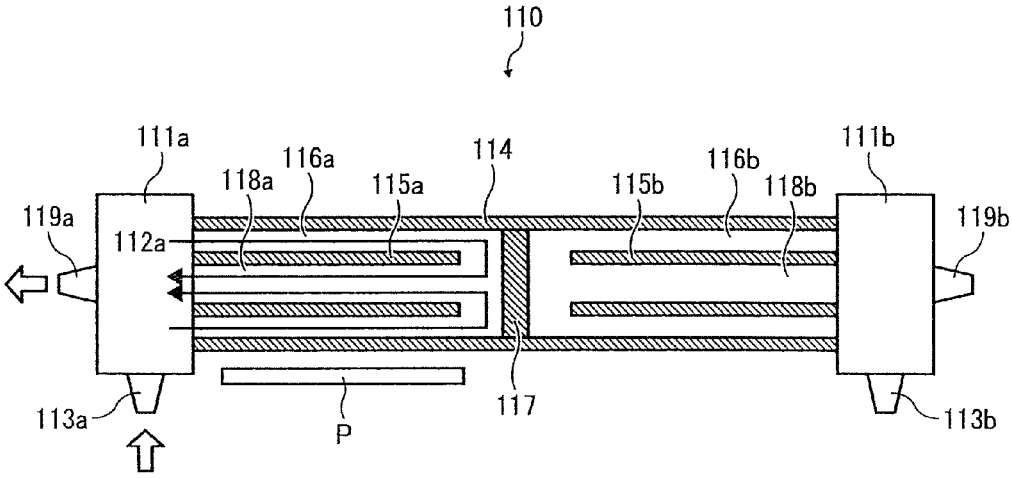
FIG. 37 is an explanation view illustrating a passing position of a paper with respect to a cooling roller according to the second embodiment.

Here, if the width of the paper P is smaller than the length of the outside flow passage 116*a*, the cooling liquid is passed only to the passage 112*a*, and the paper P is transported on the outside flow passage 116*a* of the cooling roller 110 as illustrated in FIG. 37. As described above, the paper P is cooled down by passing the cooling liquid only to one flow passage, thereby saving the energy and increasing the lift span of the cooling device 18.

In FIG. 37, the outside flow passage 116*a* is identical in length to the outside flow passage 116*b*. However, the outside flow passage 116*a* may be different in length from the outside flow passage 116*b*. In this case, the width of the paper P is detected. If the width of the paper P is smaller than both of the length of the outside flow passage 116*a* and the length of the outside flow passage 116*b*, the paper P can be transported on either of the outside flow passage 116*a* and the outside flow passage 116*b*. However, if the width of the paper P is larger than one of the length of the outside flow passage 116*a* and the length of the outside flow passage 116*b* and smaller than the other, the paper P is preferably transported on the outside flow passage 116*a* or the outside flow passage 116*b* that has the length larger than the width of the paper P.

Next, a case where the cooling liquid 102 is fed through one feed unit will be described with reference to FIG. 38.

Figure 38:
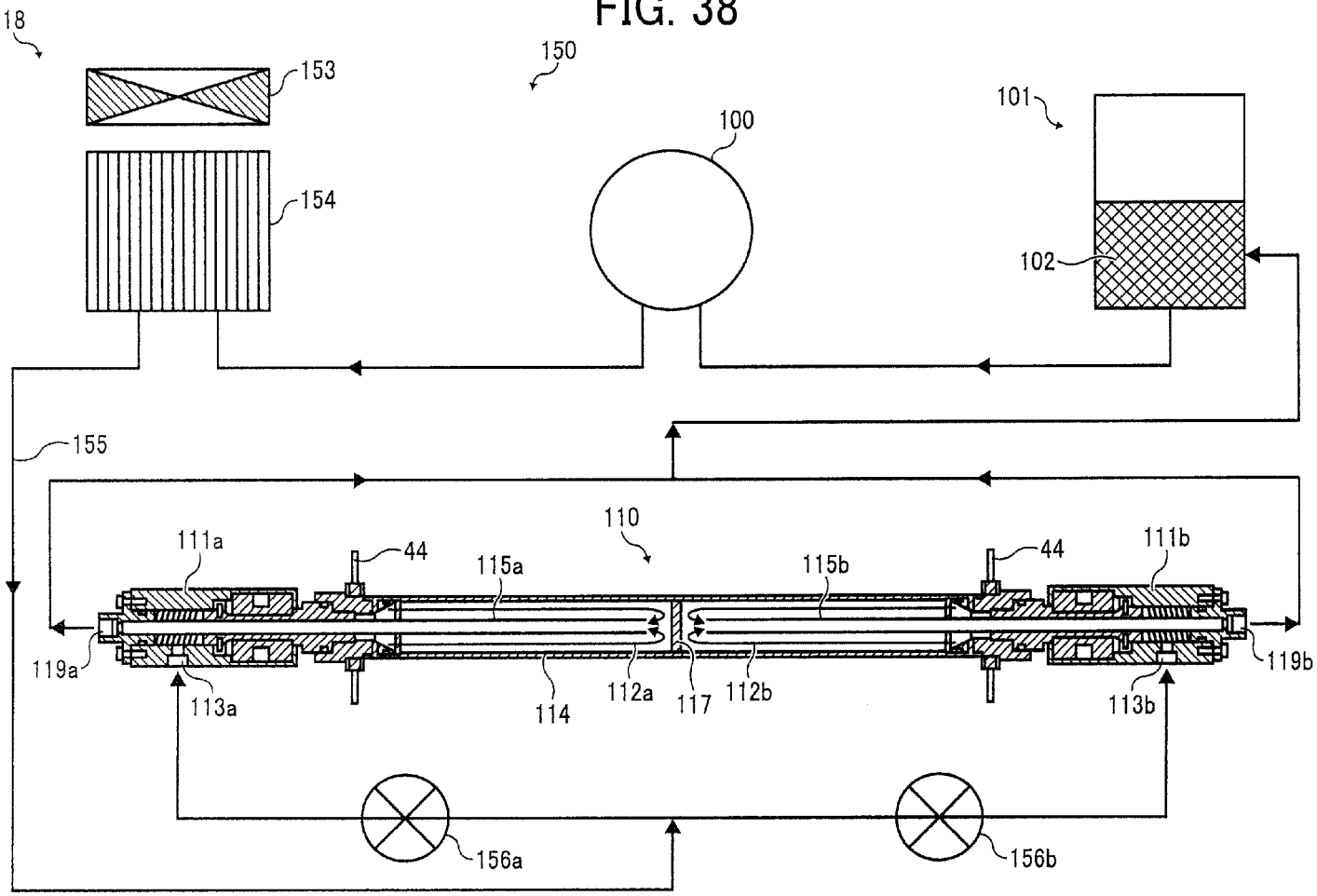
FIG. 38 is a view illustrating a cooling circulation device in which a cooling liquid is fed through one feed unit.

In a cooling circulation device 150, illustrated in FIG. 38, used in the cooling device 18, the cooling liquid 102 inside the tank 101 is fed by the pump 100, and when passing through a radiator 154 that is a heat radiation unit, a cooling fan 153 blows air to radiate heat to the outside, thereby lowering the temperature of the cooling liquid 102 (heat exchange between the cooling liquid 102 and the outside). The cooling liquid 102 cooled down by the radiator 154 is fed to the inside of the cooling roller 110 from the feed port 113*a* of the first rotating tube joint unit 111*a* and the feed port 113*b* of the second rotating tube joint unit 111*b*, which are mounted to both axial direction ends of the cooling roller 110 via a liquid feed tube 155 and flows through the passage 112*a* or the passage 112*b* inside the cooling roller 110. At this time, the cooling roller 110 deprives the paper P, which became a high temperature while passing through the heat fixing unit 16, of heat, so that the temperature of the cooling liquid 102 inside the cooling roller 110 is raised (heat exchange between the cooling liquid 102 and the paper P). The cooling liquid 102 that was raised in temperature inside the cooling roller 110 is drained from the drain port 119*a* of the first rotating tube joint unit 111*a* or the drain port 119*b* of the second rotating tube joint unit 111*b* and is fed again by the pump 100 via the tank 101. Through the circulation of the cooling liquid 102, radiating heat of the paper P to the outside of the cooling device 18 is repeated.

In the cooling circulation device 150 illustrated in FIG. 38, if the flow passage to the cooling roller 110 from after going out of the radiator 154 and the flow passages of the passage 112*a* side and the passage 112*b* side of the cooling roller 110 are the same in structure, feeding can be performed by one pump 100, so that the feed port 113*a* and the feed port 113*b* have the same flow quantity and pressure. Therefore, the cooling roller 110 can have the cooling efficiency that is symmetrical at the left side and the right side of the flow passage wall 117.

Next, a case where the cooling liquid 102 is fed through two feed unit will be described with reference to FIG. 39.

Figure 39:
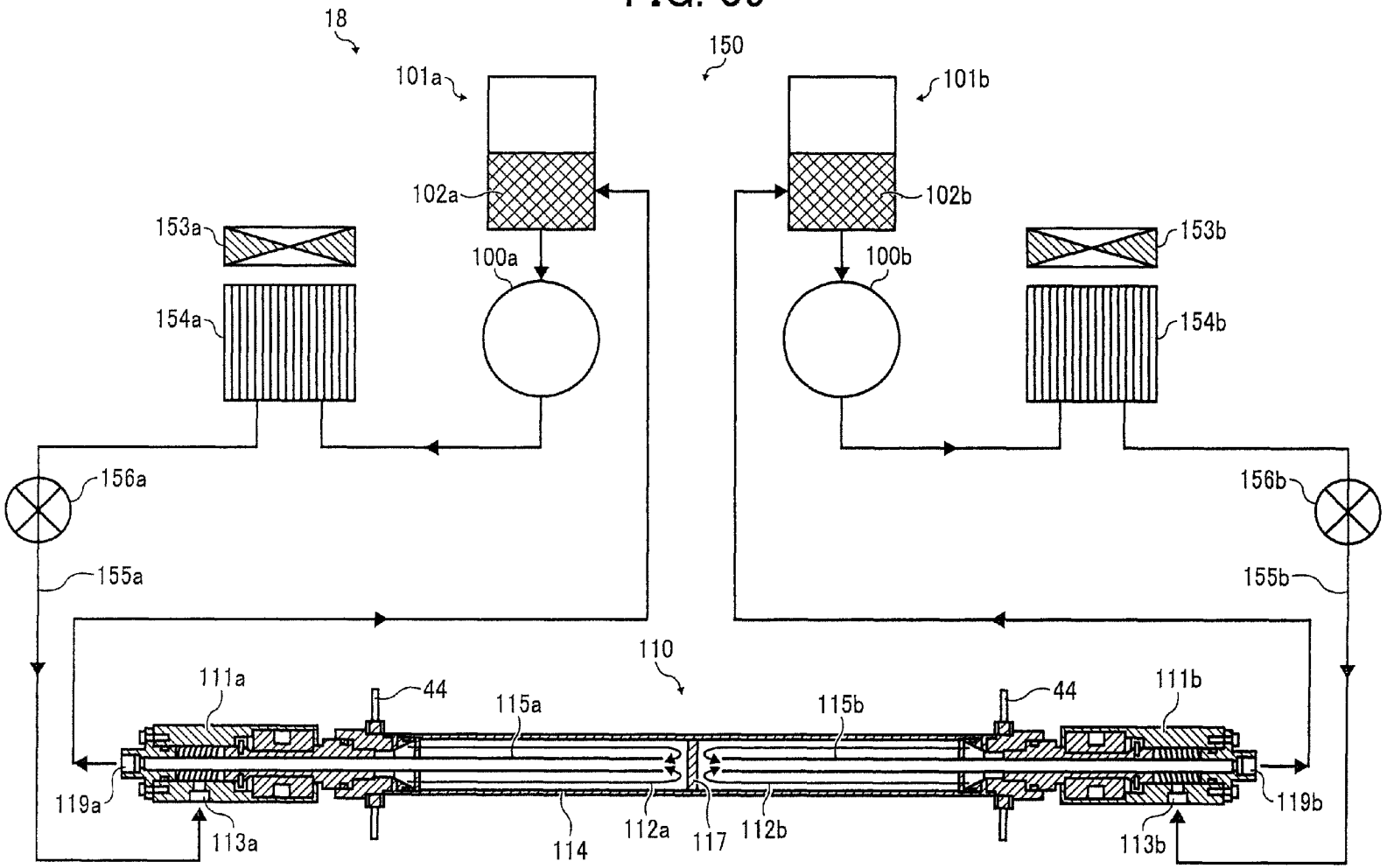
FIG. 39 is a view illustrating a cooling circulation device in which a cooling liquid is fed through two feed units.

In the cooling circulation device 150 illustrated in FIG. 39, circulation systems of the cooling liquids 102 of the passage 112*a* and the passage 112*b* of the cooling roller 110 have independent flow passages.

A cooling liquid 102*a* inside a tank 101*a* is fed by the pump 100*a*, and when passing through a radiator 154*a*, a cooling fan 153*a* blows air to radiate heat to the outside, thereby lowering the temperature of the cooling liquid 102*a* (heat exchange between the cooling liquid 102*a* and the outside). The cooling liquid 102*a* cooled down by the radiator 154*a* is fed to the inside of the cooling roller 110 from the feed port 113*a* of the first rotating tube joint unit 111*a*, which is mounted to an axial direction one end of the cooling roller 110, through a feed tube 155*a*, and flows through the passage 112*a* inside the cooling roller 110. At this time, the cooling roller 110 deprives the paper P, which became a high temperature through the heat fixing unit 16, of heat, so that the temperature of the cooling liquid 102*a* inside the cooling roller 110 is raised (heat exchange between the cooling liquid 102*a* and the paper P). The cooling liquid 102*a* that was raised in temperature inside the cooling roller 110 is drained from the drain port 119*a* of the first rotating tube joint unit 111*a* and is fed again by the pump 100*a* via the tank 101*a*.

Further, a cooling liquid 102*b* inside a tank 101*b* is fed by the pump 100*b*, and when passing through a radiator 154*b*, a cooling fan 153*b* blows air to radiate heat to the outside, thereby lowering the temperature of the cooling liquid 101 (heat exchange between the cooling liquid 102*b* and the outside). The cooling liquid 102*b* cooled down by the radiator 154*b* is fed to the inside of the cooling roller 110 from the feed port 113*b* of the second rotating tube joint unit 111*b*, which is mounted to an axial direction one end of the cooling roller 110, through a feed tube 155*b*, and flows through the passage 112*b* inside the cooling roller 110. At this time, the cooling roller 110 deprives the paper P, which became a high temperature through the heat fixing unit 16, of heat, so that the temperature of the cooling liquid 102*b* inside the cooling roller 110 is raised (heat exchange between the cooling liquid 102*b* and the paper P). The cooling liquid 102*b* that was raised in temperature inside the cooling roller 110 is drained from the drain port 119*b* of the second rotating tube joint unit 111*b* and is fed again by the pump 100*b* via the tank 101*b*.

Therefore, when the passage 112*a* and the passage 112*b* inside the cooling roller 110 are different, when the passage 112*a* and the passage 112*b* of the cooling roller 110 are different in heat quantity received from the outside, or when the flow passages to the cooling roller 110 from after going out of the radiators 154*a* and 154*b* are different, it possible to independently control feed liquid quantities of the pumps 100*a* and 100*b*, air quantities of the cooling fans 153*a* and 153*b*, and flow quantities of the cooling liquids 102*a* and 102*b*.

Next, a mechanism of adjusting the flow quantity of the cooling liquid 102 will be described.

When the cooling circulation device 150 is mounted in the image forming device, even though the flow passage to the cooling roller 110 from after going out of the radiator 154 and the flow passages of the passage 112*a* side and the passage 112*b* side of the cooling roller 110 have the same structure, due to layout and spatial problems, the liquid feed tube 155 connected with the first rotating tube joint unit 111*a* may be different in length from the liquid feed tube 155 connected with the second rotating tube joint unit 111*b*. At this time, due to influence of pressure loss, the two passages inside the cooling roller 110, that is, the passage 112*a* and the passage 112*b* have different cooling efficiencies. Further, in addition to the configuration difference of the circulation system, a variation of the component accuracy or a variation between lots may occur. For these reasons, a flow quantity adjusting valve 156 is connected to the liquid feed tube 155 of the cooling circulation device 150, and thus the flow quantity can be adjusted through a mechanical mechanism.

Figure 40:
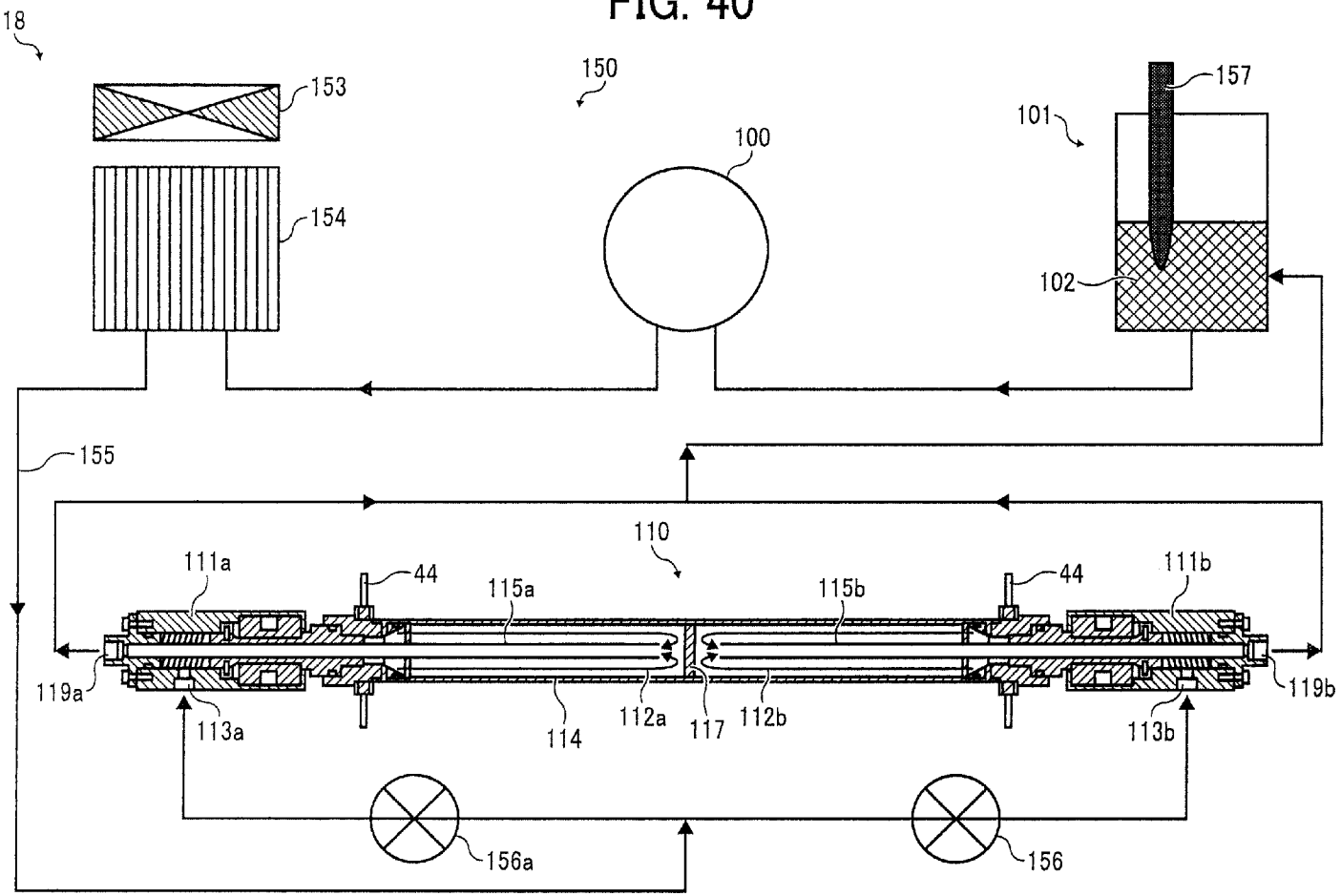
FIG. 40 is a schematic view illustrating a cooling circulation device in which a temperature detecting unit for detecting a temperature of a cooling liquid is disposed inside a tank.

Next, a case of detecting the temperature of the cooling liquid 102 to control the flow quantity of the cooling liquid 102 will be described. FIG. 40 illustrates an example in which a temperature detecting unit that detects the temperature of the cooling liquid 102 is disposed inside the tank 101.

The temperature of the cooling liquid 102 detected by the temperature detecting unit 157 is feedback controlled. The flow quantity of the cooling liquid 102 is adjusted by adjusting the feed liquid quantity of the pump 100 or the flow quantity adjusting valves 156*a* and 156*b* so that the cooling liquid flowing through the passage 112*a* of the cooling roller 110 can have the same temperature as the cooling liquid flowing through the passage 112*b*.

Since the inside of the tank 101 of FIG. 40 is a common position of the passage 112*a* and the passage 112*b*, control is impossible. However, if the temperature detecting unit 157 are disposed adjacent to the flow quantity adjusting valve 156*a* and the flow quantity adjusting valve 156*b*, respectively, the flow quantities of the passage 112*a* and the passage 112*b* can be adjusted by feeding back the detected temperature of the cooling liquid 102 and controlling the flow quantity adjusting valves 156*a* and 156*b*.

In the circulation system of the cooling circulation device 150 illustrated in FIG. 39, a method of disposing the temperature detecting unit 157 in each of the two tanks 101*a* and 101*b* or a method of disposing the temperature detecting unit 157 between the radiator 154*a* and the feed port 113*a* of the first rotating tube joint unit 111*a* and between the radiator 154*b* and the feed port 113*b* of the second rotating tube joint unit 111*b*, respectively, may be considered. Comparing the two methods, the later method of disposing the temperature detecting unit 157 between the radiator 154*a* and the feed port 113*a* and between the radiator 154*b* and the feed port 113*b*, respectively, that is, detecting at those points, has the highest accuracy since the temperatures of the cooling liquids 101*a* and 101*b* cooled down by the radiators 154*a* and 154*b* are close to the temperatures of the cooling liquids fed to the feed ports 113*a* and 113*b*. Further, a configuration that controls the temperature of the cooling liquid 102 by feeding back the temperature of the cooling liquid detected by the temperature detecting unit 157 and controlling the air quantity of the cooling fan 153 is also possible.

Next, a case of detecting the temperature near the surface of the cooling roller 110 to control the flow quantity of the cooling liquid 102 will be described.

Figure 41:
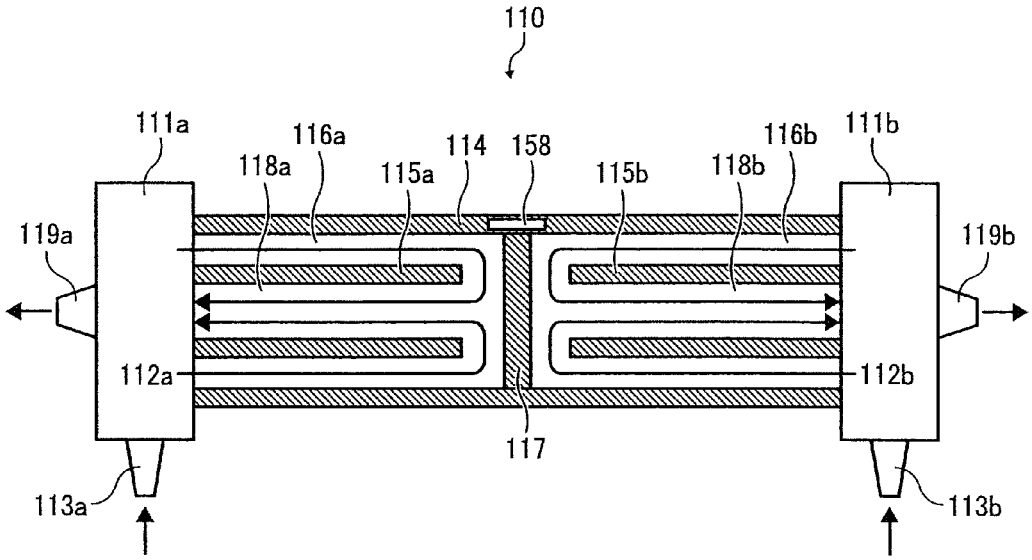
FIG. 41 is a view illustrating a schematic configuration of a cooling roller in which a temperature detecting unit for detecting a temperature near a surface of the cooling roller is disposed inside an outer tube.

FIG. 41 illustrates an example in which a temperature detecting unit 158 that detects the temperature near the surface of the cooling roller 110 is disposed inside the outer tube 114 of the cooling roller 110. The temperature near the surface of the cooling roller 110 detected by the temperature detecting unit 158 is feedback controlled. The flow quantity of the cooling liquid is adjusted, for example, by adjusting the feed liquid quantity of the pump 100 or the flow quantity adjusting valves 156*a* and 156*b* illustrated in FIG. 38 so that the cooling liquid flowing through the passage 112*a* of the cooling roller 110 can have the same temperature as the cooling liquid flowing through the passage 112*b*. Further, the temperature of the cooling liquid is controlled by feeding back the temperature near the surface of the cooling roller 110 detected by the temperature detecting unit 158 and, for example, controlling the air quantity of the cooling fan 153 of FIG. 38.

As described above, according to the present embodiment, the cooling device 18 includes the cooling roller 110 for contacting the paper P as the sheet-like member to cool down the paper P and the pump 100 that is a cooling medium feeding/retrieving unit for feeding the cooling liquid 102 as the cooling medium to the inside of the cooling roller 110 from the feed port disposed in the cooling roller 110 and retrieving the cooling liquid 101 drained to the outside of the cooling roller 110 from the drain port disposed in the cooling roller 110. The cooling roller 110 has a dual tube structure in which the inner tube 115 is disposed inside the outer tube 114, and the outside flow passage 116 in which the cooling liquid 102 flows through the space between the outer tube 114 and the inner tube 115 and the inside flow passage 118 in which the cooling liquids 102 flows inside the inner tube 115 are formed. An opening that allows the outside flow passage 116 and the inside flow passage 118 to communicate with each other is formed in the middle of the inner tube 115 in the longitudinal direction of the cooling roller 110. The passage 112*a* as a first passage in which the cooling liquid 102 fed by the pump 100 flows in the outside flow passage 116 to the inside flow passage 118 in a direction from one end to the other end of the cooling roller 110 and the passage 112*b* as a second passage in which the cooling liquid 102 fed by the pump 100 flows in the outside flow passage 116 to the inside flow passage 118 in a direction from the other end to one end of the cooling roller 110 are formed. According to this configuration, the passage in which the cooling liquid 102 flows is divided into two parts in the longitudinal direction of the cooling roller 110 to cool down the cooling roller 110. Therefore, compared to the configuration in which the cooling liquid 102 flows in one direction in the longitudinal direction of the cooling roller 110, the temperature increment of the cooling roller 110 can be further reduced. Further, the temperature difference in the longitudinal direction and the temperature difference between both ends of the cooling roller 10 can be reduced. Further, uniform image quality and gloss can be obtained in the width direction of the cooling roller 110. Moreover, the temperature control can be performed symmetrically in the longitudinal direction of the cooling roller 110, and thus the curl of the paper P can be reduced.

Further, according to the present embodiment, a configuration may be employed in which the opening is formed in a central portion of the inner tube 115 in the longitudinal direction of the cooling roller; at one end side of the cooling roller 110, a first feed port for feeding the cooling liquid 102 to the inside of the cooling roller 110 and a first drain port for draining the cooling liquid 102 from the inside of the cooling roller 110 to the outside of the cooling roller 110 are formed; at the other end side of the cooling roller 110, a second feed port for feeding the cooling liquid 102 to the inside of the cooling roller 110 and a second drain port for draining the cooling liquid 102 from the inside of the cooling roller 110 to the outside of the cooling roller 110 are formed; the cooling liquid 102 fed from the first feed port, in the passage 112*a*, flows through the outside flow passage 116, flows into the inside flow passage 118 through the opening, and is drained from at least one of the first drain port and the second drain port; and the cooling liquid 102 fed from the second feed port, in the passage 112*b*, flows through the outside flow passage 116, flows into the inside flow passage 118 through the opening, and is drained from at least one of the first drain port and the second drain port. Therefore, since the configuration of the cooling roller 110 is simplified, the cost of the cooling device 18 can be reduced.

Further, according to the present embodiment, a configuration may be employed in which the opening is formed in a central portion of the inner tube 115 in the longitudinal direction of the cooling roller; at one end side of the cooling roller 110, a first feed port for feeding the cooling liquid 102 to the inside of the cooling roller 110 is formed; at the other end side of the cooling roller 110, a second feed port for feeding the cooling liquid 102 to the inside of the cooling roller 110 is formed; a drain port for draining the cooling liquid 102 from the inside of the cooling roller 110 to the outside of the cooling roller 110 is formed at any of one end side and the other end side of the cooling roller 110; the cooling liquid 102 fed from the first feed port, in the passage 112*a*, flows through the outside flow passage 116, flows into the inside flow passage 118 through the opening, and is drained from the drain port; and the cooling liquid 102 fed from the second feed port, in the passage 112*b*, flows through the outside flow passage 116, flows into the inside flow passage 118 through the opening, and is drained from the drain port. Therefore, since one common port is formed as the drain port of the cooling liquid 102 flowing through the passage 112*a* and the passage 112*b*, the configuration of the cooling roller 110 is simplified, thereby reducing the cost of the cooling device 18. Further, it is possible to facilitate routing of the liquid feed tube 155 that connects the drain port with the pump 100.

Further, according to the present embodiment, a configuration may be employed in which the flow passage wall 117 that is a partition for dividing the inside of the cooling roller 110 into two parts at the middle in the longitudinal direction of the cooling roller is disposed; at one end side of the cooling roller 110, a first feed port for feeding the cooling liquid 102 to the inside of the cooling roller 110 and a first drain port for draining the cooling liquid 102 from the inside of the cooling roller 110 to the outside of the cooling roller 110 are formed;

at the other end side of the cooling roller 110, a second feed port for feeding the cooling liquid 102 to the inside of the cooling roller 110 and a second drain port for draining the cooling liquid 102 from the inside of the cooling roller 110 to the outside of the cooling roller 110 are formed; the cooling liquid 102 fed from the first feed port, in the passage 112*a*, flows through the outside flow passage 116, is returned by the flow passage wall 117, flows into the inside flow passage 118 inside the inner tube 115 located at the one end side of the flow passage wall 117, and is drained from the first drain port; and the cooling liquid 102 fed from the second feed port, in the passage 112*b*, flows through the outside flow passage 116, is returned by the flow passage wall 117, flows into the inside flow passage 118 inside the inner tube 115 located at the other end side of the flow passage wall 117, and is drained from the second drain port. Therefore, since the configuration of the cooling roller 110 is simplified, the cost of the cooling device 18 can be reduced.

Further, according to the present embodiment, positions where the cooling liquids 102 are returned by the flow passage wall 117 in the middle of the passage 112*a* and the passage 112*b* in the longitudinal direction of the cooling roller 110 may be stepwise or continuously changed depending on a position along the circumferential direction of the cooling roller 110. According to this configuration, it is possible to eliminate a spot in which the cooling liquid does not flow in the outside flow passage 116 over all circumferences of the cooling roller 110 and over the longitudinal direction of the cooling roller 110 in an area of the cooling roller 110 at which the paper P is transported, and thus it is possible to eliminate a spot that can not be locally cooled down.

Further, according to the present embodiment, the rotating tube joint unit 111 that is a support unit for rotatably supporting the outer tube 114 and fixedly supporting the inner tube 115 may be disposed at each end of the cooling roller 110. According to this configuration, the turbulence is generated in the flow (the flow in the longitudinal direction and the rotation direction) of the cooling liquid 102 inside the outside flow passage 116 near the outer tube 114, and thus the cooling efficiency can be increased.

Further, according to the present embodiment, the rotating tube joint unit 111 that is a support unit for rotatably supporting the outer tube 114 and the inner tube 115 may be disposed at each end of the cooling roller 110. According to this configuration, the flow (the flow in the rotation direction and the axial direction) of the cooling liquid 102 inside the outside flow passage 116 becomes smooth, and thus the cooling efficiency can be increased.

Further, according to the present embodiment, the flow passage auxiliary wall 122, 123, or 124 that is a guide wall for guiding the cooling liquid 102 from the outside flow passage 116 to the inside flow passage 118 through the opening may be disposed near the opening. According to this configuration, the cooling liquids 102 flowing in through the two different outside flow passages 116 are not directly joined, and the flow is smoothly guided in a direction from the outside flow passage 116 to the inside flow passage 118. Therefore, it is possible to prevent the cooling efficiency from being lowered.

Further, according to the present embodiment, a plurality of opening may be formed at different positions in the longitudinal direction of the inner tube 115. According to this configuration, due to the positions in the longitudinal direction of the cooling roller 110 where the openings are formed, positions in which the cooling liquids 102 flowing in from the outside flow passage 116 through the two different outside flow passages 116 collide with each other are changed depending on a position over the all circumferences of the cooling roller 110. Therefore, it is possible to prevent the cooling efficiency from being locally lowered.

Further, according to the present embodiment, a configuration may be employed in which a center of the width of the paper P in a direction orthogonal to the longitudinal direction of the cooling roller passes through near a position where the cooling liquid 102 flows into the inside flow passage 118 from the outside flow passage 116 in the passage 112*a* and a position where the cooling liquid 102 flows into the inside flow passage 118 from the outside flow passage 116 in the passage 112*b*. According to this configuration, the paper is transported so as to be centered so that the areas of the paper P passing at the two different outside flow passages 116 is equal, and thus it is possible to reduce curl, and image quality and gloss unevenness caused by fixing in the width direction of the paper P.

Further, according to the present embodiment, when the width of the paper P in a direction orthogonal to the longitudinal direction of the cooling roller 110 is smaller than the width of any one of the outside flow passage 116 of the passage 112*a* and the outside flow passage 116 of the passage 112*b* in the longitudinal direction of the cooling roller 110, the paper P may be transported on the passage 112*a* or the passage 112*b* that has the width, in the longitudinal direction of the cooling roller, larger than the width of the paper P and the cooling liquid 102 may be flowed only in the passage at a side in which the paper P is transported. According to this configuration, the paper P is cooled down by passing the cooling liquid to one of the passage 112*a* and the passage 112*b*, the energy can be saved.

Further, according to the present embodiment, feeding the cooling liquid 102 flowing to the passage 112*a* and the passage 112*b* may be performed by one liquid feed unit. According to this configuration, since the cooling liquid 102 flows to the passage 112*a* and the passage 112*b* by one liquid feed unit, the size of the cooling device can be reduced, and the cost can be reduced. Further, the passage 112*a* and the passage 112*b* may have the same configuration. Thereby, the temperature and the temperature gradient of the cooling roller 110 can become equal left and right in the longitudinal direction of the cooling roller 110.

Further, according to the present embodiment, the cooling liquid 102 flowing in the passage 112*a* and the cooling liquid 102 flowing in the passage 112*b* may be fed by different liquid feed units. According to this configuration, it is possible to independently control the flow quantity of the passage 112*a* and the quantity of the flow flowing in the passage 112*b*. Further, a liquid feed unit that is low in liquid feed performance, and thus is small in size, and/or low in cost can be used.

Further, according to the present embodiment, the flow quantity adjusting valve 156 may be disposed as the flow quantity adjusting unit for adjusting the flow quantity of the cooling liquid 102 flowing in the passage 112*a* and the passage 112*b*, and the flow quantity of the cooling liquid 1 flowing in the passage 112*a* and the flow quantity of the cooling liquid 102 flowing in the passage 112*b* may be equaled by the flow quantity adjusting valve 156. According to this configuration, control can be performed so that the temperature gradient is symmetrical about a boundary between the passage 112*a* and the passage 112*b* in the longitudinal direction of the cooling roller 110. Further, it is possible to reduce curl, and image quality and gloss unevenness caused by fixing in the width direction of the paper P.

Further, according to the present embodiment, a configuration may be employed in which the flow quantity adjusting valve 156 that is the flow quantity adjusting unit for adjusting the flow quantity of the cooling liquid 102 flowing in the passage 112*a* and the passage 112*b* and the temperature detecting unit 157 for detecting the temperature of the cooling liquid 102 flowing in the passage 112*a* and the passage 112*b* are disposed; and based on the temperature of the cooling liquid 102 detected by the temperature detecting unit 157, the flow quantity of the cooling liquid 102 flowing in the passage 112*a* and the flow quantity of the cooling liquid 102 flowing in the passage 112*b* are adjusted by the flow quantity adjusting valve 156 so that the passage 112*a* and the passage 112*b* have the same cooling efficiency. According to this configuration, control is performed so that the temperature and the temperature gradient of the cooling roller 110 are equal right and left in the longitudinal direction of the cooling roller 110, and thus it is possible to reduce curl, and image quality and gloss unevenness caused by fixing in the width direction of the paper P.

Further, according to the present embodiment, a configuration may be employed in which the radiator 154 that is the heat radiating unit for radiating heat of the cooling liquid 102 to the outside, the cooling fan 153 for blowing air to the radiator 154, the air quantity control unit for controlling the air quantity of the cooling fan 153, and the temperature detecting unit 157 for detecting the temperature of the cooling liquid flowing in the passage 112*a* and the passage 112*b* are disposed; and based on the temperature of the cooling liquid 102 detected by the temperature detecting unit 157, the air quantity of the cooling fan 153 is controlled by the air quantity control unit so that the cooling liquid 102 flowing in the passage 112*a* has the same temperature as the cooling liquid 102 flowing in the passage 112*b*. According to this configuration, control is performed so that the temperature and the temperature gradient of the cooling roller 110 are equal right and left in the longitudinal direction of the cooling roller 110, and thus it is possible to reduce curl, and image quality and gloss unevenness caused by fixing in the width direction of the paper P.

Further, according to the present embodiment, a configuration may be employed in which the flow quantity adjusting valve 156 that is the flow quantity adjusting unit for adjusting the flow quantity of the cooling liquid 102 flowing in the passage 112*a* and the passage 112*b* and the temperature detecting unit 158 for detecting the temperature near the surface of the cooling roller 110 on the passage 112*a* and the passage 112*b* are disposed; and based on the temperature, near the surface of the cooling roller 110, detected by the temperature detecting unit 158, the flow quantity of the cooling liquid 102 flowing in the passage 112*a* and the flow quantity of the cooling liquid 102 flowing in the passage 112*b* are adjusted by the flow quantity adjusting valve 156 so that the temperature near the surface of the cooling roller 110 on the passage 112*a* is equal to the temperature near the surface of the cooling roller 110 on the passage 112*b*. According to this configuration, since control is performed so that the temperature and the temperature gradient of the cooling roller 110 is equal right and left in the longitudinal direction of the cooling roller 110, it is possible to reduce curl, and image quality and gloss unevenness caused by fixing in the width direction of the paper P.

Further, according to the present embodiment, a configuration may be employed in which the radiator 154 that is the heat radiating unit for radiating heat of the cooling liquid 102 to the outside, the cooling fan 153 for blowing air to the radiator 154, the air quantity control unit for controlling the air quantity of the cooling fan 153, and the temperature detecting unit 158 for detecting the temperature near the surface of the cooling roller 110 on the passage 112*a* and the passage 112*b* are disposed; and based on the temperature, near the surface of the cooling roller 110, detected by the temperature detecting unit 158, the air quantity of the cooling fan 153 is controlled by the air quantity control unit so that the temperature near the surface of the cooling roller 110 on the passage 112*a* is equal to the temperature near the surface of the cooling roller 110 on the passage 112*b*. According to this configuration, since control is performed so that the temperature and the temperature gradient of the cooling roller 110 is equal right and left in the longitudinal direction of the cooling roller 110, it is possible to reduce curl, and image quality and gloss unevenness caused by fixing in the width direction of the paper P.

Further, according to the present embodiment, in the image forming device that includes the toner image forming unit for forming the toner image on the paper P, the heat fixing unit 16 for fixing the toner image, formed on the paper P, on the paper P by at least heat, and the cooling unit for cooling down the paper P on which the toner image is fixed by the heat fixing unit 16, the cooling device 18 of the present invention is used as the cooling unit. Thereby, it is possible to reduce curl, and image quality and gloss unevenness caused by fixing in the width direction of the paper P.

Third Embodiment

Next, a cooling device according to a third embodiment will be described with reference to FIGS. 42 to 55. Here, configuration examples of a cooling roller 110 different from the cooling roller 22 of the cooling device 18 according to the first embodiment described above will be described. The cooling device illustrated in FIG. 2 is used as an overall configuration of the cooling device, and duplicated description will be omitted. Further, a configuration example of an image forming device in which the cooing device according to the present embodiment is mounted is the same as that in FIG. 22, and thus duplicated description is omitted in the present embodiment.

Configuration Example 1

A cooling roller 110 of a configuration example 1 according to a third embodiment is different in flow direction of a cooling medium from that of FIG. 23 according to the second embodiment but is similar in configuration. Therefore, duplicated description will be omitted.

Figure 42:
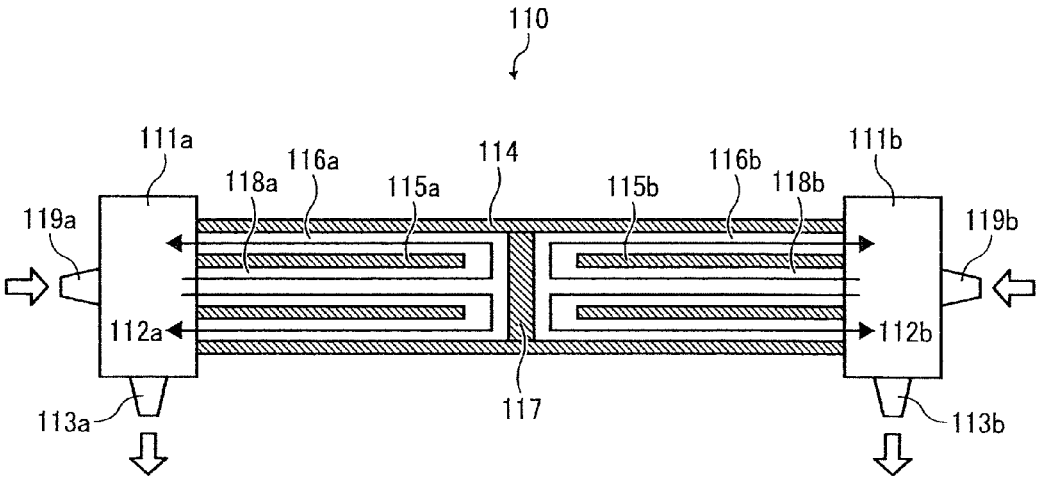
FIG. 42 is a cross-sectional view illustrating a schematic configuration of a cooling roller of a configuration example 1 according to the third embodiment.

In FIG. 42, the cooling liquid is fed from the feed port 119*a* of the first rotating joint unit 111*a* to the cooling roller 110, passes through the inside flow passage 118*a* (the return flow passage) inside the inner tube 115*a*, is returned by the flow passage wall 117, which separates the flow passage 112*a* and the flow passage 112*b*, present in the middle in the longitudinal direction of the cooling roller 110, passes through the outside flow passage 116*a* (the forward flow passage) that is a space between the outer tube 114 and the inner tube 115*a*, and is drained from the drain port 113*a* of the first rotating tube joint unit 111*a*.

Similarly, the cooling liquid is fed from the feed port 119*b* of the second rotating joint unit 111*b* to the cooling roller 110, passes through the inside flow passage 118*b* (the return flow passage) inside the inner tube 115*b*, is returned by the flow passage wall 117, which separates the flow passage 112*a* and the flow passage 112*b*, present in the middle in the longitudinal direction of the cooling roller 110, passes through the outside flow passage 116*b* (the forward flow passage) that is a space between the outer tube 114 and the inner tube 115*b*, and is drained from the drain port 113*b* of the second rotating tube joint unit 111*b*.

As described above, the cooling roller 110 has the two independent flow passages 112*a* and 112*b* in which reciprocating circulation is performed. The cooling roller 110 has the cooling area divided in the longitudinal direction of the cooling roller 110 and forms the closed-loop flow passage together with the cooling liquid circulating unit which will be described later and is illustrated in FIGS. 52, 53, and 54 through the rotating tube joint unit 111*a* and 111*b* to circulate the cooling liquid.

Figure 52:
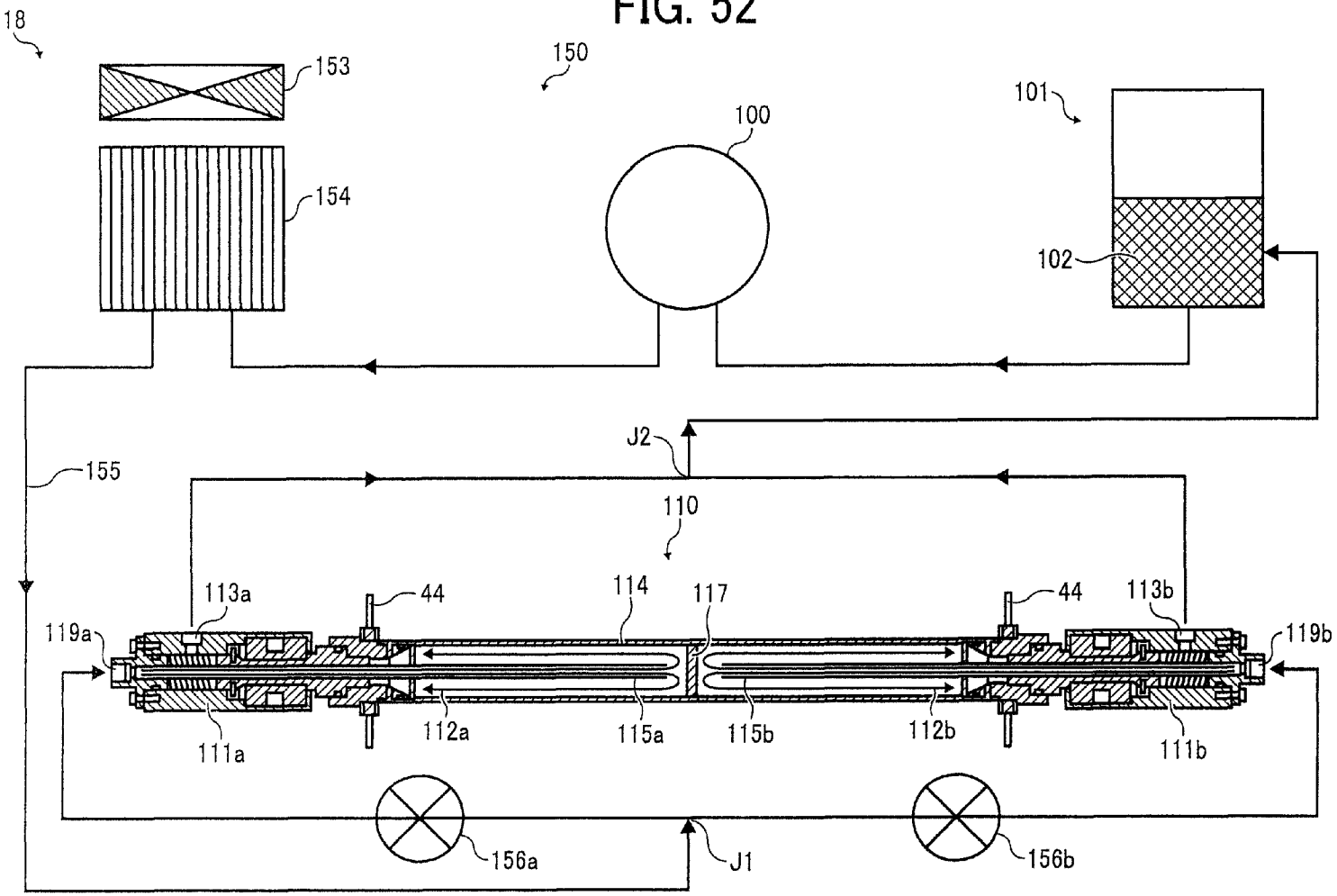
FIG. 52 is a view illustrating a cooling circulation device in which a cooling liquid is fed through one feed unit.
Figure 53:
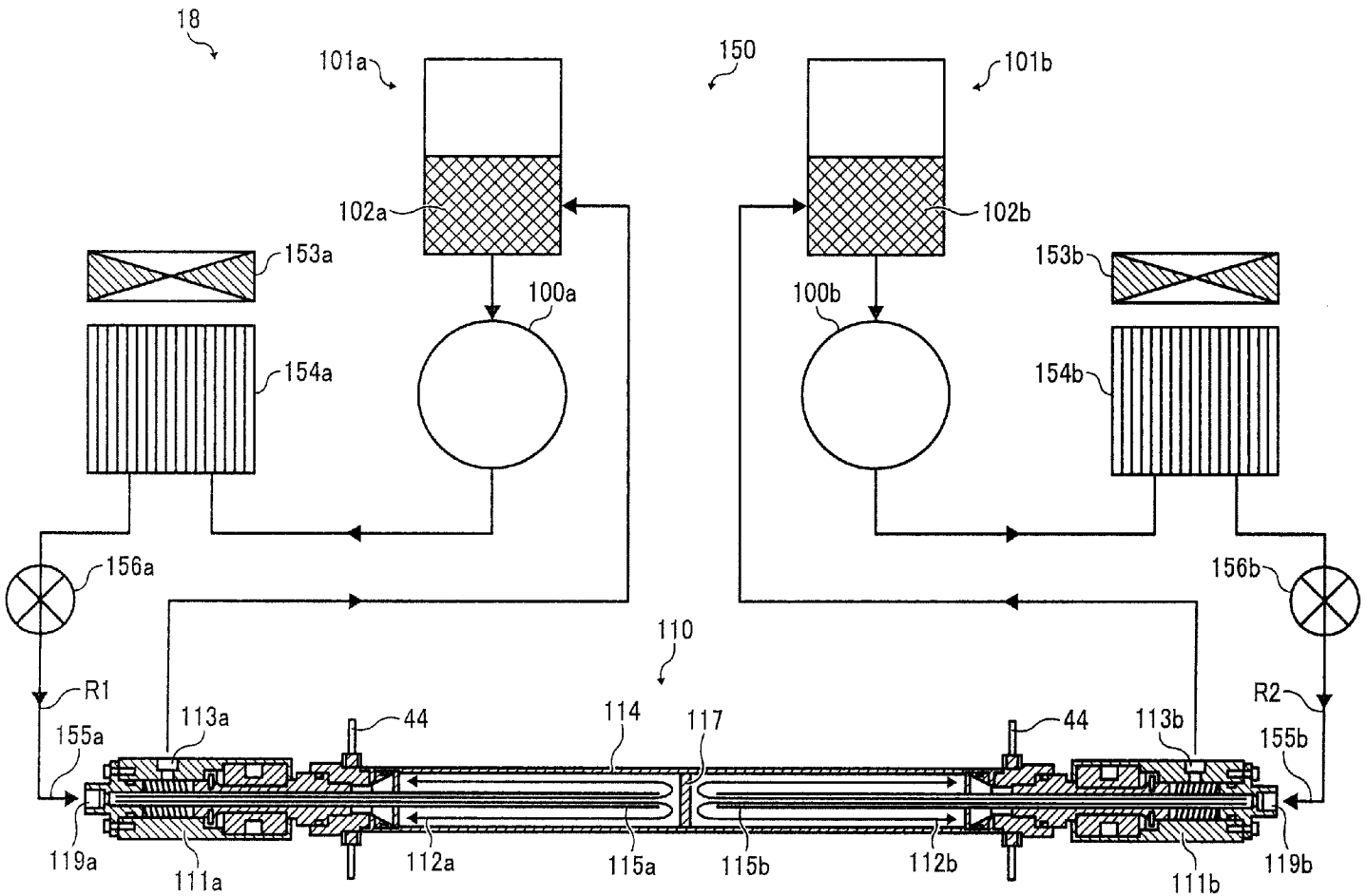
FIG. 53 is a view illustrating a cooling circulation device in which a cooling liquid is fed through two feed units.
Figure 54:
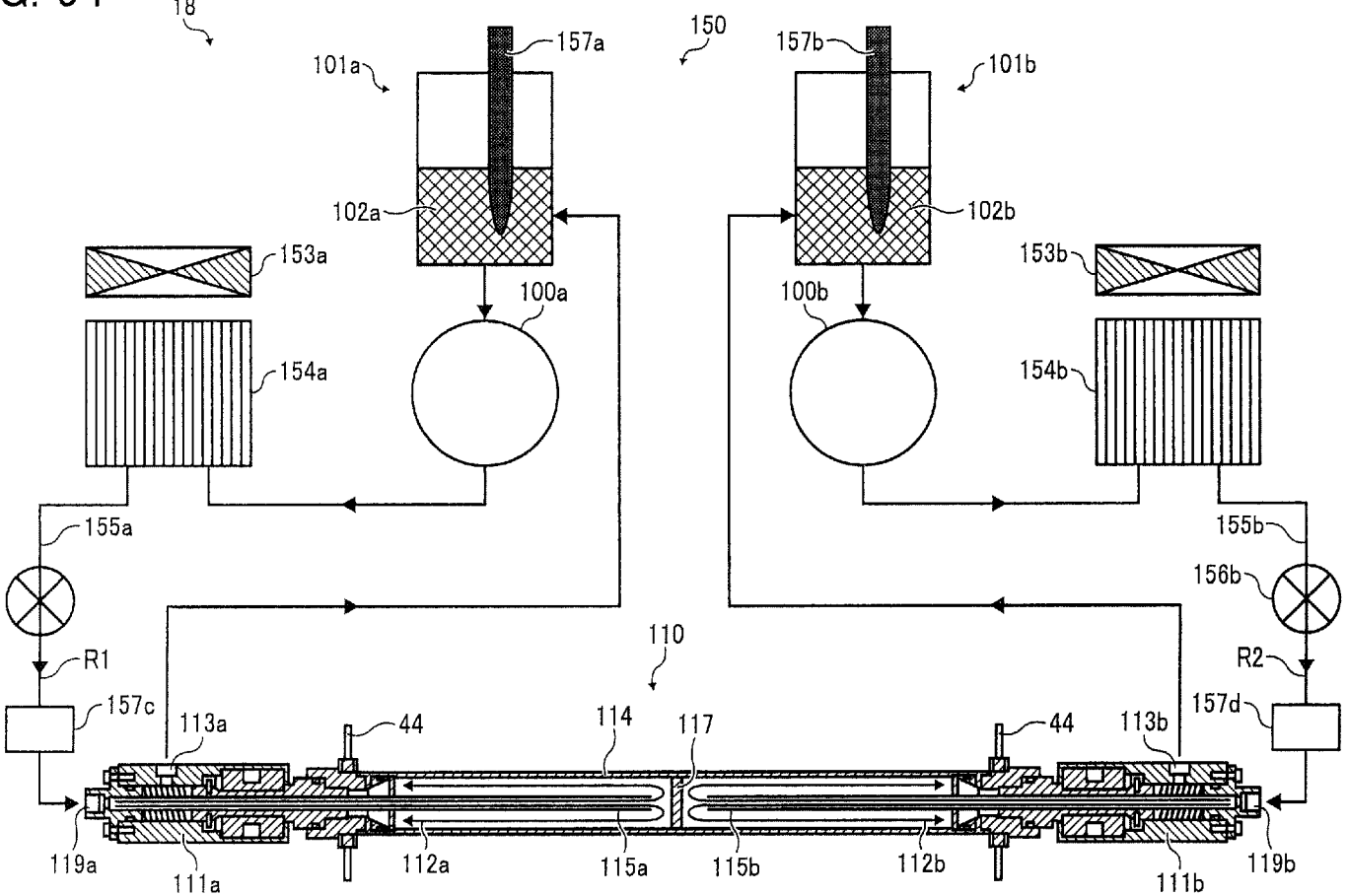
FIG. 54 is a view illustrating a cooling circulation device in which a temperature detecting unit for detecting a temperature of a cooling liquid is disposed inside a tank.

The cooling liquid cooled down by the cooling liquid circulating unit which will be described later and is illustrated in FIGS. 52, 53, and 54 is fed from the feed port 119*a* of the first rotating tube joint unit 111*a* to the cooling roller 110 according to the configuration example 1 illustrated in FIG. 42, passes through the inside flow passage 118*a* (the forward flow passage) inside the inner tube 115*a*, is returned by the flow passage wall 117, which separates the passage 112*a* and the passage 112*b*, present in the middle in the longitudinal direction of the cooling roller 110, passes through the outside flow passage 116*a* (the first return flow passage) that is the space between the outer tube 114 and the inner tube 115*a*, and is drained from the drain port 113*a* of the first rotating tube joint unit 111*a*. At this time, the outer tube 114 at the left side of the flow passage wall 117 is cooled down by the cooling liquid flowing through the outside flow passage 116*a*.

Figure 55:
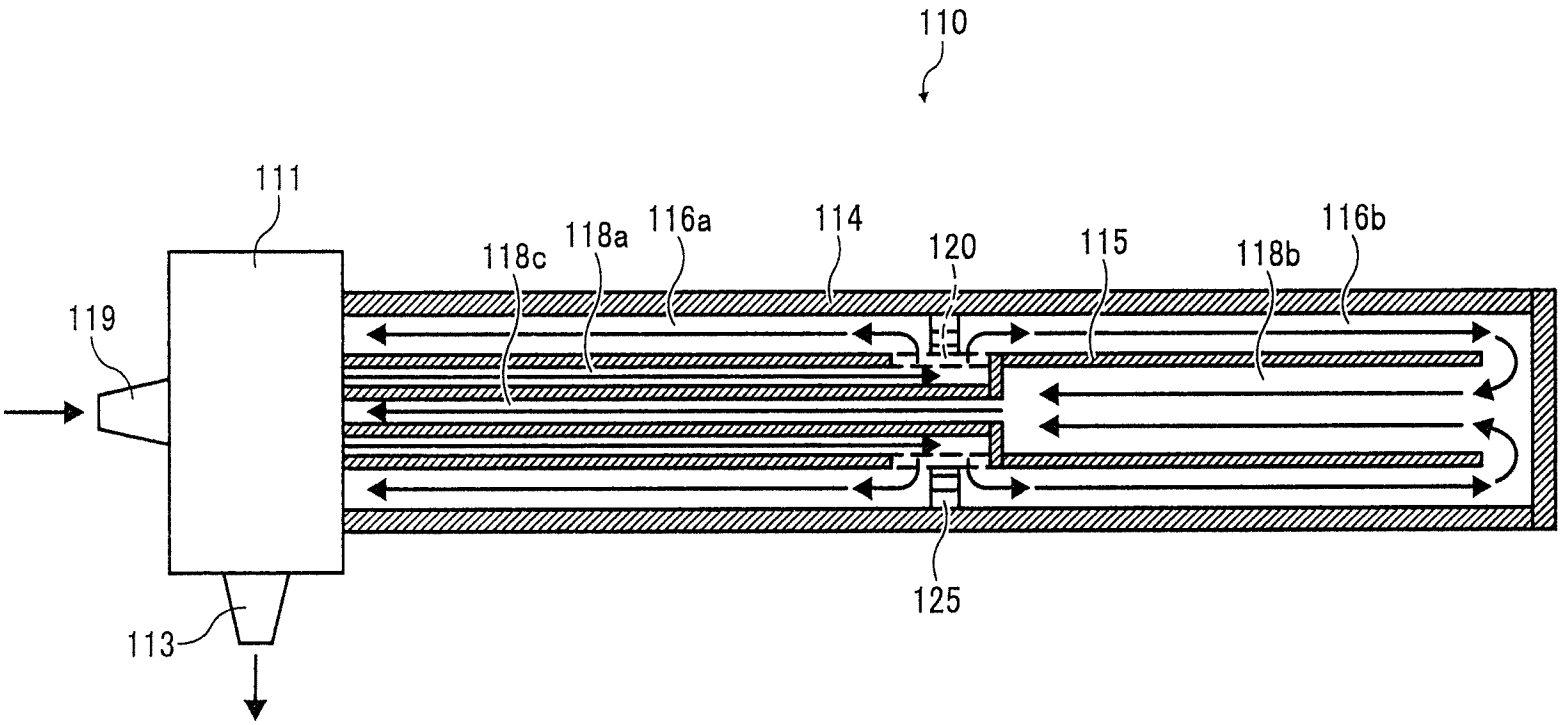
FIG. 55 is a cross-sectional view illustrating a schematic configuration of a cooling roller in which a rotating tube joint unit is mounted only to one end side.

Similarly, the cooling liquid cooled down by the cooling liquid circulating unit which will be described later and is illustrated in FIGS. 53, 54, and 55 is fed from the feed port 119*b* of the second rotating tube joint unit 111*b* to the cooling roller 110, passes through the inside flow passage 118*b* (the forward flow passage) inside the inner tube 115*b*, is returned by the flow passage wall 117, which separates the passage 112*a* and the passage 112*b*, present in the middle in the longitudinal direction of the cooling roller 110, passes through the outside flow passage 116*b* (the second return flow passage) that is the space between the outer tube 114 and the inner tube 115*b*, and is drained from the drain port 113*b* of the second rotating tube joint unit 111*b*. At this time, the outer tube 114 at the right side of the flow passage wall 117 is cooled down by the cooling liquid flowing through the outside flow passage 116*b*.

Here, at a position where the cooling liquid is returned by the flow passage wall 117 and so flows from the inside flow passage 118*a* or 118*b* to the outside flow passage 116*a* or 116*b*, the temperature of the cooling liquid is low. However, since the paper P heated while passing through the heat fixing unit 16 illustrated in FIG. 1 passes through the surface of the cooling roller 110 while closely contacting the surface of the cooling roller 110, the temperature of the cooling liquid is more raised as it is closer to the first rotating tube joint unit 111*a* side of the outside flow passage 116*a* and the second rotating tub joint unit 111*b* side of the outside flow passage 116*b*. Therefore, the surface temperature of the cooling roller 110 (the outer tube 114) is lowest at the flow passage wall 117 side of FIG. 42 and highest at the first rotating tube joint unit 111*a* side and the second rotating tube joint unit 111*b* side.

Therefore, the cooling efficiency is highest near the flow passage wall 117 and lowest at the first rotating tube joint unit 111*a* side and the second rotating tube joint unit 111*b* side in FIG. 42. The temperature gradient is symmetrical with respect to the flow passage wall 117 of the cooling roller 110 as the boundary, and it is possible to reduce the temperature difference in the width direction of the cooling roller 110.

Since it is divided into the passage 112*a* (the first return flow passage) and the passage 112*b* (the second return flow passage) by the flow passage wall 117 as the boundary, the outside flow passage 116*a* and the outside flow passage 116*b* absorb heat of the paper P by half. Therefore, it is possible to decrease the temperature increment of the cooling liquid. As a result, the cooling efficiency is increased, and the cooling efficiency difference in the longitudinal direction of the cooling roller 110 is decreased.

Further, since it is possible to efficiently cool down an image central portion of a paper that is generally high in printing rate, it is possible to further prevent the blocking phenomenon of the paper central portion in which heat is likely to be accumulated when the paper is stacked after discharged.

Flow passage auxiliary walls 123*a* and 123*b* described above in FIG. 25 may be formed in the cooling roller 110 illustrated in FIG. 42 so that the cooling liquid can easily flow from the inside flow passage 118 to the outside flow passage 116.

In the cooling roller 110 illustrated in FIG. 42, the cooling liquid flowing in through the inside flow passage 118 collides against the flow passage wall 117 and thus is difficult to flow into the outside flow passage 116, and opposite flow may be generated near the flow passage wall 117. For this reason, the flow passage auxiliary walls 123*a* and 123*b*, illustrated in FIG. 25, having an angle for guiding the cooling liquid to flow in a direction from the inside flow passage 118 to the outside flow passage 116 are formed in the flow passage wall 117. Due to the same reason, even though not shown, the flow passage wall 117 may have a shape with a curvature. Since the flow passage auxiliary walls 123*a* and 123*b* are formed in the flow passage wall 117, the flow of the cooling liquid from the inside flow passage 118 to the outside flow passage 116 becomes smooth, thereby increasing the cooling efficiency.

Configuration Example 2

Figure 43A:
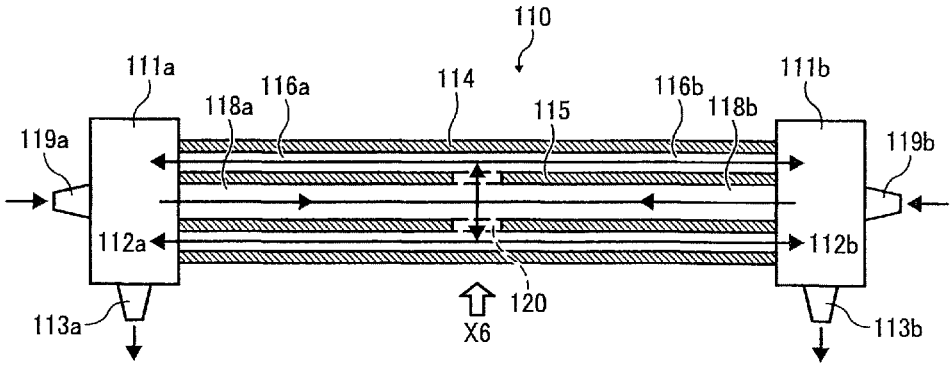
FIG. 43A is a cross-sectional view illustrating a schematic configuration of a cooling roller of a configuration example 2 according to the third embodiment.
Figure 43B:
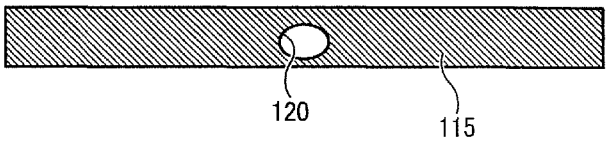
FIG. 43B is an enlarged cross-sectional view illustrating an inner tube of the cooling roller of the configuration example 2.

Next, a cooling roller 110 according to a configuration example 2 is illustrated in FIGS. 43A and 43B. FIG. 43A is a schematic cross-sectional view of a cooling roller 110 having a structure in which the rotating tube joint unit 111 are mounted to both axial direction ends of the cooling roller 110, and the flow passage 112*a* and the flow passage 112*b* are communicated with each other through the flow port 120. FIG. 43B is an enlarged view of the inner tube 115 when the cooling roller 110 illustrated in FIG. 43A is viewed in a direction of an arrow X6 in the drawing.

In FIGS. 43A and 43B, the cooling liquid is fed from the feed port 119*a* of the first rotating joint unit 111*a* to the inside of the cooling roller 110, passes through the inside flow passage 118*a* (the forward flow passage) inside the inner tube 115, passes through the outside flow passage 116*a* (the return flow passage) or the outside flow passage 116*b* (the return flow passage) that is the space between the outer tube 114 and the inner tube 115, passes through the flow port 120 present in the middle in the longitudinal direction of the cooling roller 110, and is drained from the drain port 113*a* of the first rotating tube joint unit 111*a* or the drain port 113*b* of the second rotating tube joint unit 111*b*.

Similarly, the cooling liquid is fed from the feed port 119*b* of the first rotating joint unit 111*b* to the inside of the cooling roller 110, passes through the inside flow passage 118*b* (the forward flow passage) inside the inner tube 115, passes through the outside flow passage 116*a* (the return flow passage) or the outside flow passage 116*b* (the return flow passage) that is the space between the outer tube 114 and the inner tube 115, passes through the flow port 120 present in the middle in the longitudinal direction of the cooling roller 110, and is drained from the drain port 113*a* of the first rotating tube joint unit 111*a* or the drain port 113*b* of the second rotating tube joint unit 111*b*.

As described above, the cooling roller 110 has the two flow passages 112*a* and 112*b* in which the cooling liquid flows through the flow port 120. The cooling roller 110 has the cooling area divided in the longitudinal direction of the cooling roller 110 and forms the closed-loop flow passage together with the cooling liquid circulating unit which will be described later through the first rotating tube joint unit 111*a* and the second rotating tube joint unit 111*b* to circulate the cooling liquid. Since the inner tube 115 is formed with such a simplified shape, the cost can be reduced.

Depending on the difference in the returning, joining and diverging structure of the flow passage wall 117 and the flow port 120, the flow method of the cooling liquid may be slightly different, but almost the same cooling effect as the cooling roller 110 of the configuration example 1 is obtained.

Configuration Example 3

Figure 44A:
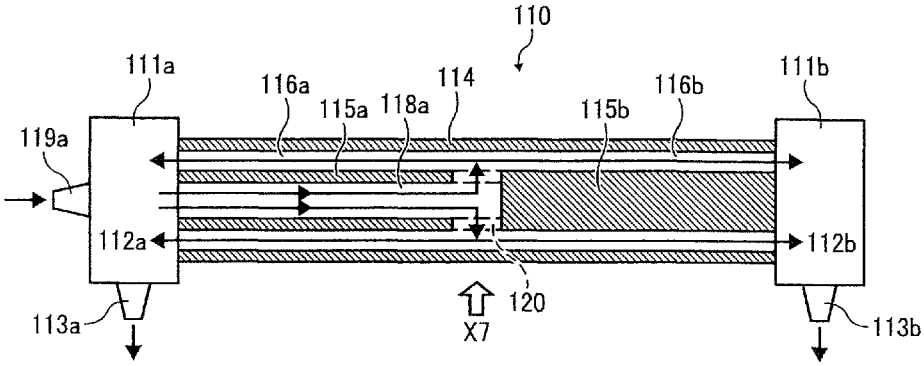
FIG. 44A is a cross-sectional view illustrating a schematic configuration of a cooling roller of a configuration example 3 according to the third embodiment.
Figure 44B:
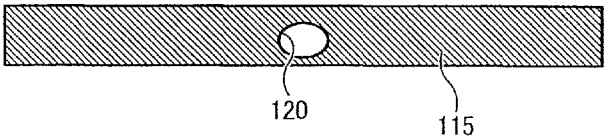
FIG. 44B is an enlarged cross-sectional view illustrating an inner tube of the cooling roller of the configuration example 3.

Next, a cooling roller 110 according to a configuration example 3 is illustrated in FIGS. 44A and 44B. FIG. 44A is a schematic cross-sectional view of a cooling roller 110 having a structure in which the rotating tube joint unit 111 are mounted to both axial direction ends of the cooling roller 110, the flow passage 112*a* and the flow passage 112*b* are communicated with each other through the flow port 120, and the inside flow passage 118 inside the inner tube 115 and the feed port 119 are formed only at any one side of the first rotating tube joint unit 111*a* side and the second rotating tube joint unit 111*b* side. FIG. 44B is an enlarged view of the inner tube 115 when the cooling roller 110 illustrated in FIG. 44A is viewed in a direction of an arrow X7 in the drawing.

In FIGS. 44A and 44B, the cooling liquid is fed from the feed port 119*a* of the first rotating joint unit 111*a* to the inside of the cooling roller 110, passes through the inside flow passage 118*a* (the return flow passage) inside the inner tube 115, passes through the outside flow passage 116*a* (the forward flow passage) or the outside flow passage 116*b* that is the space between an outer tube 114 and an inner tube 115 via the flow port 120 present in the middle in the longitudinal direction of the cooling roller 110, and is drained from the drain port 113*a* of the first rotating tube joint unit 111*a* or the drain port 113*b* of the second rotating tube joint unit 111*b*.

As described above, the cooling roller 110 has the flow passage 112*a* and the passage 112*b* in which the cooling liquid flows through the flow port 120. The cooling roller 110 has the cooling area divided by the outside flow passage 116*a* and the outside flow passage 116*b* in the longitudinal direction of the cooling roller 110 and forms the closed-loop flow passage together with the cooling liquid circulating unit which will be described later through the first rotating tube joint unit 111*a* and the second rotating tube joint unit 111*b* to circulate the cooling liquid.

Further, the feed port 119 is formed at any one side of the first rotating tube joint unit 111*a* side and the second rotating tube joint unit 111*b* side, and thus it is possible to facilitate routing of a liquid feed tube 155 (see FIG. 53) of the cooling device 18 which will be described later.

Depending on the difference in the returning and diverging structure of the flow passage wall 117 and the flow port 120, the flow method of the cooling liquid may be slightly different, but almost the same cooling effect as the cooling rollers 110 of the configuration example 1 and the configuration example 2 is obtained.

Further, as illustrated in FIG. 28, the flow passage auxiliary wall 124 that guides the cooling liquid flowing in from the inside flow passage 118*a* through the flow port 120 to the outside flow passage 116*a* or the outside flow passage 116*b* may be formed at an end of the inner tube 115*b* at the flow port 120 side. Therefore, it is possible to make the cooling liquid flowing in through the inside flow passage 118*a* to easily flow into the outside flow passage 116*a* or the outside flow passage 116*b* through the flow port 120.

Configuration Example 4

Figure 45A:
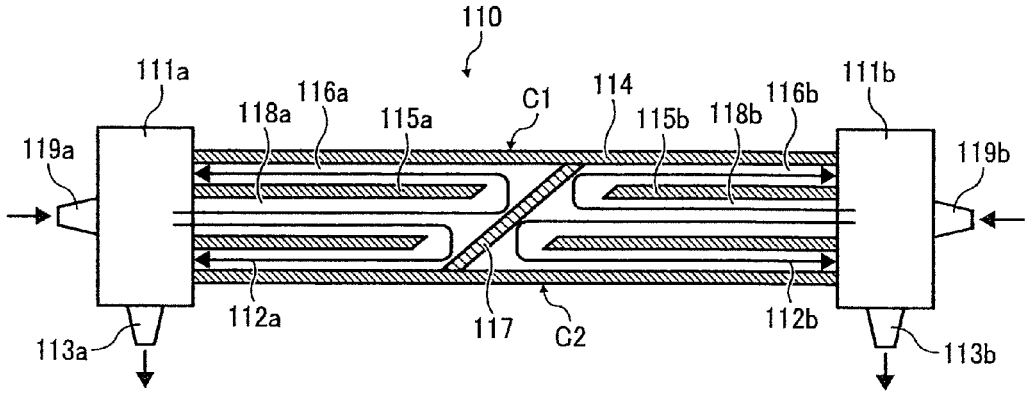
FIG. 45A is a cross-sectional view illustrating a schematic configuration of a cooling roller of a configuration example 4 according to the third embodiment.
Figure 45B:
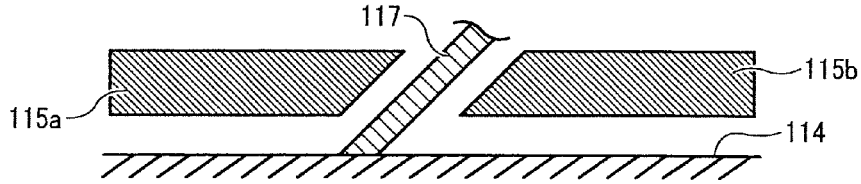
FIG. 45B is an enlarged cross-sectional view illustrating an inner tube of the cooling roller of the configuration example 4.

Next, a cooling roller 110 according to a configuration example 4 is illustrated in FIGS. 45A and 45B. FIG. 45A is a schematic cross-sectional view of a cooling roller 110 having a structure in which the rotating tube joint unit 111 are mounted to both axial direction ends of the cooling roller 110, the two independent passages 112 are formed, and return positions in the longitudinal direction of the cooling roller 110 are different in the circumferential direction. FIG. 45B is an enlarged view of the inner tube 115 when the cooling roller 110 illustrated in FIG. 45A is viewed from directly above the paper plane.

In FIG. 45A, the cooling liquid is fed from the feed port 119*a* of the first rotating tube joint unit 111*a* to the inside of the cooling roller 110, passes through the inside flow passage 118*a* (the forward flow passage) inside the inner tube 115*a*, is returned by the flow passage wall 117, which separates the passage 112*a* and the passage 112*b*, present in the middle in the longitudinal direction of the cooling roller 110, passes through the outside flow passage 116*a* (the return flow passage) that is the space between the outer tube 114 and the inner tube 115*a*, and is drained from the drain port 113*a* of the first rotating tube joint unit 111*a*.

Similarly, the cooling liquid is fed from the feed port 119*b* of the second rotating tube joint unit 111*a* to the inside of the cooling roller 110, passes through the inside flow passage 118*b* (the forward flow passage) inside the inner tube 115*b*, is returned by the flow passage wall 117, which separates the passage 112*a* and the passage 112*b*, present in the middle in the longitudinal direction of the cooling roller 110, passes through the outside flow passage 116*b* (the return flow passage) that is the space between the outer tube 114 and the inner tube 115*b*, and is drained from the drain port 113*b* of the second rotating tube joint unit 111*b*.

Here, in order to eliminate a spot that can not be cooled locally over one round in a circumferential direction since the cooling liquid is not passed to the outside flow passage 116, the flow passage wall 117 is disposed obliquely with respect to the longitudinal direction of the cooling roller 110. The inner tube 115*a* and the inner tube 115*b* have oblique cross sections so that the return positions can be different in the circumferential direction and disposed alternately in the longitudinal direction of the cooling roller 110.

Figure 46A:
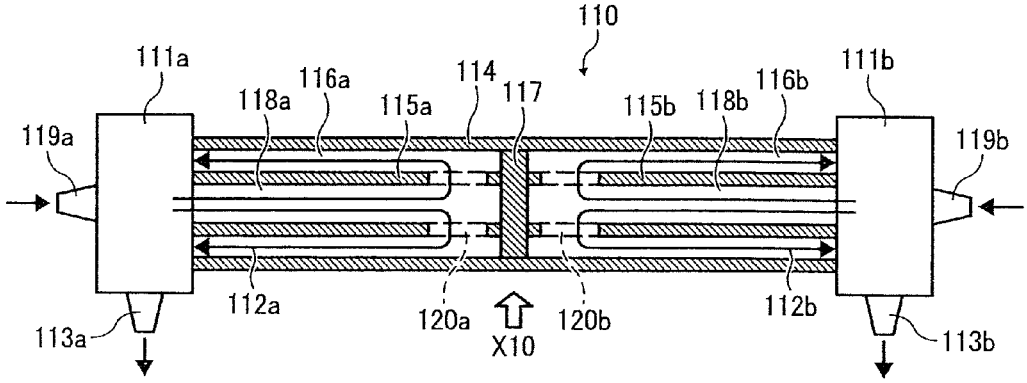
FIG. 46A is a cross-sectional view illustrating a schematic configuration of a cooling roller of a configuration example 5 according to the third embodiment.

In the present configuration example, at a circumferential direction position C1 of the cooling roller 110 illustrated in FIG. 46A, the cooling roller 110 is cooled down by the cooling liquid flowing through the outside flow passage 116*a* (the first return flow passage). As the cooling roller 110 rotates, at a circumferential direction position C2 of the cooling roller 110, the cooling roller 110 is cooled down by the cooling liquid flowing through the outside flow passage 116*b* (the second return flow passage). Therefore, since it is possible to eliminate a spot in which the cooling liquid is not circulated in the outside flow passages 116*a* and 116*b* over one round in the circumferential direction of the cooling roller 110 near a position where the cooling liquid is returned by the flow passage wall 117, it is possible to eliminate a spot where the cooling efficiency is locally lowered.

In the example illustrated in FIG. 45B, the inner tubes 115*a* and 115*b* have the oblique cross sections. However, the cross sections of the inner tubes 115*a* and 115*b* are not limited to the oblique structure but may have a structure in which the cooling liquid does not locally flow to the outside flow passage 116 over one round in the circumferential direction of the cooling roller 110 and does not disturb the flow of the cooling liquid.

As described above, the cooling roller 110 has the two independent flow passages 112*a* and 112*b* in which reciprocating circulation is performed. The cooling roller 110 has the cooling area divided in the longitudinal direction of the cooling roller 110 and forms the closed-loop flow passage together with the cooling liquid circulating unit which will be described later through the first rotating tube joint unit 111*a* and the second rotating tube joint unit 111*b* to circulate the cooling liquid.

Configuration Example 5

Figure 46B:
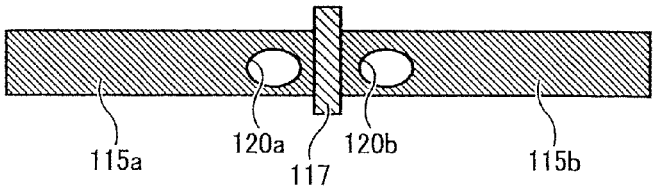
FIG. 46B is an enlarged cross-sectional view illustrating an inner tube of the cooling roller of the configuration example 5.

Next, a cooling roller 110 according to a configuration example 5 is illustrated in FIGS. 46A and 46B. FIG. 46A is a schematic cross-sectional view of a cooling roller 110 in which the rotating tube joint unit 111 are mounted to both axial direction ends of the cooling roller 110, and the two independent flow passages 112*a* and 112*b* are formed. FIG. 46B is an enlarged view of the inner tube 115 when the cooling roller 110 illustrated in FIG. 46A is viewed in a direction of an arrow X10 in the drawing.

The outer tube 114 rotates. One end side of the inner tube 115*a* is fixedly supported to the first rotating tube joint unit 111*a* not to rotate, and the other end side is rotatably supported to the flow passage wall 117 through a bearing (not shown). One end side of the inner tube 115*b* is fixedly supported to the second rotating tube joint unit 111*b* not to rotate, and the other end side is rotatably supported to the flow passage wall 117 through a bearing (not shown). The flow port 120*a* is formed in the inner tube 115*a* near the flow passage wall 117 to allow the cooling liquid to flow from the inside flow passage 118*a* to the outside flow passage 16*a*. The flow port 120*b* is formed in the inner tube 115*b* near the flow passage wall 117 to allow the cooling liquid to flow from the inside flow passage 118*b* to the outside flow passage 116*b*.

The cooling roller 110 having such a configuration generates the turbulence in the flow (the flow in the axial direction and the rotation direction) of the cooling liquid inside the outside flow passage 116, particularly, near the inside of the outer tube 114, thereby increasing the cooling efficiency.

Configuration Example 6

Figure 47A:
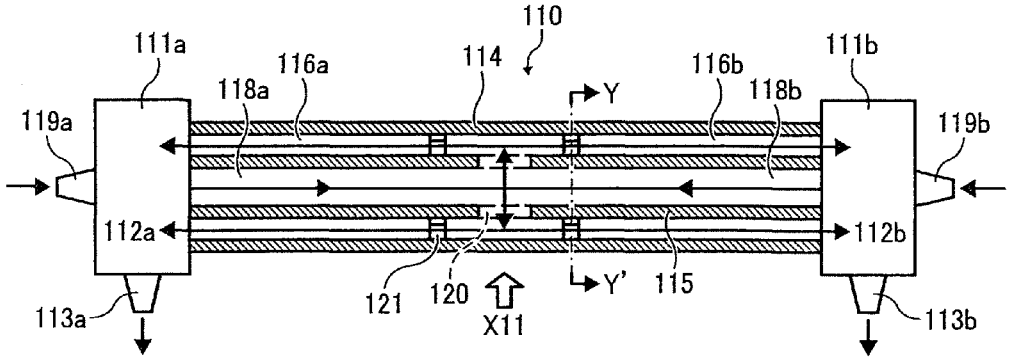
FIG. 47A is a cross-sectional view illustrating a schematic configuration of a cooling roller of a configuration example 6 according to the third embodiment.
Figure 47B:
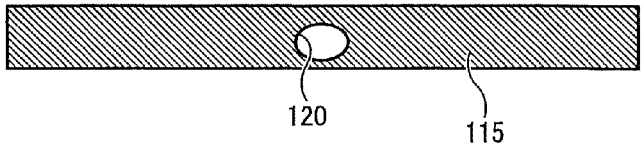
FIG. 47B is an enlarged cross-sectional view illustrating an inner tube of the cooling roller of the configuration example 6.

Next, a cooling roller 110 according to a configuration example 6 is illustrated in FIGS. 47A and 47B. FIG. 47A is a schematic cross-sectional view of a cooling roller 110 having a structure in which the rotating tube joint unit 111 are mounted to both axial direction ends of the cooling roller 110, and the two passages 112*a* and 112*b* are communicated with each other through the flow port 120. The outer tube 114 rotates, and both ends of the inner tube 115 are rotatably supported to the rotating tube joint unit 111. FIG. 47B is an enlarged view of the inner tube 115 when the cooling roller 110 illustrated in FIG. 47A is viewed in a direction of an arrow X11 in the drawing.

In the present configuration example, similarly to the embodiment illustrated in FIGS. 31A, 31B and 32, the outer tube 114 and the inner tube 115 are locally fixed by the coupling support unit 121. Therefore, the outer tube 114 and the inner tube 115 rotate together. Preferably, the coupling support unit 121 has a mechanical strength that can endure the load generated when the outer tube 114 and the inner tube 115 rotate together and has a structure that disturbs the flow of the cooling liquid flowing through the outside flow passage 116 as little as possible.

The cooling roller 110 having such a configuration makes smooth the flow (the flow in the axial direction and the rotation direction) of the cooling liquid inside the outside flow passage 116, thereby increasing the cooling efficiency.

Configuration Example 7

Figure 48A:
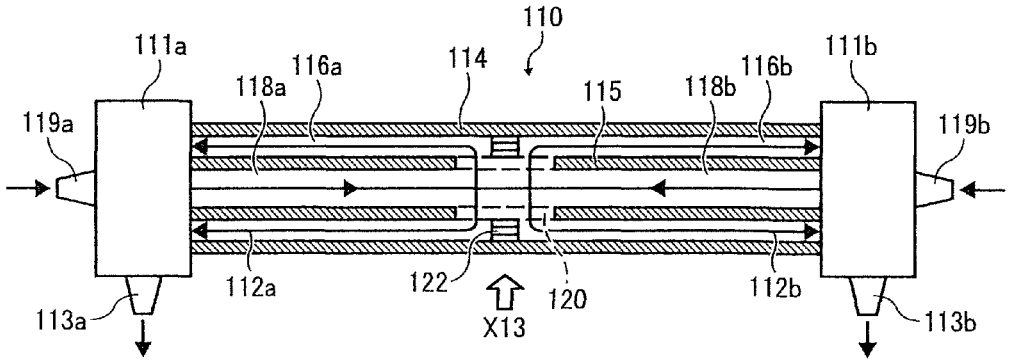
FIG. 48A is a cross-sectional view illustrating a schematic configuration of a cooling roller of a configuration example 7 according to the third embodiment.
Figure 48B:
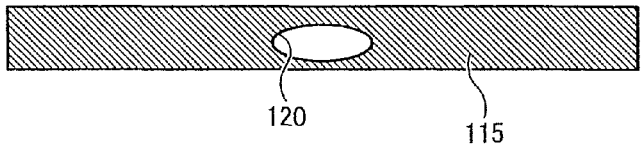
FIG. 48B is an enlarged cross-sectional view illustrating an inner tube of the cooling roller of the configuration example 7.

Next, a cooling roller 110 according to a configuration example 7 is illustrated in FIGS. 48A and 48B. FIG. 48A is a schematic cross-sectional view of a cooling roller 110 having a structure in which the rotating tube joint unit 111 are mounted to both axial direction ends of the cooling roller 110, and the two passages 112*a* and 112*b* are communicated with each other through the flow port 120. FIG. 48B is an enlarged view of the inner tube 115 when the cooling roller 110 illustrated in FIG. 48A is viewed in a direction of an arrow X13 in the drawing.

The flow passage auxiliary wall 122 is fixed to the inner wall of the outer tube 114 between a spot of the inner tube 115 where the flow port 120 is formed and the outer tube 114. The cooling liquids flowing in through the inside flow passages 118*a* and 118*b* easily flows into the outside flow passages 116*a* and 116*b* through the flow port 120.

When the inner tube 115 does not rotate or when the inner tube 115 rotate together with the outer tube 114, the flow passage auxiliary wall 122 can be formed to extend up to the inside of the flow port 120. However, when the outer tube 114 and the inner tube 115 asynchronously rotate, the flow passage auxiliary wall 122 needs to be disposed inside the outside flow passage 116 not to come into contact with the inner tube 115.

Further, as described in the embodiment illustrated in FIG. 34, even when the inner tube 115 is divided into the inner tube 115*a* and the inner tube 115*b*, the flow passage auxiliary wall 122 may be disposed to be fixed to the inner wall of the outer tube 114 near the passages 112*a* and 112*b*. Therefore, it is possible to enable the cooling liquid flowing in through the inside flow passages 118*a* and 118*b* to easily flow into the outside flow passages 116*a* and 116*b* through the passages 112*a* and 112*b*.

Configuration Example 8

Figure 49A:
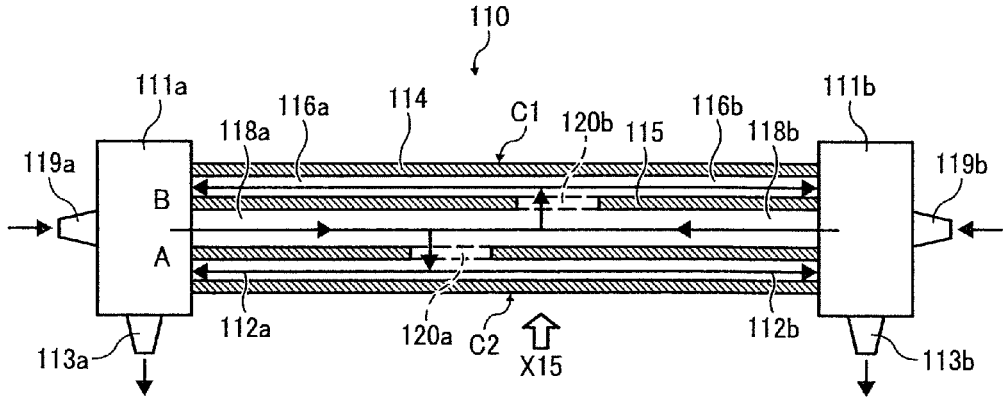
FIG. 49A is a cross-sectional view illustrating a schematic configuration of a cooling roller of a configuration example 8 according to the third embodiment.
Figure 49B:
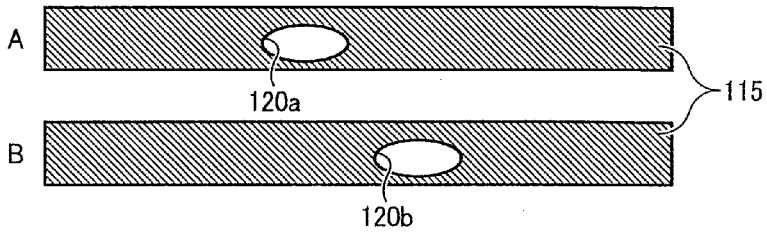
FIG. 49B is an enlarged cross-sectional view illustrating an inner tube of the cooling roller of the configuration example 8.

Next, a cooling roller 110 according to a configuration example 8 is illustrated in FIGS. 49A and 49B. FIG. 49A is a schematic cross-sectional view of a cooling roller 110 having a structure in which the rotating tube joint unit 111 are mounted to both axial direction ends of the cooling roller 110, and the two passages 112*a* and 112*b* are communicated with each other through the flow port 120. FIG. 49B is a cross-sectional view when the cooling roller 110 illustrated in FIG. 49A is viewed in a direction of an arrow X15 in the drawing.

In the present configuration example, at least two flow ports 120*a* and 120*b* that allow the outside flow passage 116 and the inside flow passage 118 to communicate with each other are formed in the inner tube 115. Positions where the cooling liquids are returned in the longitudinal direction of the cooling roller 110 are different in the circumferential direction. Therefore, it is possible to prevent all of the cooling liquids from flowing from the inside flow passage 118 to the outside flow passage 116 at the same position of the longitudinal direction of the cooling roller 110 over one round in the circumferential direction.

At a circumferential direction position C2 of the cooling roller 110 of FIG. 49A, the cooling liquid is fed from the feed port 119*a* of the first rotating tube joint unit 111*a* to the inside of the cooling roller 110, passes through the inside flow passage 118*a* inside the inner tube 115, passes through the outside flow passage 116*a* and the outside flow passage 116*b* that are the spaces between the outer tube 114 and the inner tube 115 via the flow port 120*a* present in the middle in the longitudinal direction of the cooling roller 110, and is drained from the drain port 113*a* of the first rotating tube joint unit 111*a* or the drain port 113*b* of a second rotating tube joint unit 111*b*.

Similarly, the cooling liquid is fed from the feed port 119*b* of the second rotating tube joint unit 111*b* to the inside of the cooling roller 110, passes through the inside flow passage 118*b* inside the inner tube 115, passes through the outside flow passage 16*a* and the outside flow passage 116*b* that are the spaces between the outer tube 114 and the inner tube 115 via the flow port 120*a* present in the middle in the longitudinal direction of the cooling roller 110, and is drained from the drain port 113*a* of the first rotating tube joint unit 111*a* or the drain port 113*b* of a second rotating tube joint unit 111*b*.

At a circumferential direction position C1 of the cooling roller 110 of FIG. 49A, the cooling liquid is fed from the feed port 119*a* of the first rotating tube joint unit 111*a* to the inside of the cooling roller 110, passes through the inside flow passage 118*a* inside the inner tube 115, passes through the outside flow passage 116*a* and the outside flow passage 116*b* that are the spaces between the outer tube 114 and the inner tube 115 via the flow port 120*b* present in the middle in the longitudinal direction of the cooling roller 110, and is drained from the drain port 113*a* of the first rotating tube joint unit 111*a* or the drain port 113*b* of a second rotating tube joint unit 111*b*.

Similarly, the cooling liquid is fed from the feed port 119*b* of the first rotating tube joint unit 111*b* to the inside of the cooling roller 110, passes through an inside flow passage 118*b* inside the inner tube 115, passes through the outside flow passage 116*a* and the outside flow passage 116*b* that are the spaces between the outer tube 114 and the inner tube 115 via the flow port 120*b* present in the middle in the longitudinal direction of the cooling roller 110, and is drained from the drain port 113*a* of the first rotating tube joint unit 111*a* or the drain port 113*b* of a second rotating tube joint unit 111*b*.

As described above, a plurality of flow ports formed in the inner tube 115 are disposed at different positions in the circumferential direction of the cooling roller 110. When the cooling liquids flowing in through the outside flow passages 116 at different positions in the circumferential direction flow into the inside flow passage 118, the cooling liquids flowing into the inside flow passage 118 from the different flow ports 120 do not collide with each other. Therefore, opposite flow or the turbulence can be reduced, and the flow of the cooling liquid from the outside flow passage 116 to the inside flow passage 118 becomes smooth, thereby increasing the cooling efficiency. Therefore, since opposite flow or the turbulence can be reduced, it is possible to prevent the cooling efficiency from being locally lowered.

Configuration Example 9

Figure 50:
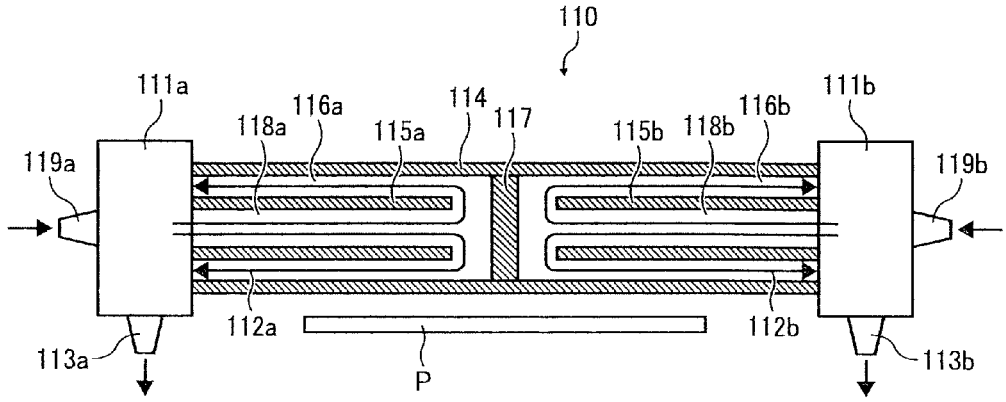
FIG. 50 is a cross-sectional view illustrating a schematic configuration of a cooling roller of a configuration example 9 according to the third embodiment.

Next, a cooling roller 110 according to a configuration example 9 is illustrated in FIG. 50. FIG. 50 is a schematic cross-sectional view of a cooling roller 110 having a structure in which the rotating tube joint unit 111 are mounted to both axial direction ends of the cooling roller 110, and the passage 112*a* and the passage 112*b* are communicated with each other through the flow port 120. The paper P that became a high temperature while passing through the heat fixing unit 16 (see FIG. 2) is transported in a direction orthogonal to the longitudinal direction of the cooling roller 110.

In FIG. 50, the cooling liquid is fed from the feed port 119*a* of the first rotating tube joint unit 111*a* to the inside of the cooling roller 110, passes through the inside flow passage 118*a* inside the inner tube 115*a*, is returned by the flow passage wall 117, which separates the passage 112*a* and the passage 112*b*, present in the middle in the longitudinal direction of the cooling roller 110, passes through the outside flow passage 116*a* that is the space between the outer tube 114 and the inner tube 115*a*, and is drained from the drain port 113*a* of the first rotating tube joint unit 111*a*.

Similarly, the cooling liquid is fed from the feed port 119*b* of the second rotating tube joint unit 111*b* to the inside of the cooling roller 110, passes through the inside flow passage 118*b* inside the inner tube 115*b*, is returned by the flow passage wall 117, which separates the passage 112*a* and the passage 112*b*, present in the middle in the longitudinal direction of the cooling roller 110, passes through the outside flow passage 116*b* that is the space between the outer tube 114 and the inner tube 115*b*, and is drained from the drain port 113*b* of the second rotating tube joint unit 111*b*.

Therefore, if heat is not received from the outside except the paper P, the temperature of the cooling liquid flowing through the outside flow passage 116 of the cooling roller 110 and the surface temperature of the outer tube 114 of the cooling roller 110 are lowest at a position where the cooling liquid is returned in the inside flow passages 118*a* and 118*b* and flows into the outside flow passages 116*a* and 116*b* and are highest at the first rotating tube joint unit 111*a* side or the second rotating tube joint unit 111*b* side.

For this reason, in the present configuration example, the paper P is transported in the longitudinal direction of the cooling roller 110 so that a central position of the paper P can pass through a position of the flow passage wall 117. As a result, the outer tube 114 of the cooling roller 110 is cooled down with a temperature gradient that becomes equal left and right in the width direction of the paper P, and the passages 112*a* and 112*b* are deprived of the same heat quantity. Therefore, it is possible to prevent the temperature of the cooling liquid from being greatly increased in any one of the passages 112.

Further, since the outer tube 114 of the cooling roller 110 is cooled down with the temperature gradient that is equal left and right in the width direction of the paper P, it is possible to reduce curl, and image quality and gloss unevenness caused by fixing in the width direction of the paper P.

Further, when the cooling roller of a structure that does not have the flow passage wall 117 formed in the cooling roller 110 is used in the present configuration example, the paper P is preferably transported in the longitudinal direction of the cooling roller 110 so that the central position of the paper P can pass through the central position of the flow port 120.

Here, if the width of the paper P is smaller than the length of the outside flow passage 116*a*, the cooling liquid is passed only to the passage 112*a*, and the paper P is transported on the passage 112*a* of the cooling roller 110 as illustrated in FIG.

51. As described above, the paper P is cooled down by passing the cooling liquid only to one flow passage 112*a*, thereby saving the energy and increasing the lift span of the cooling device 18.

Figure 51:
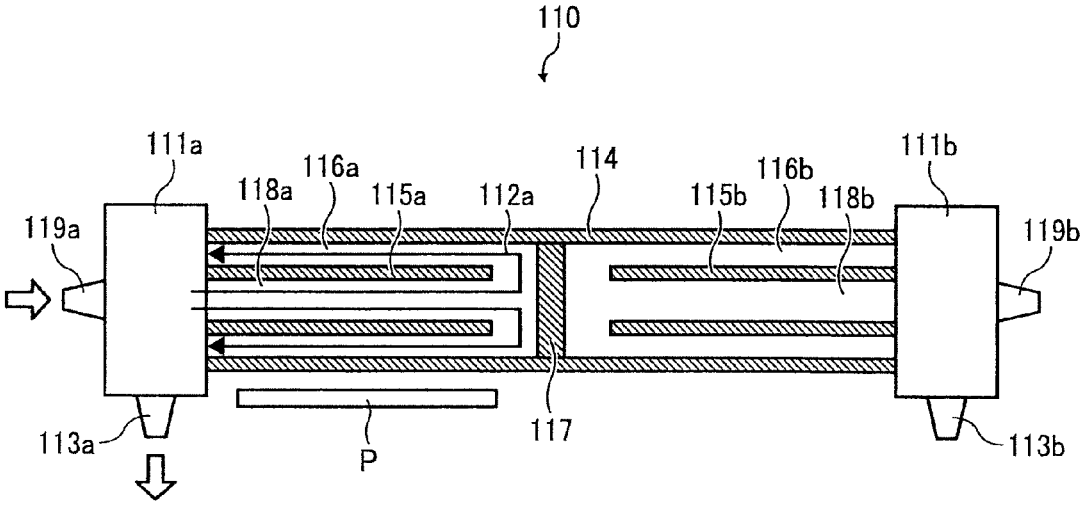
FIG. 51 is an explanation view illustrating a passing position of a paper with respect to a cooling roller.

In FIG. 51, the outside flow passage 116*a* is identical in length to the outside flow passage 116*b*. However, the outside flow passage 116*a* may be different in length from the outside flow passage 116*b*. In this case, the width of the paper P is detected. If the width of the paper P is smaller than both of the length of the outside flow passage 116*a* and the length of the outside flow passage 116*b*, the paper P can be transported on either of the outside flow passage 116*a* and the outside flow passage 116*b*. However, if the width of the paper P is larger than one of the length of the outside flow passage 116*a* and the length of the outside flow passage 116*b* and smaller than the other, the paper P is preferably transported on the outside flow passage 116*a* or the outside flow passage 116*b* that has the length larger than the width of the paper P.

Next, a case where the cooling liquid 102 is fed through one feed unit will be described with reference to FIG. 52.

In the cooling circulation device 150, illustrated in FIG. 52, used in the cooling device 18, the cooling liquid 102 inside the tank 101 is fed by the pump 100, and when passing through a radiator 154 that is a heat radiation unit, the cooling fan 153 blows air to radiate heat to the outside, thereby lowering the temperature of the cooling liquid 102 (heat exchange between the cooling liquid 102 and the outside). The cooling liquid 102 cooled down by the radiator 154 is fed to the inside of the cooling roller 110 from the feed port 119*a* of the first rotating tube joint unit 111*a* and the feed port 119*b* of the second rotating tube joint unit 111*b*, which are mounted to both axial direction ends of the cooling roller 110, through the feed tube 155 in which the flow passage is divided into two parts at a diverging point J1, and flows through the passage 112*a* or the passage 112*b* inside the cooling roller 110. At this time, the cooling roller 110 deprives the paper P, which became a high temperature while passing through the heat fixing unit 16, of heat, so that the temperature of the cooling liquid 102 inside the cooling roller 110 is raised (heat exchange between the cooling liquid 102 and the paper P). The cooling liquid 102 that was raised in temperature inside the cooling roller 110 is drained from the drain port 113*a* of the first rotating tube joint unit 111*a* or the drain port 113*b* of the second rotating tube joint unit 111*b*, passes through the liquid feed tube 155 that is joined into one flow passage at a joining point J2, and is fed again by the pump 100 via the tank 101. Through the circulation of the cooling liquid 102, radiating heat of the paper P to the outside of the cooling device 18 is repeated.

In the cooling circulation device 150 illustrated in FIG. 52, if the flow passage to the cooling roller 110 from after going out of the radiator 154 and the flow passages of the passage 112*a* side and the passage 112*b* side of the cooling roller 110 are the same in structure, feeding can be performed by one pump 100, so that the feed port 119*a* and the feed port 119*b* have the same flow quantity and pressure. Therefore, the cooling roller 110 can have the cooling efficiency that is symmetrical at the left side and the right side of the flow passage wall 117.

Next, a case where the cooling liquid 102 is fed through two feed unit will be described with reference to FIG. 53.

In the cooling circulation device 150 illustrated in FIG. 53, circulation systems of the cooling liquid 102 the passage 112*a* and the passage 112*b* of the cooling roller 110 have a flow passage R1 and a flow passage R2 which are independent of each other.

At the flow passage R1 side, the cooling liquid 102*a* inside the tank 101*a* is fed by the pump 100*a*, and when passing through the radiator 154*a*, the cooling fan 153*a* blows air to radiate heat to the outside, thereby lowering the temperature of the cooling liquid 101 (heat exchange between the cooling liquid 102*a* and the outside). The cooling liquid 102*a* cooled down by the radiator 154*a* is fed to the inside of the cooling roller 110 from the feed port 119*a* of the first rotating tube joint unit 111*a*, which is mounted to an axial direction one end of the cooling roller 110, through the feed tube 155*a*, and flows through the passage 112*a* inside the cooling roller 110. At this time, the cooling roller 110 deprives the paper P, which became a high temperature while passing through the heat fixing unit 16, of heat, so that the temperature of the cooling liquid 102*a* inside the cooling roller 110 is raised (heat exchange between the cooling liquid 102*a* and the paper P). The cooling liquid 102 that was raised in temperature inside the cooling roller 110 is drained from the drain port 113*a* of the first rotating tube joint unit 111*a* and is fed again by the pump 100*a* via the tank 101*a*.

Further, at the flow passage R2 side, the cooling liquid 102*b* inside the tank 101*b* is fed by the pump 100*b*, and when passing through a radiator 154*b*, the cooling fan 153*b* blows air to radiate heat to the outside, thereby lowering the temperature of the cooling liquid 102*b* (heat exchange between the cooling liquid 102*b* and the outside). The cooling liquid 102*b* cooled down by the radiator 154*b* is fed to the inside of the cooling roller 110 from the feed port 119*b* of the second rotating tube joint unit 111*b*, which is mounted to an axial direction one end of the cooling roller 110, through the feed tube 155*b*, and flows through the passage 112*b* inside the cooling roller 110. At this time, the cooling roller 110 deprives the paper P, which became a high temperature through the heat fixing unit 16, of heat, so that the temperature of the cooling liquid 102*b* inside the cooling roller 110 is raised (heat exchange between the cooling liquid 102*b* and the paper P). The cooling liquid 102 that was raised in temperature inside the cooling roller 110 is drained from the drain port 113*b* of the second rotating tube joint unit 111*b* and is fed again by the pump 100*b* via the tank 101*b*.

Therefore, when the passage 112*a* and the passage 112*b* inside the cooling roller 110 are different, when the passage 112*a* and the passage 112*b* of the cooling roller 110 are different in heat quantity received from the outside, or when the flow passages to the cooling roller 110 from after going out of the radiators 154*a* and 154*b* are different, it possible to independently control the feed liquid quantities of the pumps 152*a* and 152*b*, the air quantities of the cooling fans 153*a* and 153*b*, and the flow quantities of the cooling liquids 102*a* and 102*b*.

Next, a mechanism of adjusting the flow quantity of the cooling liquid 102 will be described.

When the cooling circulation device 150 is mounted in the image forming device, even though the flow passage to the cooling roller 110 from after going out of the radiator 154 and the flow passages of the passage 112*a* side and the passage 112*b* side of the cooling roller 110 are the same in structure, due to layout and spatial problems, the liquid feed tube 155 connected to the first rotating tube joint unit 111*a* may be different in length from the liquid feed tube 155 connected with the second rotating tube joint unit 111*b*. At this time, due to influence of pressure loss, the two passages inside the cooling roller 110, that is, the passage 112*a* and the passage 112*b* have different cooling efficiencies. Further, in addition to the configuration difference of a circulation system, a variation of the component accuracy or a variation between lots may occur. For these reasons, the flow quantity adjusting valve 156 is connected to the liquid feed tube 155 of the cooling circulation device 150, and thus the flow quantity can be adjusted by a mechanical mechanism.

Next, a case of detecting the temperature of the cooling liquid 102 to control the flow quantity of the cooling liquid 102 will be described. FIG. 54 illustrates an example in which temperature detecting unit 157*a* and 157*b* that detect the temperature of the cooling liquid 102 are disposed inside the tanks 101*a* and 101*b*.

The temperatures of the cooling liquids 102 detected by the temperature detecting unit 157*a* and 157*b* are feedback controlled. The flow quantity of the cooling liquid 102 is adjusted by adjusting the feed liquid quantities of the pumps 100*a* and 100*b* or the flow quantity adjusting valves 156*a* and 156*b* so that the cooling liquid 102 flowing through the passage 112*a* of the cooling roller 110 can have the same temperature as the cooling liquid flowing through the passage 112*b*.

Here, since a cooling target is the paper P transported on the cooling roller 110, a method of detecting the temperatures of the cooling liquids 102 flowing through the outside flow passages 116*a* and 116*b* inside the cooling roller 110 through the temperature detecting unit 157*a* and 157*b* and performing feedback control has the highest degree of accuracy. However, the outside flow passages 116*a* and 116*b* inside the cooling roller 110 have a problem on the space for disposing the temperature detecting units 157*a* and 157*b* or a problem in that the cooling roller 110 is rotary-driven. For this reason, as positions for actually forming the temperature detecting units 157*a* and 157*b*, positions where temperature detecting units 157*c* and 157*d* illustrated in FIG. 54 are disposed directly before the cooling liquids 102 flow into the feed port 119*a* of the first rotating tube joint unit 111*a* and the feed port 119*b* of the second rotating tube joint unit 111*b* are preferable. Further, a configuration of feeding back the temperature of the cooling liquid 102 detected by each temperature detecting unit 157 and controlling the air quantities of the cooling fans 153*a* and 153*b* to control the temperature of the cooling liquid 102 is possible.

In the present embodiment, it is also possible to control the flow quantity of the cooling liquid 102 by detecting the temperature near the surface of the cooling roller 110.

The temperature near the surface of the cooling roller 110 detected by the temperature detecting unit 158 is feedback controlled. The flow quantity of the cooling liquid 102 is adjusted, for example, by adjusting the feed liquid quantity of the pump 100 or the flow quantity adjusting valves 156*a* and 156*b* illustrated in FIG. 52 so that the cooling liquid flowing through the passage 112*a* of the cooling roller 110 can have the same temperature as the cooling liquid flowing through the passage 112*b*. Further, the temperature of the cooling liquid is controlled by feeding back the temperature near the surface of the cooling roller 110 of the cooling roller 110 detected by the temperature detecting unit 158 and controlling the air quantity of the cooling fan 153 of FIG. 52.

In the present embodiment, the rotating tube joint unit 111 are mounted to both axial direction ends of the cooling roller 110, but as illustrated in FIG. 55, a configuration in which the rotating tube joint unit 111 is mounted only to one end side of the cooling roller 110 is possible. In this case, the inside of the inner tube 115 disposed inside the outer tube 114 partially has the dual tube structure. The cooling liquid 102 fed from the feed port 119 of the rotating tube joint unit 111 flows through the inside flow passage 118*a* inside the inner tube 115 from one end side, which is a side at which the rotating tube joint unit 111 of the cooling roller is mounted, toward the other end side, passes through the communication port 120 formed in a central portion of the inner tube 115, is diverged by a diverging wall 125, and flows into the outside flow passage 116*a* and the outside flow passage 116*b*. The cooling liquid 102 flowing into the outside flow passage 116*a* flows through the outside flow passage 116*a* toward the one end side and is drained from the drain port 113 of the rotating tube joint unit 111. Meanwhile, the cooling liquid 102 flowing into the outside flow passage 116*b* flows through the outside flow passage 116*b* toward the other end side, is returned by the inside cross section of the outer tube 114 at the other end side, and flows into the inside flow passage 118*b* inside the inner tube 115. The cooling liquid 102 flowing into the inside flow passage 118 flows toward the one end side, passes through the inside flow passage 118*c* of the inner tube 115, and is drained from the drain port 113 of the rotating tube joint unit 111.

As described above, according to the present embodiment, the cooling device 18 includes the cooling roller 110 for contacting the paper P as the sheet-like member to cool the paper P and the pump 100 that is a cooling medium feeding/retrieving unit for feeding the cooling liquid 102 as the cooling medium to the inside of the cooling roller 110 from the feed port disposed in the cooling roller 110 and retrieving the cooling liquid 102 drained to the outside of the cooling roller 110 from the drain port disposed in the cooling roller 110. The cooling roller 110 has a dual tube structure in which the inner tube 115 is disposed inside the outer tube 114, and the outside flow passage 116 in which the cooling liquid 102 flows through the space between the outer tube 114 and the inner tube 115 and the inside flow passage 118 in which the cooling liquids 102 flows inside the inner tube 115 are formed. An opening that allows the outside flow passage 116 and the inside flow passage 118 to communicate with each other is formed in the middle of the inner tube 115 in the longitudinal direction of the cooling roller 110. The passage 112*a* as a first passage in which the cooling liquid 102 fed by the pump 100 flows the inside flow passage 118, flows into the outside flow passage 116 via the opening, and flows toward at least one end side of the cooling roller 110 and the passage 112*b* as a second passage in which the cooling liquid 102 fed by the pump 100 flows through the inside flow passage 118, flows into the outside flow passage 116 via the opening, and flows toward at least the other end side of the cooling roller 110 are formed. According to this configuration, the passage in which the cooling liquid 102 flows is divided into two parts in the longitudinal direction of the cooling roller 110 to cool down the cooling roller 110. Therefore, compared to the configuration in which the cooling liquid 102 flows in one direction in the longitudinal direction of the cooling roller 110, the temperature increment of the cooling roller 110 can be further reduced. Further, the temperature difference in the longitudinal direction and the temperature difference between both ends of the cooling roller 110 can be reduced. Further, uniform image quality and gloss can be obtained in the width direction of the cooling roller 110. Further, the temperature control may be performed symmetrically in the longitudinal direction of the cooling roller 110, and thus the curl of the paper P can be reduced.

Further, according to the present embodiment, a configuration may be employed in which the opening is formed in a central portion of the inner tube 115 in the longitudinal direction of the cooling roller; at one end side of the cooling roller 110, a first feed port for feeding the cooling liquid 102 to the inside of the cooling roller 110 and a first drain port for draining the cooling liquid 102 from the inside of the cooling roller 110 to the outside of the cooling roller 110 are formed; at the other end side of the cooling roller 110, a second feed port for feeding the cooling liquid 102 to the inside of the cooling roller 110 and a second drain port for draining the cooling liquid 102 from the inside of the cooling roller 110 to the outside of the cooling roller 110 are formed; the cooling liquid 102 fed from the first feed port, in the passage 112*a*, flows through the inside flow passage 118, flows into the outside flow passage 116 through the opening, flows toward at least one of the one end side and the other end side, and is drained from at least one of the first drain port and the second drain port; and the cooling liquid 102 fed from the second feed port, in the passage 112*b*, flows through the inside flow passage 118, flows into the outside flow passage 116 through the opening, flows toward at least one of the one end side and the other end side, and is drained from at least one of the first drain port and the second drain port. According to this configuration, since the configuration of the cooling roller 110 is simplified, the cost of the cooling device 18 can be reduced.

Further, according to the present embodiment, a configuration may be employed in which the opening is formed in a central portion of the inner tube 115 in the longitudinal direction of the cooling roller 110; at one end side of the cooling roller 110, a first feed port for feeding the cooling liquid 102 to the inside of the cooling roller 110 is formed; at the other end side of the cooling roller 110, a second feed port for feeding the cooling liquid 102 to the inside of the cooling roller 110 is formed; a drain port for draining the cooling liquid 102 from the inside of the cooling roller 110 to the outside of the cooling roller 110 is formed at any of one end side and the other end side of the cooling roller 110; the cooling liquid 102 fed from the first feed port, in the passage 112*a*, flows through the inside flow passage 118, flows into the outside flow passage 116 through the opening, flows toward at least one of the one end side and the other end side, and is drained from the drain port; and the cooling liquid 102 fed from the second feed port, in the passage 112*b*, flows through the inside flow passage 118, flows into the outside flow passage 116 through the opening, flows toward at least one of the one end side and the other end side, and is drained from the drain port. According to this configuration, since one common port is formed as the drain port of the cooling liquid 102 flowing through the passage 112*a* and the passage 112*b*, the configuration of the cooling roller 110 is simplified, thereby reducing the cost of the cooling device 18. Further, it is possible to facilitate routing of the liquid feed tube 155 that connects the drain port with the pump 100.

Further, according to the present embodiment, a configuration may be employed in which the flow passage wall 117 that is a partition for dividing the inside of the cooling roller 110 into two parts is disposed in the middle in the longitudinal direction of the cooling roller; at one end side of the cooling roller 110, a first feed port for feeding the cooling liquid 102 to the inside of the cooling roller 110 and a first drain port for draining the cooling liquid 102 from the inside of the cooling roller 110 to the outside of the cooling roller 110 are formed; at the other end side of the cooling roller 110, a second feed port for feeding the cooling liquid 102 to the inside of the cooling roller 110 and a second drain port for draining the cooling liquid 102 from the inside of the cooling roller 110 to the outside of the cooling roller 110 are formed; the cooling liquid 102 fed from the first feed port, in the passage 112*a*, flows through the inside flow passage 118, is returned by the flow passage wall 117, flows into the outside flow passage 116 located at the one end side of the flow passage wall 117, and is drained from the first drain port; the cooling liquid 102 fed from the second feed port, in the passage 112*b*, flows through the inside flow passage 118, is returned by the flow passage wall 117, flows into the outside flow passage 116 located at the other end side of the flow passage wall 117, and is drained from the second drain port. According to this configuration, since the configuration of the cooling roller 110 is simplified, the cost of the cooling device 18 can be reduced.

Further, according to the present embodiment, positions where the cooling liquids 102 are returned by the flow passage wall 117 in the middle of the passage 112*a* and the passage 112*b* in the longitudinal direction of the cooling roller 110 may be stepwise or continuously changed depending on a position along the circumferential direction of the cooling roller 110. According to this configuration, it is possible to eliminate a spot in which the cooling liquid does not flow in the outside flow passage 116 over all circumferences of the cooling roller 110 and over the longitudinal direction of the cooling roller 110 in an area of the cooling roller 110 at which the paper P is transported, and thus it is possible to eliminate a spot that can not be locally cooled down.

Further, according to the present embodiment, the rotating tube joint unit 111 that is a support unit for rotatably supporting the outer tube 114 and fixedly supporting the inner tube 115 may be disposed at each end of the cooling roller 110. According to this configuration, the turbulence is generated in the flow (the flow in the longitudinal direction and the rotation direction) of the cooling liquid 102 inside the outside flow passage 116 near the outer tube 114, and thus the cooling efficiency can be increased.

Further, according to the present embodiment, the rotating tube joint unit 111 that is a support unit for rotatably supporting the outer tube 114 and the inner tube 115 may be disposed at each end of the cooling roller 110. According to this configuration, the flow (the flow in the rotation direction and the axial direction) of the cooling liquid 102 inside the outside flow passage 116 becomes smooth, and thus the cooling efficiency can be increased.

Further, according to the present embodiment, the flow passage auxiliary wall 122, 123, or 124 may be disposed near the opening as the guide wall for guiding the cooling liquid 102 from the inside flow passage 118 to the outside flow passage 116 through the opening. According to this configuration, the cooling liquids 102 flowing in through the two different inside flow passages 118 are not directly joined, and thus the flow can be smoothly guided in a direction from the inside flow passage 118 to the outside flow passage 116. Therefore, it is possible to prevent the cooling efficiency from being lowered.

Further, according to the present embodiment, a plurality of opening may be formed at different positions in the longitudinal direction of the inner tube 115. According to this configuration, due to the positions where the openings are present in the longitudinal direction of the cooling roller 110, positions in which the cooling liquids 102 flowing in from the outside flow passage 116 through the two different outside flow passages 116 collide with each other are changed depending on a position over the all circumferences of the cooling roller 110. Therefore, it is possible to prevent the cooling efficiency from being locally lowered.

Further, according to the present embodiment, a configuration may be employed in which a center of the width of the paper P in a direction orthogonal to the longitudinal direction of the cooling roller passes through near a position where the cooling liquid 102 flows into the inside flow passage 118 from the outside flow passage 116 in the passage 112*a* and a position where the cooling liquid 102 flows into the inside flow passage 118 from the outside flow passage 116 in the passage 112*b*. According to this configuration, the paper is transported so as to be centered so that the areas of the paper P passing at the two different outside flow passages 116 is equal, and thus it is possible to reduce curl, and image quality and gloss unevenness caused by fixing in the width direction of the paper P.

Further, according to the present embodiment, when the width of the paper P in a direction orthogonal to the longitudinal direction of the cooling roller 110 is smaller than the width of any one of the outside flow passage 116 of the passage 112*a* and the outside flow passage 116 of the passage 112*b* in the longitudinal direction of the cooling roller 110, the paper P may be transported on the passage 112*a* or the passage 112*b* that has the width, in the longitudinal direction of the cooling roller, larger than the width of the paper P and the cooling liquid 102 may be flowed only in the passage at a side in which the paper P is transported. According to this configuration, since the paper P is cooled down by passing the cooling liquid to one of the passage 112*a* and the passage 112*b*, the energy can be saved.

Further, according to the present embodiment, feeding the cooling liquid 102 flowing to the passage 112*a* and the passage 112*b* may be performed by one liquid feed unit. According to this configuration, since the cooling liquid 102 flows to the passage 112*a* and the passage 112*b* by one liquid feed unit, the size of the cooling device can be reduced, and the cost can be reduced. The passage 112*a* and the passage 112*b* may have the same configuration. Thereby, the temperature and the temperature gradient of the cooling roller 110 can become equal left and right in the longitudinal direction of the cooling roller 110.

Further, according to the present embodiment, the cooling liquid 102 flowing in the passage 112*a* and the cooling liquid 102 flowing in the passage 112*b* may be fed by different liquid feed units. According to this configuration, it is possible to independently control the quantity of the flow flowing in the passage 112*a* and the quantity of the flow flowing in the passage 112*b*. Further, a liquid feed unit that is low in liquid feed performance, small in size, and low in cost can be used.

Further, according to the present embodiment, the flow quantity adjusting valve 156 may be disposed as the flow quantity adjusting unit for adjusting the flow quantity of the cooling liquid 102 flowing in the passage 112*a* and the passage 112*b*, and the flow quantity of the cooling liquid 102 flowing in the passage 112*a* and the flow quantity of the cooling liquid 102 flowing in the passage 112*b* may be equaled by the flow quantity adjusting valve 156. According to this configuration, control can be performed so that the temperature gradient can be symmetrical about a boundary between the passage 112*a* and the passage 112*b* in the longitudinal direction of the cooling roller 110. Further, it is possible to reduce curl, and image quality and gloss unevenness caused by fixing in the width direction of the paper P.

Further, according to the present embodiment, a configuration may be employed in which the flow quantity adjusting valve 156 that is the flow quantity adjusting unit for adjusting the flow quantity of the cooling liquid 102 flowing in the passage 112*a* and the passage 112*b* and the temperature detecting unit 157 for detecting the temperature of the cooling liquid 102 flowing in the passage 112*a* and the passage 112*b* are disposed; and based on the temperature of the cooling liquid 102 detected by the temperature detecting unit 157, the flow quantity of the cooling liquid 102 flowing in the passage 112*a* and the flow quantity of the cooling liquid 102 flowing in the passage 112*b* are adjusted by the flow quantity adjusting valve 156 so that the passage 112*a* and the passage 112*b* can have the same cooling efficiency. According to this configuration, control is performed so that the temperature and the temperature gradient of the cooling roller 110 are equal right and left in the longitudinal direction of the cooling roller 110, and thus it is possible to reduce curl, and image quality and gloss unevenness caused by fixing in the width direction of the paper P.

Further, according to the present embodiment, a configuration may be employed in which the radiator 154 that is the heat radiating unit for radiating heat of the cooling liquid 102 to the outside, the cooling fan 153 for blowing air to the radiator 154, the air quantity control unit for controlling the air quantity of the cooling fan 153, and the temperature detecting unit 157 for detecting the temperature of the cooling liquid flowing in the passage 112*a* and the passage 112*b* are disposed, and based on the temperature of the cooling liquid 102 detected by the temperature detecting unit 157, the air quantity of the cooling fan 153 is controlled by the air quantity control unit so that the cooling liquid 102 flowing in the passage 112*a* has the same temperature as the cooling liquid 102 flowing in the passage 112*b*. According to this configuration, control is performed so that the temperature and the temperature gradient of the cooling roller 110 are equal right and left in the longitudinal direction of the cooling roller 110, it is possible to reduce curl, and image quality and gloss unevenness caused by fixing in the width direction of the paper P.

Further, according to the present embodiment, a configuration may be employed in which the flow quantity adjusting valve 156 that is the flow quantity adjusting unit for adjusting the flow quantity of the cooling liquid 102 flowing in the passage 112*a* and the passage 112*b* and the temperature detecting unit 158 for detecting the temperature near the surface of the cooling roller 110 on the passage 112*a* and the passage 112*b* are disposed; and based on the temperature, near the surface of the cooling roller 110, detected by the temperature detecting unit 158, the flow quantity of the cooling liquid 102 flowing in the passage 112*a* and the flow quantity of the cooling liquid 102 flowing in the passage 112*b* are adjusted by the flow quantity adjusting valve 156 so that the temperature near the surface of the cooling roller 110 on the passage 112*a* is equal to the temperature near the surface of the cooling roller 110 on the passage 112*b*. According to this configuration, control is performed so that the temperature and the temperature gradient of the cooling roller 110 are equal right and left in the longitudinal direction of the cooling roller 110, and thus it is possible to reduce curl, and image quality and gloss unevenness caused by fixing in the width direction of the paper P.

Further, according to the present embodiment, a configuration may be employed in which the radiator 154 that is the heat radiating unit for radiating heat of the cooling liquid 102 to the outside, the cooling fan 153 for blowing air to the radiator 154, the air quantity control unit for controlling the air quantity of the cooling fan 153, and the temperature detecting unit 158 for detecting the temperature near the surface of the cooling roller 110 on the passage 112*a* and the passage 112*b* are disposed; and based on the temperature, near the surface of the cooling roller 110, detected by the temperature detecting unit 158, the air quantity of the cooling fan 153 is controlled by the air quantity control unit so that the temperature near the surface of the cooling roller 110 on the passage 112*a* is equal to the temperature near the surface of the cooling roller 110 on the passage 112*b*. According to this configuration, control is performed so that the temperature and the temperature gradient of the cooling roller 110 is equal right and left in the longitudinal direction of the cooling roller 110, and thus it is possible to reduce curl, and image quality and gloss unevenness caused by fixing in the width direction of the paper P.

Further, according to the present embodiment, in the image forming device that includes the toner image forming unit for forming the toner image on the paper P, the heat fixing unit 7 for fixing the toner image, formed on the paper P, on the paper P by at least heat, and the cooling unit for cooling down the paper P on which the toner image is fixed by the heat fixing unit 7, the cooling device 18 of the present invention is used as the cooling unit. Thereby, it is possible to reduce curl, and image quality and gloss unevenness caused by fixing in the width direction of the paper P.

As described above, according to the present invention, an excellent effect of being capable of improving the cooling efficiency of the sheet-like member by the cooling roller is achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cooling device, comprising: a cooling roller that comprises a hollow tubular member;

a cooling medium transport unit that transports a cooling liquid to an inside of the hollow tubular member; and a turbulence generating unit that has a helical shape in a single winding direction and is disposed near an inner wall of the hollow tubular member to generate turbulence in the cooling liquid, wherein the cooling device is configured to cause the cooling roller to contact a sheet-like member to cool down the sheet-like member, wherein a winding direction of the helical shape is set to cause feeding in a direction reverse to a flow direction of a cooling liquid flowing near the inner wall of the hollow tubular member.

2. The cooling device according to claim 1, wherein the turbulence generating unit is detachably attached to the hollow tubular member.

3. The cooling device according to claim 1, wherein the cooling roller has a dual tube structure in which, in a hollow inside of an outer tube that is the hollow tubular member, an inner tube, which has a tube structure finer than an outer tube, is disposed and which has an outside flow passage in which a cooling liquid flows between the outer tube and the inner tube and an inside flow passage in which a cooling liquid flows inside the inner tube.

4. The cooling device according to claim 1, wherein the turbulence generating unit is disposed in an area extending in a circumferential direction of the outer tube where the sheet-like member is held.

5. The cooling device according to claim 1, wherein the turbulence generating unit is a coil-like member.

6. The cooling device according to claim 1, wherein the turbulence generating unit is a net-like member.

7. An image forming apparatus comprising the cooling device according to claim 1.

8. The cooling device according to claim 1, wherein a winding direction of the helical shape is set to cause feeding in a same direction as a flow direction of the cooling liquid.

9. The cooling device according to claim 1, wherein a winding direction of the helical shape is set to cause feeding in a direction reverse to a flow direction of the cooling liquid.

* * * * *